United States Patent [19]

Brown

[11] Patent Number: 4,698,249

[45] Date of Patent: Oct. 6, 1987

[54] MODULAR-ACCESSIBLE-TILES PROVIDING ACCESSIBILITY TO CONDUCTORS AND PIPING WITH IMPROVED SOUND ISOLATION

[76] Inventor: John G. Brown, 20205 State Line Rd., Harvard, Ill. 60033

[21] Appl. No.: 783,309

[22] Filed: Oct. 2, 1985

Related U.S. Application Data

[63] Continuation of Ser. No. 391,760, Jun. 24, 1982, Pat. No. 4,546,024, which is a continuation-in-part of Ser. No. 131,516, Mar. 18, 1980, abandoned.

[51] Int. Cl.[4] ..... B32B 3/00; E04F 15/16

[52] U.S. Cl. ..... 428/44; 52/309.13; 52/385; 52/390; 428/47; 428/49; 428/54; 428/57; 428/189

[58] Field of Search ..... 428/44, 49, 51, 54, 428/57, 109, 192; 52/384, 385, 389, 390, 403, 747, 309, 13; 156/71

[56] References Cited

U.S. PATENT DOCUMENTS

| | | | |
|---|---|---|---|
| 3,335,048 | 8/1967 | Morain | 52/390 |
| 3,817,012 | 6/1974 | Wack | 52/385 |
| 3,902,293 | 9/1975 | Witt et al. | 428/201 |
| 3,988,187 | 10/1976 | Witt et al. | 428/53 |
| 4,546,024 | 10/1985 | Brown | 428/54 |
| 4,567,704 | 2/1986 | Bernett et al. | 428/49 |

*Primary Examiner*—Paul J. Thibodeau

[57] ABSTRACT

An array of gravity-held-in-place-load-bearing-horizontal-modular-accessible-tiles with flexible joints between adjacent modular-accessible-tiles in which the flexible joints are cuttable and reassembleable to provide accessibility to flat conductor cable disposed above or below one or more horizontal-disassociation-cushioning-layers which require flexible joints between adjacent modular-accessible-tiles to be dynamic-interactive-fluidtight-flexible-joints to assemble the modular-accessible-tiles by gravity, friction, and accumulated-interactive-assemblage into a floating finished floor array without adherence to the horizontal-base-surface, wherein the horizontal-disassociation-cushioning-layer provides accommodation to the thickness variations cause by termination and crossing over of layers of flat conductor cables and the horizontal-disassociation-cushioning-layer also provides improved impact sound isolation.

20 Claims, 34 Drawing Figures

J.B.M.
10
14
10
15
14
10
35
16
35
16

C-M.A.T.
10
14
24
10
24
14
1
10
19
17
27
19
17
27
36
19
16
16
J.B.M.
ADJACENT M.A.T.
M.A.T.

C-M.A.T.
10
14
24
10
10
24
15
14
9
10
19
27
32
18
18
27
32
2
36
19
16
16
JB.M.
ADJACENT M.A.T.
M.A.T.

R-C-M.A.T.
10
14
12
33
10
10
15
14
36
10
19
25
26
27
34
25
26
27
34
33
3
19
16
16
J.B.M.
ADJACENT M.A.T.
M.A.T.

R-C-M.A.T.
10
14
33
10
10
15
14
4
10
19
27
25
26
27
32
34
25
26
27
32
33
34
36
27
19
16
16
J.B.M.
ADJACENT M.A.T.
M.A.T.

C-M.A.T.
10
14
24
10
10
15
14
5
10
12
27
27
24
36
27
J.B.M.
38
38
16
16

C-M.A.T.
10
14
24
10
10
24
14
6
24
27
32
39
39
32
27
36
39
27
J.B.M.
38
38
16
16

R-C-M.A.T.
10
12
14
33
10
10
15
14
7
10
27
34
41
41
27
34
33
36
J.B.M.
38
38
16
16

R-C-M.A.T.
10
14
10
33
10
33
15
14
8
10
25
26
27
32
34
32
34
25
26
27
J.B.M.
38
38
16
16

MODULAR-ACCESSIBLE-TILES PROVIDING ACCESSIBILITY TO CONDUCTORS AND PIPING WITH IMPROVED SOUND ISOLATION

This is a continuation of application Ser. No. 391,760 filed June 24, 1982, which issued Oct. 8, 1985, as U.S. Pat. No. 4,546,024, which is a continuation-in-part of application Ser. No. 131,516 filed Mar. 18, 1980, now abandoned and refiled as a file wrapper continuation Jan. 3, 1984, as Ser. No. 567,151.

BACKGROUND OF THE INVENTION

Tile floors are desirable for many purposes, since they are easily maintained in clean condition and in high level of appearance, and are less subject to wear than carpeted floors, where the appearance level is reduced rapidly to a generally lower level than when originally installed. Accordingly, tile floors are highly desirable for use in multi-story public and government buildings; public assembly buildings; community buildings; educational buildings; religious buildings; medical buildings and hospitals; commercial and mercantile buildings, such as, banks, eating and drinking establishments, stores; office buildings; and residential buildings, such as, apartments and condominiums, housing for the elderly, nursing homes, and private residences; particularly in arid and semi-arid areas with sand and other areas where blowing sand is a continuing problem. Likewise, tile floors are highly preferably from a maintenance and durability point of view for rental apartments and condominiums, public housing, nursing homes, and the like.

The present evolution of a highly industrialized throwaway technological society, which is very intensive in utilization of energy and resources, has brought into focus the realization that we need to invent such as some of the following:

- We need new ways to conserve or eliminate use of finite energy reserves, to mention a few:
  - To produce products that are of long-term endurance with low energy use in production, transportation, and installation
  - To transport products to factories
  - To transport to project point of use
  - To install finished products by means using minimum energy during installation
  - To make products to last substantially longer
- We need to re-use durable products directly, without expensive recycling
- We need to find ways for products to give more essential benefits, that is, synthesized products which perform a plurality of benefits in creative living and working environments Current identified problems of the present energy and resource intensive, throwaway, industrialized society are the seed bed for inventing new products or inventing new ways of assembling existing durable products to fully utilize their inherent durability and/or re-use or recycling our finite, non-renewable resources and energy or industrially-manufactured products with optimum minimization of energy and resource costs or environmental quality costs in the various stages of gathering resources and energy, transporting resources to factories or construction sites, manufacturing finished products from gathered resources and energy, transporting, distributing and assembling into finished beneficial products at points of use to provide optimum beneficial quality of living, with due consideration to future costs in benefically preserving, re-using, recycling and converting to future uses.

Ceramic, quarry, selected natural stone, and hardwood flooring, and the like, have proven capability to last centuries when properly installed, while currently these tiles installed with rigid joints more often than not have cracking of joints or penetration of the tile joints by liquids and chemcials which cause loosening of the rigid bonding of the tile to the supporting substrate, causing breaking of the tile and further loosening of adjacent tile, or acids in liquids deteriorate structural elements, such as steel reinforcement in concrete substrate, or allow unsanitary liquids to drain down on occupied spaces below.

Common causes of tile popping off include (1) the use of soaps or cleaning solutions containing salts or acids, which penetrate through the commonly used sand-and-cement tile joints (which have a porosity of 9 to 10%) to the setting bed, the salts growing in size over a period of 10 years or so, causing the tiles to come up; (2) the use of an acid solution to clean the tile regularly, even the strongly acid tile cleaner commonly used to clean the tile during construction, followed by improper or insufficient rinsing, with subsequent wetting of the tile reactivating the acids, with consequent deterioration of the joint; (3) deflection of the slab due to a structural problem, causing tiles to heave upward and shear off clean as through there were no bond, the bond being the weakest part of the conventional construction assembly. Therefore, utilizing dynamic-interactive-fluidtight-elastomeric-adhesive-sealant-joints of this teaching to assemble tile into a more fluidtight assembly with flexible, more impervious, fluidtight joints gives the dynamic, interactive matrix of the tiles the capacity to overcome many of these common problems, along with achieving the following:

- Durability of the installation by using gravity and friction and accumulated-interactive-assemblage
- Improved sound isolation
- Re-use of the tile covering Conventional grouts, thin-set mortars, and mortar setting beds, as well as improved conventional grouts and thin-set mortars with a variety of new type additives, are all rigid in nature, requiring a rigid substrate, wherein this rigid support depends on rigid bond and support, and such tiles are all subject to gradual penetration of liquids in varying degrees working their way through grout joints, thin-set mortars or mortar setting beds adhering the tiles, causing gradual swelling, bacterial growth, bond disintegration, which lead to gradual coming loose of tile in most installations from their horizontal-base-surface, and deflection of the horizontal-base-surface quite often causes conventional, rigidly set and rigidly grouted tiles to come loose, which uncushioned tiles easily break against their rigid substrate and adjacent tiles, causing additional disintegration of tile, whereas this invention exploits the gravity weight of the tile, friction, and accumulated-interactive-assemblage combined with the flexible joints between adjacent tiles, forming a dynamic, interactive, floating assembly with fluidtight-flexible-joints between adjacent tile free of penetration of fluids to the horizontal-base-surface below, beyond the porosity of the tile itself, which tile, if it is made of good quality clays fired at high temperature, is of very low porosity, wherein the tile is held in place by a more dependable force of gravity with a proven superior duration when compared with conventional rigid bonding means for attaching tile to a horizontal-base-surface, and wherein floating tiles are cushioned against breakage by horizontal-disassociation-cushioning-layer which concurrently provides the improved impact sound isolation disassociation within a very thin combination.

There are three different types of sound control required in floor/ceiling assemblies between occupied spaces in contemporary habitable environments:

Sound Transmission Class (STC)-the Federal government has determined that in most situations a wall or floor/ceiling system shall have Sound Transmsision Loss Class greater than STC 52 when evaluated in relationship to acceptable ambient background level Impact Isolation Class (IC)-the Federal government has determined that in most situations a wall or floor/ceiling system shall have a Sound Isolation Class greater than IIC 52 to provide sufficient impact sound isolation in a floor/ceiling assembly between individual habitable living units in multiple-level housing Noise Reduction Coefficient (NRC)-measures or indicates the ability of a material to absorb sound-the Federal government has no standards on this, and its value standard is determined by the Architect and/or Acoustical Engineer

NOTE:

Allowable sound levels mentioned above are discussed in A GUIDE TO AIRBORNE, IMPACT AND STRUCTURAL BORNE NOISE CONTROL IN MULTIFAMILY DWELLINGS published by the U.S. Department of Housing and Urban Development as levels for Grade II Multiple Dwelling Residential Urban and Suburban Areas which, by definition, are areas of average noise levels. No federal standards exist yet, although they are needed, for commercial and industrial buildings, except as are required by local codes, regulations or personal standards of individual owners, architects, engineers, etc.

As to this invention, all three of the above different types of sound control values are affected to varying degrees by this invention. Unquestionably, the Impact Isolation Class (IIC) is of the greatest importance and benefit from this invention, and the Sound Transmission Class (STC) is of next greatest importance and benefit from this invention.

However, as a disadvantage to the currently available tile floors in multi-story structures, those above the first floor of a building are highly transmissive to impact sound generated, for example, by the shoe heels of a person walking across the tile floor (women with spike heels and men with metal clips), or other forms of impact on the floor. The sound is transmitted to the floor below, and in the event of a heavy traffic area, such as, a restaurant, a dance floor, apartments, condominiums, nursing homes, hospitals, or the like, impact sound transmission through the floor below to occupied spaces below can be a very serious problem, requiring the installation of carpeting even when, for other reasons, carpet is undesirable or not the best answer. As a result of this, it becomes very difficult to place a dance floor, or a high-traffic restaurant, hospital, nursing home or apartment on an upper floor of a multi-story building since there are strong reasons or personal perferences to leave such establishments uncarpeted but, rather with hard surface, enduring floors. The occupants of the floor below may be seriously disturbed by the continuous transmission of the impact of footsteps on the tile.

Similarly, in multi-story apartments and condominiums where it is desired to keep maintenance costs to a minimum, the impact sound of footsteps and the like from the apartment overhead can generate excessive disturbing noise and a continuous series of tenant complaints, forcing the installation of carpeting, with its added expense, periodic cleaning, replacement costs, and the like.

While previous attempts have been made to produce tile coverings having high loss of impact sound from transmission to other occupied areas, particularly areas below source of impact sound, they have not been very successful. For example, wood tiles have been placed on ½ inch plywood which, in turn, rests upon ¼ inch cork sheet lying on a wood or a concrete structural subfloor. With this configuration, the sound damping has not been exceptionally high, and the problem of warping of the plywood requires the use of screws to hold the plywood in place which, in turn, helps to transmit the impact sound to the structural subfloor. Also the system is not waterproof and comes up if water is allowed to stand on its surface overnight. This invention, using waterproof materials, overcomes this disadvantage.

In accordance with this invention, a horizontal-tile-array is provided having greatly reduced impact sound transmission through its horizontal-base-surface. If desired, this can be combined with improved thermal insulation or the floor supported on foam insulation, with or without a horizontal-disassociation-cushioning-layer, for impact sound isolation, and may be accomplished with a unique, dynamic systen in which the tiles are resiliently carried upon the horizontal-disassociation-cushioning-layer. In accordance with this invention, tile breakage, due to the receipt of an excessive load from a spike heel or a heavy woman or the like, can be essentially controlled or dampened for good tile floor life, coupled with a greatly improved impact sound isolation.

Current review and understanding of the existing state of the art for setting materials for cermaic tile is well presented and documented in the HANDBOOK FOR CERAMIC TILE INSTALLATION prepared by the Tile Council of America, Inc., wherein under the following headings are presented materials for setting ceramic tile:

Portland cement mortar
Dry-set mortar
Latex-portland cement mortar
Epoxy mortar
Modified epoxy emulsion mortars
Furan mortar This same HANDBOOK FOR CERAMIC TILE INSTALLATION also clearly discusses the special products for setting ceramic tile under the following headings:

Epoxy adhesive
Organic adhesive
Special tile-setting mortars
Mounted tile
Pre-grouted ceramic tile sheets
Special fiber mesh-reinforced concrete backer board
Thresholds Also this same HANDBOOK FOR CERAMIC TILE INSTALLATION discusses in detail materials for grouting ceramic tile under the following headings:

Commercial portland cement grout
Sand portland cement grout
Dry-set grout
Latex-portland cement grout
Mastic grout
Furan resin grout for quarry tile, packing house tile, and paver tile
Epoxy grout for quarry tile, packing house tile, ceramic mosaic tile and paver tile
Silicone rubber grout The following other methods of installing floor tile are of interest:

'Redi-Set Systems 200' by American-Olean Tile Company, whereby 1 inch by 1 inch ceramic mosaic tiles were made up in 24 inch by 24 inch sheets in the factory with pregrouted urethane sealant joints. This product was withdrawn from the market several years ago. It was designed for only interior, non-load-bearing use and was adhered to a horizontal-base-surface.

'Acousti-Floor Sound Control Underlayment' by Laticrete International, a system by which a ½ inch thickness of cementitious material is troweled onto a concrete slab and the tile covering is installed in a conventional manner, adhered to the horizontal-base-surface.

'Hartco Wood Foam Tile' by Tibbals Floor Company, whereby hardwood floor tiles are backed with 1/16 or ⅛ inch thick layer of polyethylene foam, with the foam adhered to the back of the hardwood tiles, the floor tiles being permanently adhered to a horizontal-base-surface with an adhesive.

'E-A-R Composites' and 'E-A-R Barrier' by E-A-R Corporation as a combination noise barrier, asborber and damper made of vinyl, generally used to isolate sound from machinery, ducts, pipes, doors, walls, floors, marine engine compartments, and hatches. The composite are not designed to serve as substrates for a finished floor tile system.

The Ceramic Tile Institute Los Angeles Chapter's sound-rated interior floor systems for both thin-set and mortar method of setting ceramic tile floors in a manner to reduce impact sound transmission. A big drawback to these methods is that they require a thickness of 1½ to 4 inches plus the thickness of the tile. Also the tile is adhered in a conventional manner over the rigid substrate.

NOTE: American-Olean Tile Company and some other manufacturers furnish glazed wall tile sheets with pregrouted joints filled with silicone sealant. These can only be used, however, for adhering to interior walls and are not related to this invention of installing gravity-held-in-place-load-bearing-horizontal-tile-arrays or gravity-held-in-place-load-bearing-horizontal-modular-accessible-tiles with dynamic-interactive fluidtight-flexible-joints.

DESCRIPTION OF THE INVENTION

Detailed review of the state of the art in the above references materially helps in differentiating how the teachings of this invention differ from the current state of the art, in particular as to the following references:

In existing state of the art, the tile is held in place by the materials for setting ceramic tile or held in place by special products for setting ceramic tile as described in the references stated, whereas in this invention the tile is held in place by gravity, friction, and accumulated-interactive-assemblage In existing state of the art, the tile is installed on a rigid substrate and is fastened mechanically or by adhesives of some type, or by both, whereas in this invention the tile floats loose laid on a horizontal-disassociation-cushioning-layer, such as, the following resilient materials, by means of the above-state gravity, friction, and accumulated-interactive-assemblage:

Horizontal-disassociation-cushioning-layer
- Disassociation elastic foam pads of the type used as carpeting pads
- Thin disassociation elastic foam layer Rigid-foam-insulation
Resilient substrate
- Non-woven compression-resistant three-dimensional nylon matting
- Non-woven vinyl random filament construction Cushioning-granular-substrate
Granular base substrate In existing state of the art, the joints between the tile are filled with rigid grout, except for pre-grouted ceramic tile sheets of various sizes for interior and wall installations. According to the Ceramic Tile Institute, such sheets, which also may be components of an installation system, are generally grouted with an elastomeric material, such as silicone, urethane, or polyvinyl chloride (PVC) rubber, each of which is engineered for its intended use. The perimeter of these factory pre-grouted sheets may include the entire, or part of the, grout between sheets, or none at all. Field applied perimeter grouting may be of the same elastomeric material as used in the factory pre-grouted sheets or as recommended by the manufacturer. Factory pre-grouted ceramic tile sheets offer flexibility, good tile alignment, overall dimensional uniformity and grouts that resist stains, mildew, shrinkage and cracking. Factory pre-grouted sheets tend to reduce total installation time where the requirement of returning a room to service or the allotted time for ceramic tile installation (as on an assembly lie) is critical. These tiles are installed on a rigid substrate and are fastened mechanically or by adhesives of some type, or by both, whereas in this invention the tiles are not grouted, but are filled with dynamic-interactive-fluidtight-elastomeric-adhesive-sealant and held in place by gravity, friction, and accumulated-interactive-assemblage for floating loose laid on a horizontal-disassociation-cushioning-layer for impact sound isolation by disassociation of impact sound source on tile from the horizontal-base-surface.

In the realities of today's marketplace costs, it is very expensive to remove adhesive- and cement-adhered hard-surface floor coverings. The established heights of fixed elements, such as floor drains, fixtures, equipment, door frames and doors, all make it difficult, expensive and even impossible due to the limitation of physical dimensions or structural weight or previous product failure to not require costly removal of existing floor coverings, whereas this invention makes possible easy removal and reinstallation and valuable salvage while providing other benefits stated herein.

The desirability and importance of the fluidtightness of this invention can be seen when it is realized that OSHA Regulation 1901.141 Sanitation Requirement states that all toilet rooms, floors and sidewalls, to a height of at least 6 inches, shall be of watertight construction. This invention makes unnecessary the waterproof membrane which prior art dictates for installation below the floor tile coverings.

Greater understanding of the teachings of this invention is gained by considering the challenges that must be overcome for teaching this invention to function and to be commercially viable. Some, but not necessarily all, of the requirements are as follows:

For example, when installing ceramic or stone tile, it is essential to have a dynamic-interactive-fluid-tight-elastomeric-adhesive-sealant-joint which remains adhered to all perimeter adjacent sides of tiles at all joints and which remains highly flexible over the life of the installation due to constant movement of joint from use by walking Dynamic-interactive-fluidtight-elastomeric-adhesive-sealant is essential to provide accumulating size of array in combination with friction and gravity to hold this invention permanently in place while allowing for assembly to float in disassociation with the horizontal-base-surface and joint to flex when walked on Room-temperature curing of elastomeric-adhesive-sealant without pressure or heat Some type of horizontal-disassociation-cushioning-layer To give impact sound isolation To keep tiles from clanking against hard-surfaced horizontal-base-surface or intermediate horizontal-composite-assemblage-sheets or three-dimensional-passage-and-support-matrix To take up unevenness and to cushion between bottom of ceramic, quarry or stone tile and top of horizontal-base-surface to avoid point source of contact between bottom of tile and top of horizontal-base-surface since ceramic, quarry and stone tile are relatively brittle In the case of wood tile, to take up unevenness Durability of horizontal-disassociation-cushioning-layer over life of installation of at least 20 years through the vicissitudes of water getting into the space between the bottom of the tile and the top of the horizontal-base-surface Control or elimination of friction destruction of horizontal-disassociation-cushioning-layer by time and air or constant flexing Thinness of the assembly is highly desirable A horizontal-composite-assemblage-sheet that will not break, rust, warp, or expand and contract excessively during installation or in-use service Cost effectiveness Correct thickness-to-width ratio of ceramic or stone tile in relation to thickness and density of the horizontal-disassociation-cushioning-layer In accordance with this invention, a gravity-held-in-place-load-bearing-horizontal-tile-array may be provided over a horizontal-base-surface which is typically a floor. An array of horizontal-individual-tiles is set on the horizontal-base-surface, with the horizontal-individual-tiles having sides positioned adjacent to the sides of adjoining tiles in the array.

In this invention, the array of rigid tiles is separated from the horizontal-base-surface by at least a 1/16 inch thickness of horizontal-disassociation-cushioning-layer. The tiles are also adhesively joined at their sides to adjacent sides of the adjoining tiles with an elastomeric-adhesive-sealant, which provides the dynamic system mentioned above, providing accumulated-interactive-assemblage.

When a heavy load is placed upon a small area of tile, it will tend to temporarily sink into the horizontal-disassociation-cushioning-layer, usually in a non-uniform manner, since the load will rarely be placed in the exact center of each tile. The elastomeric-adhesive-sealant-joints between the adjoining tiles will correspondingly stretch or compress to adjust for the temporary deflection of the tiles, with the tops of said joints being in compression and the bottoms of said joints being in tension, or vice versa, to avoid breakage and rupture of the elastomeric-adhesive-sealant-joints between tiles, to disperse the stress, and to prevent breaking of the tiles which by the nature of many ceramic and stone materials are relatively brittle.

As a result of this, impact sound applied to the tiles and passing through the horizontal-base-surface is substantially diminished, being dampened by the presence of the horizontal-disassociation-cushioning-layer, and also due to the resilient, dynamic system of flexible joints utilized to join the tiles together.

Preferably, the horizontal-disassociation-cushioning-layer is a sheet of elastic foam, being preferably about 1/16 to ½ inch thick. Any suitable elastic foam may be used. Examples of preferred resilient elastic foam which may be used include commercially available carpet foundation foam, for example, ¼ inch thick Omalon II (Spec 1, Spec 2, or Spec 3, Spec 2 being preferred) for the horizontal-disassociation-cushioning-layer. This material is polyurethane and is sold by the Olin Chemical Company. For thin horizontal-disassociation-cushioning-layers, a preferred material is polyethylene foam, such as Volara #2A, 2#/CF density, ⅛ inch thickness, and Volara #4A, 4#/CF density, 1/16 inch thickness, both as manufactured by Voltek, a Sekisui Company. Another suitable horizontal-disassociation-cushioning-layer is Contract Life 310 EPDM carpet pad, sold by Dayco Corporation. Urethane, polyurethane, polyethylene, polystyrene, EPDM, isocyanurate, and latex foams are also suitable. Other types of elastic foam material of a variety of chemical composition material may also be used and, if desired, solid elastomeric materials may also be used for the thickness of the horizontal-disassociation-cushioning-layer. The thickness of horizontal-disassociation-cushioning-layer may be factory-mnufactured rolled goods, flat or folded sheet, poured-in-place foams from jobsite pouring systems, or sprayed-in-place foams from jobsite spraying systems, as is the most convenient means, as long as it is of generally uniform thickness, durable in nature and/or correct density to functionally support floor loads. Also elastic carpet pads may be used, such as, possibly rubberized animal hair, synthetic fiber, and/or India jute pads, flat sponge rubber, waffled sponge rubber, flat latex rubber, herringbone design rippled sponge rubber, waffled EPDM polymer sponge, latex foam rubber, and the like.

Also the horizontal-disassociation-cushioning-layer may be a porous, oil-resistant vinyl matting with a non-woven filament construction, with a backing, or a two-layer composite consisting of a polyester non-woven filter fabric heat-bonded to a compression-resistant three-dimensional nylon matting, such as is manufactured by American Enka Company of Enka, North Carolina.

Also the horizontal-disassociation-cushioning-layer may be a pourous, oil-resistant vinyl matting with a non-woven filament construction, without a backing, such as is manufactured by 3M Company for entrance matting.

The standard horizontal-individual-tiles used in this invention may be of any desired size, commonly from 1 inch to 1 foot on a side or larger.

Modular-accessible-tiles, composite-modular-accessible-tiles, and resilient-composite-modular-accessible-tiles may be manufactured, transported, and installed for accessibility to conductors, conduits, raceways, piping, and utilities below in sizes up to 6 feet on one or more sides, being manufactured, assembled, and composed of a plurality of standard horizontal-individual-tiles of any of the hard-surface materials disclosed herein or of similar type hard-surface materials, with a plurality of flexible joints between the horizontal-individual-tiles for disposition in various combinations over any of the following:

One or more horizontal-disassociation-cushioning-layers

A three-dimensional-passage-and-support-matrix with at least one horizontal-disassociation-cushioning-layer within the combination.

Modular-accessible-tiles, composite-modular-accessible-tiles, and resilient-composite-modular-accessible-tiles may be manufactured, transported, and installed for accessibility to conductors, conduits, raceways, piping, and utilities below in sizes up to 6 feet on one or more sides, being manufactured, assembled, and composed of a plurality of standard horizontal-individual-tiles of any of the hard-surface materials disclosed herein or of similar type hard-surface materials, with a plurality of flexible joints between the horizontal-individual-tiles for disposition in various combinations over rigid-foam-insulation.

Modular-accessible-tiles, composite-modular-accessible-tiles, and resilient-composite-modular-accessible-tiles may be manufactured, transported, and installed for accessibility to conductors, conduits, raceways, piping, and utilities below in sizes up to 6 feet on one or more sides, being manufactured, assembled, and composed of a plurality of standard horizontal-individual-tiles of any of the hard-surface materials disclosed herein or of similar type hard-surface materials, with a plurality of flexible joints between the horizontal-individual-tiles adhered to and assembled on a horizontal-composite-assemblage-sheet for disposition in various combination over any of the following:

One or more horizontal-disassociation-cushioning-layers

A three-dimensional-passage-and-support-matrix with at least one horizontal-disassociation-cushioning-layer within the combination with the above variations of modular-accessible-tiles being the preferred embodiment of this invention.

In specialized instances, from one foreign source single horizontal-individual-tiles of ceramic/quarry tile up to 6 feet on one or more sides have become available for special requirements. Therefore, theoretically, a single ceramic/quarry tile, selected for its levelness, may be adhered with a suitably engineered adhesive to a single large metallic horizontal-composite-assemblage-sheet, forming a structural tension composite diaphragm, provided the resulting modular-accessible-tile is installed over one of the following:

A precision, uniform thickness of horizontal-disassociation-cushioning-layer of elastic foam loose laid over a precision. leveled horizontal-base-surface to provide uniform support A precision leveled three-dimensional-passage-and-support-matrix installed over a precision leveled horizontal-base-surface to provide uniform support.

Large size cast cementitious and epoxy-based reinforced terrazzo tiles up to 6 feet on one or more sides may be manufactured for installation over one of the following:

A precision, uniform thickness of horizontal-disassociation-cushioning-layer of elastic foam loose laid over a precision leveled horizontal-base-surface to provide uniform support.

A precision leveled three-dimensional-passage-and-support-matrix installed over a precision leveled horizontal-base-surface.

Wood laminations of rotary cut veneers as well as resilient plastic and rubber sheets may be manufactured of a single veneer or sheet up to 6 feet on one or more sides and more rapidly installed on conventional horizontal-base-surfaces without the precision required for single ceramic/quarry tiles, single stone or terrazzo tiles by the teachings of this invention.

The tiles typically may be of rectangular, square, hexagonal, octagonal or triangular shape, although any other shape may be used, such as traditional shapes like Mediterranean, Spanish, Valencia, Biscayne, segmental, or oblong hexagonal. The tile may be of any commercially available material. The teachings of this invention call for use of any of the following horizontal-individual-tile material categories, referring to the drawings, for the manufacture and assembly of modular-accessible-tiles and as arrays of modular-accessible-tiles:

Ceramic tile materials, such as, ceramic mosaic tile, porcelain paver tile, quarry tile, glazed and unglazed paver tile, conductive ceramic tile, packing house tile, brick pavers, brick, and the like.

Stone tile materials, such as, slate tile, marble tile, granite tile, sandstone tile, limestone tile, quartz tile, and the like.

Hardwood tile materials, such as, white oak, red oak, ash, pecan, cherry, American black walnut, angelique, rosewood, teak, maple, birch, and the like.

Softwood tile materials, such as, cedar, pine, douglas fir, hemlock, yellow pine, and the like.

Wood tile materials, such as, irradiated, acrylic-impregnated hardwoods and softwoods.

Cementitious materials, such as, chemical matrices, epoxy modified cement, polyacrylate modified cement, epoxy matrix, polyester matrix, latex matrix, plastic fiber-reinforced matrices, metallic fiber-reinforced matrices, plastic-reinforced matrices, metallic reinforced matrices, and the like.

Terrazzo materials, such as, chemical matrices, epoxy modified cement, polyacrylate modified cement, epoxy matrix, polyester matrix, latex matrix , cementitious terrazzos, and the like.

Hard-surface resilient tile materials, such as, solid vinyl, cushioned or backed vinyl, conductive vinyl, reinforced vinyl, vinyl asbestos, asphalt, rubber, cork, vinyl-bonded cork, linoleum, leather, flexible-elastic, polyurethane wood, fritz tile, and the like.

Composition tile may also be used, as well as any other rigid tile.

The dynamic-interactive-fluidtight-elastomeric-adhesive-sealant which is used to join the horizontal-individual-tiles as well as to join the modular-accessible-tiles one side to another at their adjoining sides may be any type of elastomeric-adhesive-sealant which provides a good adhesive bond to each tile side, is flexible when cured, is capable of taking the stress inherent within the dynamic moving action of the dynamic system, and will form a non-sticky, flexible surface coating after curing. Typically, polysulfide, silicone, butyl, silicone foam, acrylic, acrylic latex, cross-linked-polyisobutylene rubber, vinyl acrylic, solvent acrylic polymer sealants, or like materials, may be used, or flexible urethane or polyurethane sealants, such as, Vulkem 116, 227 or 45 as manufactured by Mameco International, which are generally preferred. Since, generally, elastomeric sealants can often be formulated from a variety of base ingredients to achieve a variety of functional purposes, any room-temperature-curing elastomeric-adhesive-sealant composition or like composition, not requiring heat or pressure for curing, which exhibits the required functional characteristics may be used to form the dynamic-interactive-fluidtight-elastomeric-adhesive-sealant.

The dynamic-interactive-fluidtight-elastomeric-adhesive-sealant may be applied between the tiles by any means, such as with a manual caulking gun or by pouring of joints. A pressurized gas pumping system for dispensing dynamic-interactive-fluidtight-elastomeric-adhesive-sealant from a bulk container with gas- or air-operated guns is the technique which is generally preferred.

The joint spacing between adjacent sides of adjacent horizontal-individual-tiles is generally adjusted to permit the formation of a strong, dynamic-interactive-fluidtight-flexible bond between the tile sides by the dynamic-interactive-fluidtight-elastomeric-adhesive-sealant used. A typical spacing is between about $\frac{1}{4}$ inch to $\frac{1}{2}$ inch for quarry and paver tile, while the spacing for many ceramic mosaic tiles may be as little as approximately 1/16 inch. Any spacing between 1/16 inch wide to $\frac{3}{4}$ inch wide is functionally usable, depending on the materials and circumstances. Most of such spacings also eliminate the need for thermal expansion and contraction joints.

It may be necessary to add a primer on sides of tile to insure a substantial adhesion by the dynamic-interactive-fluidtight-elastomeric-adhesive-sealant to tile sides, depending upon the ingredients of the dynamic-interactive-fluidtight-elastomeric--adhesive-sealant and the porosity of the tile being joined, as well as the recommendations of the sealant manufacturer. Where a primer is required, care must be used to prevent and insure keeping primer off the face of the tile.

In the interest of economy and simplicity, it is obviously desirable if at all possible to endeavor to select an elastomeric-adhesive-sealant for a given tile, which has the other inherent functional characteristics required without requiring a primer. For example, the preferred urethane and polyurethane sealants listed do not require a primer when utilized with most non-pourous tile, such as, ceramic tile, masonry tile, and the like.

It is preferable, particularly, for the tiles to be free of any direct mechanical attachment by any means which can serve to transmit impact sound to the horizontal-base-surface, typically the structural supporting subfloor. In other words, in this invention it is preferably contemplated for the horizontal-individual-tiles or the modular-accessible-tiles, as the case may be, to "float" by gravity, friction, and accumulated-interactive-assemblage on the thickness of horizontal-disassociation-cushioning-layer, being joined one to another only at all of their sides by a dynamic-interactive-fluidtight-elastomeric-adhesive-sealant bond to the sides of the adjoining horizontal-individual-tiles or the modular-accessible-tiles, as the case may be. Thus a dynamic system is formed which dynamically responds to foot traffic or rolling loads in all of the joints of dynamic-interactive-fluidtight-elastomeric-adhesive-sealant between the horizontal-individual-tiles and the modular-accessible-tiles, so that the external and internal moments created by the loads, which generate tension and shear on the tiles and joints, can be dispersed through the flexible system among the various tiles by means of a continuous dynamic dissipation, much like continuous beam action which has a greater strength to size than a simple beam, between adjacent tiles, dissipating the stress in various directions from the load to the adjacent tiles.

The dynamic-interactive-fluidtight-elastomeric-adhesive-sealant bonds between adjacent sides of tiles sustain internal shear force in the elastomeric-adhesive-sealant-joints to provide dynamic-interactive-fluidtight-flexible-joints with the top of the joint in compression and the bottom of the joint in tension at one moment as a foot steps on or near the tile, and, at the next moment, the compression and tension may be reversed. However, the deflection is partially equalized, and the stresses dispersed to surrounding tiles by the system of this invention, thus greatly reducing the possiblity of breakage of rigid tiles or the dynamic-interactive-fluidtight-flexible bonds, despite their involvement in a dynamic system.

The plurality of dynamic-interactive-fluidtight-flexible-joints between the tiles combined with the thickness of horizontal-disassociation-cushioning-layer under the tiles distributes stress through "wavelike" dampening or dispersing action to the adjacent tiles, even when the tile is heavily pressed in a tilted position, in cooperation with the dynamic-interactive-fluidtight-flexible-joints, thus distributing loads to adjacent tiles and controling the tilting of horizontal-individual-tiles and greatly reducing the possibility of snapping of tiles which are relatively brittle by nature.

Dynamic-interactive-fluidtight-flexible-joints as thin as $\frac{1}{8}$ inch have been thick enough to hold tiles one to another for their functional interaction. However, tests to date indicate a thicker joint $\frac{1}{4}$ inch thickness or over is required to sustain spike heels when width of joint between tiles is sufficient to allow a spike heel to bear on dynamic-interactive-fluidtight-flexible-joints, rather than on sides of tiles. Thin joints, obviously, save expensive dynamic-interactive-fluidtight-elastomeric-adhesive-sealant but require greater time to install foam rods or sand or aggregate filler. Full depth joints are faster and easier to make while giving better support to spike heels and decreasing slightly the flexible feel when walking on the installation.

Testing has shown the ease with which horizontal-individual-tiles may be removed from the floor to replace broken tiles, to relocate all or portions of the floor, to gain access to the horizontal-base-surface, cushioning-granular-substrate, utilities, flat conductor cable, and the like. Alternative procedures for reinstalling horizontal-individual-tiles or reinstalling modular-accessible-tiles in the array of modular-accessible-tiles by allowing adhesive seal to reseal the dynamic-interactive-fluidtight-flexible-joints are as follows:

1. Cutting dynamic-interactive-fluidtight-flexible-joint down the middle with a vertical cut or sloping cut and not removing the dynamic-interactive-fluidtight-elastomeric-adhesive-sealant from the sides of the horizontal-individual-tile. When the horizontal-individual-tile or modular-accessible-tile is ready to be reinstalled, place a bead or series of spots of gun-grade-elastomeric-adhesive-sealant along the vertical or sloping side to reset the tile.
2. Cutting the dynamic-interactive-fluidtight-flexible-joint down the middle with a verticle or sloping cut and not removing the dynamic-interactive-fluidtight-elastomeric-adhesive-sealant from the sides of the horizontal-individual-tile and also cutting or routing in the dynamic-interactive-fluidtight-flexible-joint a series of uniformly-spaced vee or half-cylindrical cross cuts on one or both sides of the middle cut for receiving a series of small beads of gun-grade-elastomeric-adhesive-sealant to hold the modular-accessible-tile in place in the array of modular-accessible-tiles at points of spaced vee or half-cylindrical ross cuts.
3. Precision casting or routing a continuous perimeter border around all sides of the perimeter of the modular-accessible-tiles with a series of uniformly-spaced vee or half-cylindrical cross cuts on one or both sides of the middle cut for receiving a series of small beads of gun-grade-elastomeric-adhesive-sealant to hold the modular-accessible-tile in place in the array of modular-accessible-tiles.
4. Double cutting the dynamic-interactive-fluidtight-flexible-joint with parallel sloping cuts to form a vee open on the top side and closed on the bottom, into which self-leveling-or gun-grade-elastomeric-adhesive-sealant is placed to seal the dynamic-interactive-fluidtight-flexible-joint.
5. Precision casting or routing into a continuous perimeter border around the perimeter of all sides of the modular-accessible-tile a vee or oval joint open on the top side and closed on the bottom, into which self-leveling- or gun-grade-elastomeric-adhesive-sealant is placed to seal the dynamic-interactive-fluidtight-flexible-joint.

Although foam rods work well, I have found alternative substitutes to using foam rods through further testing of my invention, which indicates that the more economical, practical way of forming the filler portion of the dynamic-interactive-fluidtight-flexible-joint between horizontal-individual-tiles or modular-accessible-tiles of my combination is by any one of the following:

1. (Preferred - seems to work very well although it uses greater quantities of expensive elastomeric-adhesive-sealant) Where horizontal-individual-tiles are adhered fluidtight to a horizontal-disassociation-cushioning-layer or are adhered fluidtight to a horizontal-composite-assemblage-sheet, flexible joints which are dynamic-interactive-fluidtight-flexible-joints may be very efficiently formed by placing a continuous flow of self-leveling-elastomeric-adhesive-sealant for the full width and height of the dynamic-interactive-fluidtight-flexible joint. Where horizontal-individual-tiles are not adhered fluidtight to a horizontal-disassociation-cushioning-layer or are not adhered fluidtight to a horizontal-composite-assemblage-sheet, flexible joints should be formed by first placing a continuous flow of gun-grade-elastomeric-adhesive-sealant at the bottom of the flexible joints to form a fluidtight bottom seal to contain the continuous filling full of the top portion of the dynamic-interactive-fluidtight-flexible-joint with self-leveling-elastomeric-adhesive-sealant for the full width and height of the dynamic-interactive-fluidtight-flexible-joint. This initial first bottom seal can beneficially hold the horizontal-individual-tiles in place against subsequent movement during the second application of the self-leveling-elastomeric-adhesive-sealant.
2. (or, in the interests of economy) Continuously fill the bottom portion of the dynamic-interactive-fluidtight-flexible-joint with gun-grade-elastomeric-adhesive-sealant, allowing this dynamic-interactive-fluidtight-elastomeric-adhesive-sealant to form a fluidtight bottom seal to contain the self-leveling-elastomeric-adhesive-sealant when the top portion of the dynamic-interactive-fluidtight-flexible-joint is being filled with it.
3. (or, in the interests of economy) Place continuous bead of gun-grade-elastomeric-adhesive-sealant below each tile joint as the horizontal-individual-tile is being set to hold the horizontal-individual-tiles in place and also to form a fluidtight bottom seal to contain the self-leveling-elastomeric-adhesive-sealant when the top portion of the dynamic-interactive-fluidtight-flexible-joint is being filled with it.
4. (or, in the interests of economy) Continuously fill the bottom portion of the joints with any type of filler, such as, perlite, talc, vermiculite, granular filler, or foam beads to a uniform height so as to provide at least ¼ inch or more space in the top of the joint for the elastomeric-adhesive-sealant by the following steps of placing a light coating or gun-grade-elastomeric-adhesive-sealant to form an overcoat wherein a zone of intermixing of self-leveling-elastomeric-adhesive-sealant will form with a fluidtight skim coat. After the skim coat becomes fluidtight, fill the joint full with self-leveling-elastomeric-adhesive-sealant.
5. (or, in the interests of economy) Continuously fill the bottom portion of the joint with sand or any fine granular material with a specific gravity greater than that of the self-leveling-elastomeric-adhesive-sealant to a uniform height so as to provide at least ¼ inch or more space in the top of the joint for the elastomeric-adhesive-sealant. Either fill the rest of the joint directly with self-leveling-elastomeric-adhesive-sealant or first form a skim seal coat over the sand or granular filler material and then fill the joint full with self-leveling-elastomeric-adhesive-sealant.
6. (or, in the interests of economy) Where horizontal-individual-tiles are adhered to a horizontal-composite-assemblage-sheet of a flexible plastic or a flexible metallic sheet to form fluidtight containment for the dynamic-interactive-fluidtight-flexible-joint, continuously fill the dynamic-interactive-fluidtight-flexible-joint full with self-leveling-elastomeric-adhesive-sealant to a uniform depth of at least ¼ inch and then brush in sand or a similar granular filler with specific gravity greater than that of the self-leveling-elastomeric-adhesive-sealant at a slow enough rate for relatively uniform distribution that the sand settles, but does not bridge over, to the bottom of the dynamic-interactive-fluidtight-flexible-joint, leaving the top portion of the dynamic-interactive-fluidtight-flexible-joint full of high-grade self-leveling-elastomeric-adhesive-sealant to a depth at least ¼ inch or greater.

Most underlayments of plywood, particleboard, hardboard, and the like warp readily when any material is adhered to only one side or when moisture or moist vapor is exposed to only one side, making it necessary to adhere these rigid boards by adhesive to the structural subfloor or mechanically fasten these rigid boards to the structural subfloor, which forms a bridge for transmission of impact sound. By the use of thin, generally flexible asbestos-cement board, sheet metal, ⅛ inch tempered hardboard, metallic sheet, plastic sheet, or the like, with flexibility to the sheets, slight flexibility to the boards, and non-warping, with a more inert nature to absorbing moisture while being limp, it is possible to keep these flexible sheets or boards flat and held in place by assembling the horizontal-individual-tiles or the modular-accessible-tiles into arrays "floating" by gravity, friction, and accumulated-interactive-assemblage accomplished by the dynamic-interactive-fluidtight-flexible-joints. The flexible sheets and boards actually exhibit some flexiblity to sink into the thickness of horizontal-disassociation-cushioning-layer under a load.

It is essential that the horizontal-composite-assemblage-sheets be relatively unsusceptible or entirely unsusceptible to moisture which causes expansion and contraction so that the unbalanced sandwich construction will, importantly, lie flat, or limp, by its relatively heavy weight to stiffness over the horizontal-disassociation-cushioning-layer, the horizontal-base-surface, and the three-dimensional-passage-and-support-matrix without adhesion to these surfaces. Generally, flexible metallic sheets and flexible plastic sheets are more inert to these moisture-induced problems, with flexible metallic sheets being generally the preferred materials for the horizontal-composite-assemblage-sheets.

The teachings of this invention call for the use of any of the following horizontal-composite-assemblage-sheet categories for assembling horizontal-individual-tiles into modular-accessible-tiles (M.A.T.), referring to FIGS. 2 and 4, composite-modular-accessible-tiles (C-M.A.T.), referring to FIGS. 3, 6, 7, 10 and 11, and resilient-composite-modular-accessible-tiles (R-C-M.A.T.), referring to FIGS. 8, 9, 12 and 13:

The horizontal-composite-assemblage-sheet is a modular-slip-sheet-temporary-containment of plastic material from 0.004 inch to 0.065 inch thick, formed by any production means into a containment means for containing self-leveling-elastomeric-adhesive-sealant-joints, such as, spun polyolefin sheeting, thin polyethylene foam sheets, thin polyurethane foam sheets, thin polystyrene foam sheets, woven polyolefin sheets, reinforced polyolefin sheeting, cross-laminated polyolefin sheeting, polyethylene sheeting, reinforced polyethylene sheeting, polyvinyl chloride sheeting, butyl sheeting, EPDM sheeting, neoprene sheeting, Hypalon sheeting, fiberglass sheeting, reinforced fiberglass sheeting, polyester film, reinforced plastic sheeting, cross-laminated poly sheeting, scrim sheeting, and scrim fabrics The horizontal-composite-assemblage-sheet is a flexible metallic sheet modularly sized to size for one or more modular-accessible-tiles and comprises a modular flexible sheet from 0.001 inch to 0.020 inch thick, such as, hot rolled steel sheets; high strength-low alloy steel sheets; cold rolled steel sheets; coated steel sheets; galvanized, galvanized bonderized, galvannealed, electrogalvanized steel sheets; aluminized steel sheets; long terne sheets; vinyl metal laminates; aluminum sheets; and stainless steel sheets, wherein the flexible metallic sheets are, further, selected from flat galvanized metallic sheets, flat metallic sheets, rolls of galvanized metallic sheets, rolls of metallic sheets, grid-stiffened pans, deformed metallic sheets, flat metallic sheets with stiffening ribs, ribbed pans, flat laminated metallic sheets, metallic foil sheeting, expanded metal sheets, woven metal sheets, and perforated metal sheets The horizontal-composite-assemblage-sheet is modularly sized to size selected for one or more horizontal-individual-tiles and comprises a modular flexible sheet from 0.001 inch to 0.125 inch thick, such as, plastic polyvinyl chloride, chlorinated polyvinyl chloride, polyethylene, polyurethane, and fiber glass The horizontal-composite-assemblage-sheet is a metallic sheet modularly sized to size for one or more horizontal-individual-tiles and comprises a modular flexible sheet from 0.004 inch to 0.125 inch thick, such as, hot rolled steel sheets; high strength-low alloy steel sheets; cold rolled steel sheets; coated steel sheets; galvanized, galvanized bonderized, galvannealed, electrogalvanized steel sheets; aluminized steel sheets; long terne sheets; vinyl metal laminates; aluminum sheets; and stainless steel sheets, wherein the flexible metallic sheets are, further, selected from galvanized metallic sheets, flat metallic sheets, rolls of galvanized metallic sheets, rolls of metallic sheets, grid-stiffened pans, deformed metallic sheets, flat metallic sheets with stiffening ribs, ribbed pans, flat laminated metallic sheets, metallic foil sheeting, expanded metal sheets, woven metal sheets, perforated metal sheets, and woven wire sheets The horizontal-composite-assemblage-sheet is a flexible sheet from 0.125 inch to 0.500 inch thick, such as, asbestos-cement sheets, plastic sheets, plastic-reinforced cementitious sheets, metallic-reinforced cementitious sheets, glass-reinforced cementitious sheets, plastic-fiber reinforced cementitious sheets, metallic-fiber reinforced cementitious sheets, glass-fiber reinforced cementitious sheets, Finnish birch plywood, overlay plywood, plastic-coated plywood, tempered hardboard, particleboard, and plywood The horizontal-composite-assemblage-sheet is a modular board from 0.500 inch to 1.125 inch thick, such as, asbestos-cement board, plastic board, plastic-reinforced cementitious board, metallic-reinforced cementitious board, plastic fiber-reinforced cementitious board, metallic fiber-reinforced cementitious board, Finnish birch plywood, overlay plywood, plastic-coated plywood, laminated tempered hardboard, micro-lam plywood, and particleboard The horizontal-composite-assemblage-sheet has a grid of warpage relief saw kerfs, forming a grid pattern of saw kerfs to impart an inherently limp flexibility to the combination due to its mass relative to its stiffness to offset unbalanced composition of sandwich, and is a material, such as, asbestos-cement board, plastic board, plastic-reinforced cementitious board, metallic-reinforced cementitious board, plastic fiber-reinforced cementitious board, metallic fiber-reinforced cementitious board, Finnish birch plywood, overlay plywood, plastic-coated plywood, laminated tempered hardboard, micro-lam plywood, and particleboard.

The horizontal-composite-assemblage-sheets are assembled coplanar as an array with their sides and ends abutting one another and are cut to size to form factory-manufactured modular-accessible-tiles.

The teachings of this invention also call for the use of any of the following materials:

The slip sheet is a plastic material from 0.004 inch to 0.065 thick, such as, spun polyolefin sheeting, thin polyethylene foam sheets, thin polyurethane foam sheets, thin polystyrene foam sheets, woven polyolefin sheeting, reinforced polyolefin sheeting, cross-laminated polyolefin sheeting, polyethylene sheeting, reinforced polyethylene sheets, polyvinyl chloride sheeting, butyl sheeting, EPDM sheeting, neoprene sheeting, Hypalon sheeting, fiberglass sheeting, reinforced fiberglass sheeting, polyester film, reinforced plastic sheeting, cross-laminated poly sheeting, scrim sheeting, and scrim fabrics The horizontal-rigid-foam-insulation comprises a rigid-foam-insulation material of any functionally required thickness, such as, extruded polystyrene, expanded polystyrene, styrene bead board, polyurethane, urethane, polyethylene, isocyanurate foam, polyvinyl chloride, foam glass, and perlite-/urethane foam sandwich.

Alternatively, it may be desired to replace or add to the thickness of horizontal-disassociation-cushioning-layer of this invention by the addition of at least a $\frac{3}{4}$ inch or greater thickness of horizontal-rigid-foam-insulation, such as, polystyrene foam board, polystyrene bead board, urea-formaldehyde foam board, polyurethane foam board, polyisocyanurate foam board, and the like, foamed-in-place rigid urethane foam and the like, urethane pour systems and the like, separating the horizontal-individual-tiles and the horizontal-base-surface. The tile array shown in the drawings is adhered together by the perimeter joints between adjacent tiles and loose laid over any type of rigid-foam-insulation, such as is listed above. The dynamic-interactive-fluidtight-flexible-joints between the tiles are still preferably used to compensate for stresses that may be generated by deflection of the relatively rigid foam which, however, still is subject to some deflection under heavy loads. An advantage of this system is that thermal insulation is provided as well as impact sound isolation. This thermal insulation can also be beneficially installed below the horizontal-disassociation-cushioning-layer.

In retrofit work the total overall thickness of the impact sound isolation combination is important so that door frames, door heads, and door hardware do not have to be reset or reworked and, hopefully, so door bottoms do not require refitting.

Also, in new work, having the impact sound isolation combination as thin as possible allows door frames to be set and fastened directly on the horizontal-base-surface with the use of existing conventional tolerances, as well as door undercuts, hardware clearances, and the like, which the teachings of this invention allow better than the eight newly-developed impact sound isolation systems developed by the Tile Council of America, Inc.

For example, the teachings of this invention allow many relatively thin combinations as illustrated by a few of the following example combinations which allow matching with existing carpet installation thickness better than other existing or new state-of-the-art impact sound isolation systems, as follows:

EXAMPLE 'A'

| | |
|---|---|
| $\frac{1}{4}$ inch porcelain ceramic mosaic tile (usually 7/32 inch actual thickness) adhered on approximately 20 gauge thickness of sheet metal | $\frac{1}{4}$ inch |
| $\frac{1}{8}$ inch thick polyethylene foam layer (may also be 1/16 inch thick) | $\frac{1}{8}$ inch |
| Approximate total thickness of combination, whereas many carpet installations are $\frac{1}{4}$ inch to $\frac{3}{4}$ inch thick, depending on thickness of carpet and/or pad | $\pm\frac{3}{8}$ inch |

EXAMPLE 'B'

| | |
|---|---|
| $\frac{3}{8}$ inch thick porcelain paver tile (usually 11/32 inch actual thickness) adhered to approximately 20 gauge thick sheet metal | $\frac{3}{8}$ inch |
| $\frac{1}{8}$ inch thick polyethylene foam layer (may be 1/16 inch thick) | $\frac{1}{8}$ inch |
| Approximate total thickness of combination, whereas many carpet installations are $\frac{1}{4}$ inch to $\frac{3}{4}$ inch thick, depending on thickness of carpet and/or pad | $\pm\frac{1}{2}$ inch |

EXAMPLE 'C'

| | |
|---|---|
| ±5/16 inch thick irradiated hardwood tile adhered with epoxy to approximately 20 gauge thick sheet metal | $\frac{3}{8}$ inch |
| $\frac{1}{8}$ inch thick polyethylene foam layer | $\frac{1}{8}$ inch |
| Approximate total thickness of combination, whereas many carpet installations are $\frac{1}{4}$ inch to $\frac{3}{4}$ inch thick, depending on thickness of carpet and/or pad, and, where carpet and pad are also selected for quality, durability and impact sound isolation and STC sound rating, this combined thickness is usually $\frac{5}{8}$ inch to 1 inch thick | $\pm\frac{1}{2}$ inch |

EXAMPLE 'D'

| | |
|---|---|
| $\frac{1}{2}$ inch thick quarry tile adhered to 20 gauge thick sheet metal | 9/16 inch |
| 1/16 inch thick polyethylene foam layer | 1/16 inch |
| Approximate total thickness of combination, whereas many carpet installations are $\frac{1}{4}$ inch to $\frac{3}{4}$ inch thick, depending on thickness of carpet and/or pad, and where carpet and pad are also selected for quality, durability and impact sound isolation and STC sound rating, this combined thickness is usually $\frac{5}{8}$ inch to 1 inch thick | $\pm\frac{5}{8}$ inch |

Carpet is a product in many respects like this invention. It is helpful in understanding this invention if one visualizes in his mind's eye these comparisons:

Visualize each loop or fiber of a carpet as equivalent to a horizontal-individual-tile, and visualize the carpet backing as a horizontal-composite-assemblage-sheet that holds each loop or fiber in an accumulated-interactive-assemblage equivalent to the horizontal-composite-assemblage-sheet (flexible asbestos-cement or flexible plastic or metallic sheets) of this invention where the horizontal-individual-tiles are adhered to this horizontal-composite-assemblage-sheet into an assembled horizontal-tile-array This invention goes beyond what carpet does and fills all perimeter joints around horizontal-individual-tiles with a flexible joint of dynamic-interactive-fluidtight-elastomeric-adhesive-sealant to form dynamic-interactive-fluidtight-flexible-joints, an improvement over the vast perimeter area surrounding each fiber of carpet, where dirt may accumulate and which fibers are equivalent to the horizontal-individual-tiles of this invention Like carpet, this invention remains flexible and can be loose laid over a horizontal-disassociation-cushioning-layer, provided the combination is composed in the different ways illustrated in our preferred embodiment disclosure, specification, drawings and claims Carpet is also cuttable and movable when loose laid, as this invention is cuttable and movable, allowing accessibility to the horizontal-base-surface and utilities and flat conductor cable power and communications systems as this invention does.

This invention fills the preceding needs as follows:

By producing a product not requiring pressure and heat to provide flexible joints By allowing transport of modular-accessible-tiles by pallet By allowing gravity, friction, and accumulated-interactive-assemblage to hold modular-accessible-tiles in place indefinitely as long as the Earth retains its gravity tension By allowing gravity-installed modular-accessible-tiles to be re-used, relocated and recycled in the same building and home or in new buildings and homes By providing substantially improved Impact Isolation Class (IIC) and Sound Transmission Class (STC) for finish hard-surfaced tile and resilient floor covering installations which are thin in thickness and can be used in retrofit and new construction By providing an array of modular-accessible-tiles with flexible joints which are cuttable, accessible, and reassembleable in order to provide access to flat conductor cable systems for power and communication wiring when building occupants' functional needs require a hard-surfaced flooring in retrofit of existing buildings and new buildings By providing a means for installing an array of modular-accessible-tiles with flexible joints which are cuttable, accessible, and reassembleable in order to provide full top accessibility to a three-dimensional-passage-and-support-matrix formed to accept and accommodate varying combinations of the following:

Factory-preassembled flexible metallic conduits with factory-installed lock connector ends Factory-preassembled rated flexible plastic conduits with facotry-installed locking connector ends Plastic and metallic conduits Plastic and metallic support raceway systems Plastic and metallic supply and return fluid piping systems for Chilled fluids Hot fluids Absorptive fluids Radiative fluids Fire protection fluids Junction and outlet boxes Passage of gases through a three-dimensional-passage-and-support-matrix By providing a liquidtight joint that retains spilt liquids on the surface for cleanup or disposal by gravity drainage.

Whereas there is an abundance of prior art in connection with flat conductor cable and many existing patents showing minor improvements in flat conductor cable, connectors, and the like, there exists to the best of my knowledge no prior art for arrays of gravity-held-in-place-load-bearing-horizontal-modular-accessible-tiles having hard-surface flooring materials as disclosed by the teachings of this invention, with modular-accessible-tiles (M.A.T.), composite-modular-accessible-tiles (C-M.A.T.), and resilient-composite-modular-accessible-tiles (R-C-M.A.T.) having cuttable, accessible, and reassembleable dynamic-interactive-fluidtight-flexible-joints for accessibility to service concealed-from-view flat conductor cable systems wherever functionally required below arrays of the gravity-held-in place-load-bearing-horizontal-modular-accessible-tiles of this invention.

BRIEF DESCRIPTION OF THE DRAWINGS

In the drawings,

FIG. 5 J. B. M. is also an enlarged, transverse, sectional view of the flexible joints between adjacent modular-accessible-tiles of this invention, shwn disposed over any type of resilient substrate relative to FIG. 5.

FIG. 6 J. B. M. is an enlarged, transverse, sectional view of the flexible joints between adjacent modular-accessible-tiles of this invention disposed over a horizontal-base-surface relative to FIG. 6.

FIG. 7 J. B. M. is an enlarged, transverse, sectional view of the flexible joints between adjacent modular-accessible-tiles of this invention, disposed over a horizontal-base-surface relative to FIG. 7.

FIG. 8 J. B. M. is an enlarged, transverse, sectional view of the flexible joints between adjacent modular-accessible-tiles of this invention, disposed over a horizontal-base-surface relative to FIG. 8.

FIG. 9 J. B. M. is an enlarged, transverse, sectional view of the flexible joints between adjacent modular-accessible-tiles of this invention, disposed over a horizontal-base-surface relative to FIG. 9.

FIG. 10 J. B. M. is an enlarged, transverse, sectional view of the flexible joints between adjacent modular accessible-tiles of this invention, disposed over a three-dimensional-passage-and-support-matrix disposed over a horizontal-base-surface relative to FIG. 10.

FIG. 11 J. B. M. is an enlarged, transverse, sectional view of the flexible joints between adjacent modular-accessible-tiles of this invention disposed over a three-dimensional-passage-and-support-matrix disposed over a horizontal-base surface relative to FIG. 11.

FIG. 12 J. B. M. is an enlarged, transverse, sectional view of the flexible joints between adjacent modular-accessible-tiles of this invention disposed over a three-dimensional-passage-and-support-matrix disposed over a horizontal-base-surface relative to FIG. 12.

FIG. 13 J. B. M. is an enlarged, transverse, sectional view of the flexible joints between adjacent modular-accessible-tiles of this invention disposed over a three-dimensional-passage-and support-matrix disposed over a horizontal-base-surface relative to FIG. 13.

FIG. 20 J.B.M. is an enlarged, transverse, sectional view of the flexible joints between adjacent horizontal-individual-tiles or modular-accessible-tiles (M.A.T., C-M.A.T., and R-C-M.A.T.) of this invention disposed over any type of cushioning-granular-substrate relative to FIG. 20, wherein FIG. 20 J.B.M. depicts joints between adjacent composite-modular-accessible-tiles (C-M.A.T.) in which flexible joints are cuttable, accessible, and reassembleable.

FIG. 21 J.B.M. is an enlarged, transverse, sectional view of the flexible joints between adjacent horizontal-individual-tiles or modular-accessible-tiles (M.A.T., C-M.A.T., and R-C-M.A.T.) of this invention disposed over any type of cushioning-granular-substrate relative to FIG. 21, wherein FIG. 21 J.B.M. depicts joints between adjacent modular-accessible-tiles (M.A.T.) in which flexible joints are cuttable, accessible, and reassembleable.

FIG. 22 J.B.M. is an enlarged, transverse, sectional view of the flexible joints between adjacent horizontal-individual-tiles or modular-accessible-tiles (M.A.T., C-M.A.T., and R-C-M.A.T.) of this invention disposed over any type of cushioning-granular-substrate relative to FIG. 22, wherein FIG. 22 J.B.M. depicts joints between adjacent horizontal-individual-tiles in which flexible joints are cuttable, accessible, and reassembleable.

Figure 3:
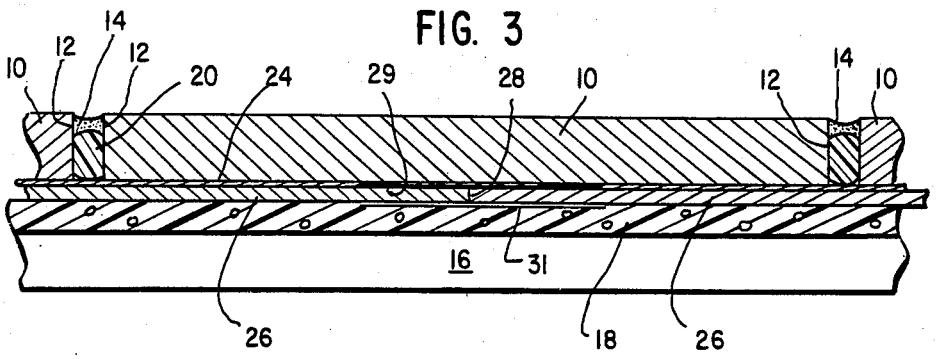
FIG. 3 is an enlarged, transverse, sectional view of the tile covering of this invention affixed to a horizontal-composite-assemblage-sheet, shown resting upon a horizontal-base-surface as the third embodiment of this invention.

Four major qualities of site-installed tile of FIG. 3 are (1) hard-surface tile, such as, ceramic mosaic tile, paver tile, quarry tile, hardwood floor tile, softwood floor tile, stone tile, terrazzo tile, cementitious tile, and resilient tile, (2) horizontal-composite-assemblage-sheets, such as, flexible plastic sheets, flexible metallic sheets, flexible boards, and rigid boards, (3) loose-laid horizontal-disassociation-cushioning-layer, and (4) dynamic-interactive-fluidtight-flexible-joints, which combine to give functional results and benefits which are greater than the sum of the four basic elements, such as:

- Enhanced sound isolation by a horizontal-disassociation-cushioning-layer of elastic foam without mechanical fastening through or adhering to a horizontal-base-surface
- Capability of selecting from a variety of existing hard-surface floor materials as to their relative functional capabilities and long-term cost benefits which best suit building user needs for assembly of finished floor system with other inherent benefits given by this invention
- Substantially improved reliability and endurance by holding floor tiles one to another enduringly with a suitably engineered elastomeric-adhesive-sealant and holding the floor tiles in place by optimum utilization of more dependable and long-term, enduring use of gravity, friction, and accumulated-interactive-assemblage effect by the flexible joint which is filled with dynamic-interactive-fluidtight-elastomeric-adhesive-sealant for holding the tiles one to another by dynamic-interactive-fluidtight-flexible-joints.

Three major qualities of modular-accessible-tiles of FIG. 3 where joints in the horizontal-composite-assemblage-sheets directly below the dynamic-interactive-fluidtight-flexible-joints in the array of modular-accessible-tiles as disclosed in the teachings of this invention, are (1) modular-accessible-tiles, (2) floating of horizontal-disassociation-cushioning-layer, and (3) dynamic-interactive-fluidtight-flexible-joints, which combine to give functional results and benefits which are greater than the above three basic elements, such as:

- Enhanced sound isolation by horizontal-disassociation-cushioning-layers without mechanical fastening through or adhering to the horizontal-base-surface
- Capability of using a variety of hard-surface flooring materials to manufacture modular-accessible-tiles
- When utilizing quarry tile, pavers, ceramic tiles, and certain stones, the dynamic-interactive-fluidtight-flexible-joints give fluidtight joints substantially more impervious to fluids while retaining flexibility of joint and adhesion of elastomeric-adhesive-sealant to perimeter sides of tile and/or perimeter sides of modular-accessible-tiles so that liquids remain on the surface for drainage to drain or cleanup Factory manufacture of modular-accessible-tiles by one of several means outlined and of a variety of hard-surface materials and degrees of sound isolation due to arrangement of horizontal-disassociation-cushioning-layer
- Variety of hard-surface floor materials mating and matching with one another and/or carpet with a thinness to the varying combination as compared to the existing state of the art to meet a variety of functional needs while providing inherent cost effective advantages and improved sound isolation Conservation of finite energy since no steam or pressure is required to make hard-surface modular-accessible-tiles-or dynamic-interactive-fluidtight-flexible-joints in the factory or when assembled on the job Utilization of horizontal-disassociation-cushioning-layer on bottom of modular-accessible-tiles to protect top finish floor surface when modular-accessible-tiles are stacked for shipment Relative thinness of finish floor system assembled of modular-accessible-tiles when compared to existing conventional methods, which has very important advantages in retrofit and remodeling as well as in new construction Capability of relocating modular-accessible-tiles on original project during renovations to meet changing functional needs or for accessibility to repairs Capability of salvaging modular-accessible-tiles and recycling modular-accessible-tiles to other projects Provision of soft resilient feel to hard-surface floor with capability to vary this soft resilient feel to suit user needs and desires by varying the combination of components Capability of hard-surface modular-accessible-tiles to support full height movable partitions or open plan divider panels while providing other inherent advantages of modular-accessible-tile system.

This invention's array of tiles with dynamic-interactive-fluidtight-flexible-joints between tiles and floating free by gravity, friction and accumulated-interactive-assemblage over a horizontal-disassociation-cushioning-layer inherently has limitations which, for example show up when a heavy woman weighing over 200 lbs. and walking in spike heels, heels approximately ¼ inch by ¼ inch in area, causes snapping of large-size quarry tiles when tiles are installed floating on slip sheets and sound isolation horizontal-disassociation-cushioning-layer. For example, in an initial test area of several hundred square feet at the entry of a restaurant, where 12 inch by 12 inch by 12 inch thick octagonal imported Brazilian tile with 4 inch by 4 inch square accent tiles were installed, several 12 inch by 12 inch tiles have broken, it is believed, from a heavy lady walking in spike heels, whereas in an adjacent area the same tiles were installed over an area of several thousand square feet over ⅛ inch thick J-M Flexboard which was installed floating over a ¼ inch thick horizontal-disassociation-cushioning-layer of Omalon II Spec 3 quality urethane foam pad with a density of 4.5 lbs./square foot, with joints of room-temperature cured, self-leveling urethane sealant, there was no failure while subjected to the same use.

Destructive failure testing of other small test sample areas has shown that snapping of tiles can be accomplished by the following:

Use of large-size tiles relative to their thickness

Use of low-temperature fired tiles

Use of porous tiles

Use of more flexible horizontal-disassociation-cushioning-layer, with lower density foam Use of slip sheet when above conditions are present On the other hand, destructive testing of other small test sample areas has shown that snapping of brittle tile cannot be accomplished when the following procedures are followed:

Use of tile with greater thickness to cross sectional area

Use of precision sized, high-temperature fired tiles which are generally having a more uniform size. This type tile generally is becoming mostly available in newer or revamped American plants and standards When using tile of extra large area to thickness, use of horizontal-composite-assemblage-sheets, particularly metallic sheets, performs very well Use denser foam when using tile of extra large area to thickness Testing to date has shown that perimeter tiles are more subject to snapping where tile abuts adjacent carpeted area. Perimeter areas adjacent to walls are not such a problem because the actual weight from the heel of a heavy lady in spike heels does not get right out on the critical edge where tile meets adjacent materials as described above. Tests to date have shown a certain percentage of possibly weaker or more brittle tiles randomly dispered throught the tile shipment. Since this invention, by its inherent nature, when utilized as shown in the drawings, FIGS. 2 and 4, utilizes to the maximum the strength of the tiles, a certain percentage of tiles in a firing or shipment will be significantly weaker or more brittle. Fortunately, inherent to this invention is the relatively easy way tile may be cut out or broken tiles cut out and replaced without visibly showing that replacement has been made.

All testing to date indicates individual quarry tile up to 12 inches by 12 inches, which are at least ½ inch thick and manufactured of good quality clay, fired at a high temperature, of selected good quality, can function quite satisfactorily, provided they are installed over a horizontal-composite-assemblage-sheet floating on a horizontal-disassociation-cushioning-layer of high quality, with a foam thickness of 1/16 inch to ½ inch, with a density at least equal to that of Omalon II Spec 3, which the manufacturer states as having a density of 4.5 lbs./square foot. Materials, such as, varieties of stone, slate, terrazo, concrete, and the like, each have their own individual characteristics and strengths that can be adapted to use by application of the teachings of this invention. Various wood tiles can be used, with wood tiles having great strength without the brittleness inherent in masonry and ceramic tiles, in the same manner as the teachings of this invention.

THE FIRST EMBODIMENT OF THIS INVENTION

Figure 1:
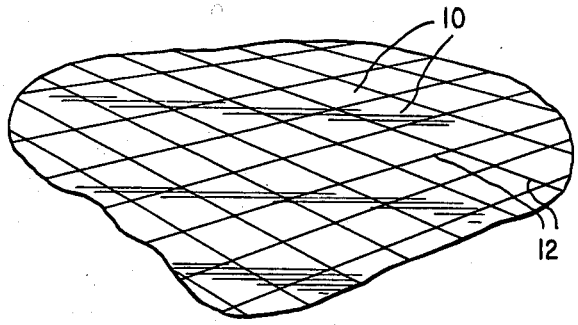
FIG. 1 is a perspective view of a tile covering in accordance with this invention.

Referring to the drawings, FIG. 1 shows a tile covering on a floor, which comprises an array of horizontal-individual-tiles 10 which may, for examples, be quarry tiles 6 inches square and ½ inch thick.

Horizontal-individual-tiles 10 are shown to be adhesively joined at their sides 12 of the adjacent sides 12 of adjoining horizontal-individual-tiles 10 with a dynamic-interactive-fluidtight-elastomeric-adhesive-sealant 14 which may, for example, be a commercially available polyurethane sealant, applied by a manual or pressure application technique.

THE SECOND EMBODIMENT OF THIS INVENTION

Figure 2:
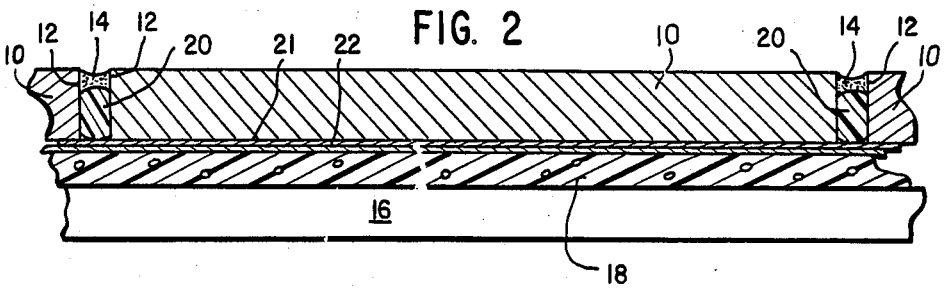
FIG. 2 is an enlarged, transverse, sectional view of the tile covering of this invention assembled over one or more slip sheets, shown resting upon a horizontal-base-surface as a second embodiment of this invention.

Referring to the drawings, FIG. 2 shows horizontal-individual-tiles 10 set on a horizontal-base-surface 16, such as, the building structural subfloor or floor of the room in which the horizontal-individual-tiles 10 are set, being separated from the horizontal-base-surface 16 by a sheet of horizontal-disassociation-cushioning-layer 18 of elastic foam, which is shown to be about ¼ inch thick, but which may be from 1/16 inch to ½ inch thick, and rests on the horizontal-base-surface 16. The thickness of the horizontal-disassociation-cushioning-layer 18 may have flat surfaces or may have an irregular upper or lower surface, if it is desired. For example, flexible plastic foam mats with waffled, herringboned or corrugated surfaces are available and may be used herein.

The horizontal-disassociation-cushioning-layer 18 is provided with one or more, preferably two, optional sheets 21, 22 of flexible plastic slip sheets made, for example, of polyethylene, polyolefin, or any other durable plastic or durable flexible composition sheet, or the like, which are provided to avoid wear of the horizontal-disassociation-cushioning-layer 18 top or bottom surface and to dissipate the minute frictional movement due to tile depression as the horizontal-individual-tiles 10 are depressed to be minutely shifted by dynamic movement of the horizontal-individual-tiles 10 from footsteps or other pressures on the horizontal-individual-tiles 10. The horizontal-disassociation-cushioning-layer 18 may have protective, flexible, plastic slip sheets inherently bonded or adhesively bonded in the manufacturing process to the horizontal-disassociation-cushioning-layer 18, rather than requiring loose slip sheets 21, 22 installed in the field.

Foam rods 20 may be provided, especially with larger tiles, to fill the lower portion of the spaces between tile sides 12 in the manner of a conventional expansion joint, with the dynamic-interactive-fluidtight-elastomeric-adhesive-sealant 14 being applied above the foam rod 20 as shown. Preferably, the dynamic-interactive-fluidtight-flexible-joint (DIFFJ) defined by form rod 20 and elastomeric-adhesive-sealant 14 should have a width between sides 12 so as to be slightly less than the smallest dimension of commonly used spike heel shoes worn by women, i.e., about ¼ inch, so as to preclude damage to the dynamic-interactive-fluidtight-flexible-joints (DIFFJ) or catching the spiked high heel shoe. When horizontal-individual-tile 10 sizes of 2 inches and less, or even 4 inches and less, on a side 12 are used, it is advantageous to reduce the size of the dynamic-interactive-fluidtight-flexible-joints (DIFFJ) between adjoining horizontal-individual-tiles 10 to approximately 1/16 inch. This small joint (DIFFJ) size is particularly suitable to the layout shown in FIG. 3, where the horizontal-individual-tiles 10 are adhered to horizontal-composite-assemblage-sheets 26 for the purpose of holding horizontal-individual-tiles 10 in position when filling the dynamic-interactive-fluidtight-flexible-joints (DIFFJ) between the horizontal-individual-tiles 10 with dynamic-interactive-fluidtight-elastomeric-adhesive-sealant 14.

The dynamic-interactive-fluidtight-elastomeric-adhesive-sealant 14 ties the various horizontal-individual-tiles 10 together so that when one horizontal-individual-tile 10 is depressed by a footstep or the like, the other horizontal-individual-tiles 10 are carried with it, while causing spreading out of the load, exhibiting flexibility in the dynamic-interactive-fluidtight-flexible-joints (DIFFJ) with compression in top and tension in bottom of the dynamic-interactive-fluidtight-joint (DIFFJ), and then tension in the top and compression in the bottom of the dynamic-interactive-fluidtight-flexible-joint (DIFFJ) due to the dynamic movement of the floating horizontal-individual-tiles 10 as the foot is lifted up, and distributing the stresses throughout several horizontal-individual-tiles 10 to reduce the possibility of rupturing a dynamic-interactive-fluidtight-flexible-joint (DIFFJ) or breakage of the horizontal-individual-tiles 10.

In FIG. 2 my invention relies on a synergistic, dynamic interactive combination of relationships wherein the combination uses assemblage of the horizontal-individual-tiles 10 adhered one to another at all perimeter joints (DIFFJ) between adjacent horizontal-individual-tiles 10 with a dynamic-interactive-fluidtight-flexible-joint (DIFFJ) of room-temperature curing, dynamic-interactive-fluidtight-elastomeric-adhesive-sealant 14 to create an enduring dynamic-interactive-fluidtight-flexible-joint (DIFFJ) in tension, compression, shear and assemblage to create a gravity-held-in-place-load-bearing-horizontal-tile-array large enough so that the resulting gravity of the assemblage creates enough tension induced by the accumulated gravity when combined with friction between the bottom of the horizontal-tile-array, loose laid over a slip sheet 21, 22 and horizontal-disassociation-cushioning-layer 18, and slip sheets 21, 22 and horizontal-disassociation-cushioning-layer 18, such as, an elastic foam 18 or cushioning-granular-substrate 18 or a two-layer composite consisting of polyester non-woven filter fabric heat bonded to compression-resistant three-dimensional nylon matting 18, to hold the horizontal-tile-array enduringly in place over a horizontal-disassociation-cushioning-layer 18 where this horizontal-disassociation-cushioning-layer 18 cushions the bottom surface of randomly-loaded horizontal-individual-tiles 10 or hard-surface floor covering 10 when they are brittle, such as, in the case of paver tile, quarry tile, stone tile, and the like. The flexible perimeter joints (DIFFJ) around the perimeter of the horizontal-individual-tiles 10, because of their inherently tenacious adhesion to the sides 12 of the horizontal-individual-tiles 10, provide an enduring dynamic-interactive-fluidtight-flexible-joint (DIFFJ) which if fluidtight against almost all commonly-encountered fluids while providing impact sound isolation, relocatability, and accessibility in an enduring new thin combination for matching adjacent floors, such as carpeted, ceramic, masonry, stone, wood and resilient floors, and retrofitting into existing structures.

THE THIRD EMBODIMENT OF THIS INVENTION

Referring to the drawings, FIG. 3 shows horizontal-individual-tiles 10 sealed with an adhesive layer of conventional thinset tile adhesive 24, with Quar-A-Poxy II as manufactured by H. B. Fuller Co. or Laticrete 4237 as manufactured by Laticrete International being preferred, to an array of abutting, generally highly flexible horizontal-composite-assemblage-sheets 26, such as, asbestos-cement-board, galvanized sheet metal, or tempered hardboard, preferably having a thickness of about ⅛ inch to ¼ inch for asbestos-cement board, as underlayment floating above a horizontal-disassociation-cushioning layer 18. As a result of further testing, galvanized sheet metal is preferred. A preferred flexible asbestos-cement board is 'Flexboard' as manufactured by Johns-Manville because of its greater strength to elasticity and flexibility without being brittle, as compared to Belgian-made 'Flexweld' as manufactured by Glasweld, while will also function. Thinset adhesive layer 24 may be provided to simply locate horizontal-individual-tiles 10 prior to insertion of the foam rods 20 and dynamic-interactive-fluidtight-elastomeric-adhesive-sealant 14, to facilitate the side 12 sealing process by preventing sliding of the horizontal-invididual-tiles 10 while installing foam rods 20 and the dynamic-interactive-fluidtight-elastomeric-adhesive-sealant 14. Generally, bonding horizontal-individual-tiles 10 smaller than 6 inches on a side 12 and, particularly, when horizontal-individual-tiles 10 are 2 inches or less on a side 12, flexible-horizontal-composite-assemblage-sheet 26 is particularly desirable as to the mechanics of assembling the dynamic-interactive-fluidtight-flexible-joints (DIFFJ). Foam rods 20 may be eliminated and the entire dynamic-interactive-fluidtight-flexible-joint (DIFFJ) filled with self-leveling-elastomeric-adhesive-sealant 14. Also foam rods 20 may be replaced by sand, gravel, perlite, vermiculite, and the like, or by gun-grade-elastomeric-adhesive-sealant 15.

In FIG. 3 my invention relies on a dynamic interactive combination of relationship wherein the combination uses the assemblage of horizontal-individual-tiles 10 adhered to a horizontal-composite-assemblage-sheet 26, such as flexible plastic sheets, flexible metallic sheets, flexible boards, or rigid boards, to create a gravity-held-in-place-load-bearing-horizontal-tile-array large enough so that the resulting gravity of the assemblage creates enough tension, induced by the accumulated gravity, when combined with friction between the bottom of the horizontal-composite-assemblage-sheet 26 and the top of the horizontal-disassociation-cushioning-layer 18 so as to hold the horizontal-tile-array enduringly in place over the horizontal-disassociation-cushioning-layer 18, such as, an elastic foam layer 18 or a cushioning-granular-substrate 18 or a two-layer composite consisting of polyester non-woven filter fabric heat-bonded to compression-resistant three-dimensional nylon matting 18, while this horizontal-disassociation-cushioning-layer 18 cushions the bottom surface of the hard-surface horizontal-individual-tiles 10 from the horizontal-base-surface 16, particularly when the horizontal-individual-tiles 10 are brittle, such as, ceramic mosaic tile, paver tile, quarry tile, stone tile, and the like. The dynamic-interactive-fluidtight-flexible-joints (DIFFJ) use room-temperature curing, dynamic-interactive-fluidtight-flexible-joints (DIFFJ) around the perimeter of each horizontal-individual-tile 10 to keep the horizontal-individual-tiles 10 adhered to each other flexibly and enduringly one to another in a fluidtight manner in tension, compression, shear, and assemblage in order to provide improved impact sound isolation, relocatability and accessibility in an enduring new thin combination while providing dynamic-interactive-fluidtight-flexible-joints (DIFFJ) and a very thin new combination for matching adjacent carpeted floors and retrofitting into existing structures.

In FIG. 3, the horizontal-individual-tiles 10 are assembled on the horizontal-composite-assemblage-sheet 26 one to another to form the assemblage into a gravity-held-in-place-load-bearing-horizontal-tile-array or an array of modular-accessible-tiles so gravity, friction, and accumulated-interactive-assemblage can be exploited to hold them in place without adhesion to the horizontal-base-surface 16. The horizontal-composite-assemblage-sheets 26 position the horizontal-individual-tiles 10 for filling of the dynamic-interactive-fluidtight-flexible-joints (DIFFJ). The horizontal-composite-assemblage-sheets 26 in the combination function cooperatively to give flexibility to the dynamic-interactive-fluidtight-flexible-joints (DIFFJ).

To protect the top surface of factory-produced modular-accessible-tiles 10 during production, storage and transit, a compressible substrate is provided when the modular-accessible-tiles are stacked one on top of another, with a rigid separator between completed modular-accessible-tiles so that the accumulating weight of a stack of modular-accessible-tiles will force the top surfaces of the horizontal-individual-tiles 10 to press against the rigid flat bottom surface of the rigid separator to force more uniform self-leveling of the top surfaces of the modular-accessible-tiles. Thus, slight variations between horizontal-individual-tiles 10 in their thickness or in the warp of the horizontal-individual-tiles 10 force a slight compression of the thin horizontal-disassociation-cushioning-layer 18 with the benefit that upon curing of the room-temperature curing, self-leveling-elastomeric-adhesive-sealant 14 the array of hard-surface modular-accessible-tiles naturally lies more uniformly level.

THE FOURTH EMBODIMENT OF THIS INVENTION

Figure 4:
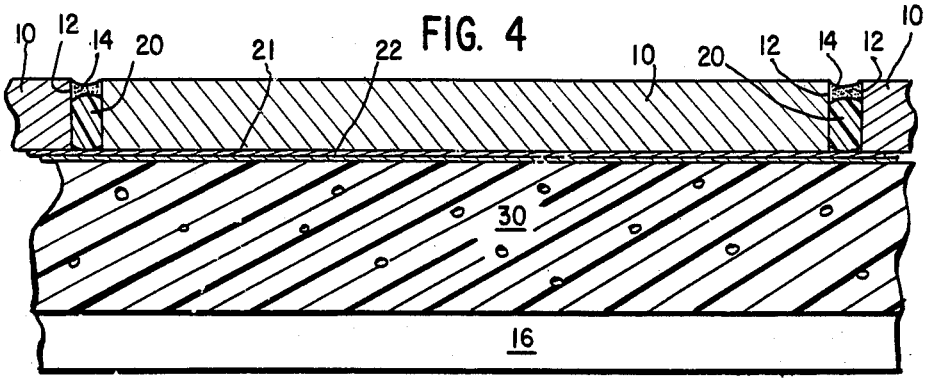
FIG. 4 is an enlarge, transverse, sectional view of the tile covering of this invention assembled over rigid-foam-insulation, shown then resting upon a horizontal-base-surface as a fourth embodiment of this invention.

Referring to the drawings, FIG. 4 shows horizontal-individual-tiles 10, dynamic-interactive-fluidtight-elastomeric-adhesive-sealant 14, foam rods 20, and slip sheets 21, 22 of a form similar or identical to that previously disclosed with respect to FIG. 2.

In this embodiment, the underlying thickness of the horizontal-disassociation-cushioning-layer 18 has been replaced with a thickness of horizontal-rigid-foam-insulation 30, which may be polystyrene foam, for example, and is present in at least a $\frac{3}{4}$ inch thickness, and is preferably of any thickness functionally required for thermal insulation purposes. As in the previous embodiments, the horizontal-individual-tiles 10 are adhesively joined at their sides 12 to adjacent sides 12 of adjoining horizontal-individual-tiles 10 with the bead of dynamic-interactive-fluidtight-elastomeric-adhesive-sealant 14. The underlying foam rod 20 may be present or omitted, as previously described.

Slip sheets 21 and 22, as previously described, may also be provided to protect the flexible horizontal-rigid-foam-insulation 30 from abrasion as the horizontal-individual-tiles 10 shift and work on the horizontal-rigid-foam-insulation 30 as they are pressed into the horizontal-rigid-foam-insulation 30. Where greater flexibility is desired, horizontal-disassociation-cushioning-layer 18, as previously described, may also be provided. Horizontal-composite-assemblage-sheets 26, as previously described, may also be provided.

An advantage of this structure is that not only does it provide impact sound isolation, but it provides thermal insulation as well to offset the fact that different temperatures may be desired in the spaces above and below the floor assembly described or to offset the effects of solar heat gain being transmitted from one area to another through the floor assembly.

In FIG. 4, my invention relies on a dynamic interactive combination of relationships similar to FIG. 2, wherein the combination uses assemblage of horizontal-individual-tiles 10 adhered one to another at all perimeter joints (DIFFJ) between adjacent horizontal-individual-tiles 10 with a dynamic-interactive-fluidtight-flexible-joint (DIFFJ) of room-temperature-curing, dynamic-interactive-fluidtight-elastomeric-adhesive-sealant 14 to create an enduring dynamic-interactive-fluidtight-flexible-joint (DIFFJ) in tension, compression, shear and assemblage to create a gravity-held-in-place-load-bearing-horizontal-tile-array large enough so that the resulting gravity of the assemblage creates enough tension induced by the accumulated gravity when combined with friction between the bottom of the horizontal-tile-array, loose laid over a slip sheet 21, 22 and horizontal-rigid-foam-insulation 30 to hold the horizontal-tile-array enduringly in place over the horizontal-rigid-foam-insulation 30 where this horizontal-rigid-foam-insulation 30 acts as a horizontal-disassociation-cushioning-layer 18 cushioning the bottom surface of randomly-loaded horizontal-individual-tiles 10 or hard-surface floor coverings 10 when they are brittle, such as in the case of paver tile, quarry tile, stone tile, and the like. The flexible perimeter joints (DIFFJ) around the perimeter of the horizontal-individual-tiles 10, because of their inherently tenacious adhesion to the sides 12 of the horizontal-individual-tiles 10, provide an enduring dynamic-interactive-fluid-tight-flexible-joint (DIFFJ) which is fluidtight against almost all commonly-encountered fluids while providing impact sound isolation, relocatability, and accessibility in an enduring new thin combination for matching adjacent floors, such as, carpeted, ceramic, masonry, stone, wood, and resilient floors, and retrofitting into existing structures.

As in the previous embodiments, the dynamic-interactive-fluidtight-flexible-joints (DIFFJ) provided by dynamic-interactive-fluidtight-elastomeric-adhesive-sealant 14 make possible the placement of horizontal-individual-tiles 10 on the horizontal-rigid-foam-insulation 30, without cracking of the horizontal-individual-tiles 10 or the bonds between the horizontal-individual-tiles 10 as the horizontal-rigid-foam-insulation 30 is compressed due to the pressure of footsteps and other stresses, while also achieving the desired impact sound isolation and also thermal insulation.

As a result of this invention, upstairs rooms with tile floors may be utilized in multi-story-buildings and other areas where design appearance, personal preferences, sanitation conditions, or economic cost value benefits indicate the need for easily maintained, cleanable tile floors, while at the same time achieving the desired advantage of substantially suppressed transmission of impact noise to the occupied spaces below the tile floor and/or providing thermal insulation between the upper and lower habitable spaces.

THE FIFTH EMBODIMENT OF THIS INVENTION

Figure 5:
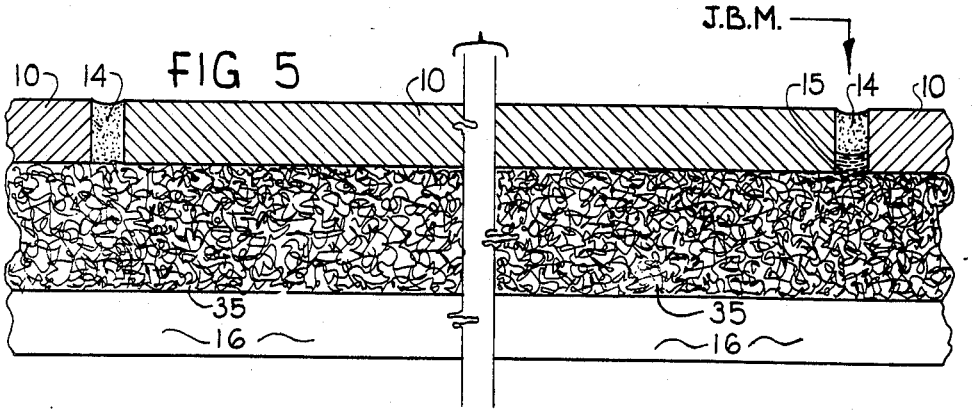
FIG. 5 is an enlarged, transverse, sectional view of the tile covering of this invention, shown disposed over any type of resilient substrate as a fifth embodiment of this invention.

Referring to the drawings, FIG. 5 shows a plurality of any of the various types of hard-surface horizontal-individual-tiles 10 having a top wearing surface, a bottom surface, three or more sides 12 to each horizontal-individual-tile 10, with sides 12 being perpendicular to the parallel top and bottom surfaces of the horizontal-individual-tile 10 and approximate uniform joint (DIFFJ) thickness between adjacent horizontal-individual-tiles 10. The horizontal-individual-tiles 10 are sized and assembled with a patterned layout so the layout provides a realtively uniform width dynamic-interactive-fluidtight-flexible-joint (DIFFJ) between all adjacent horizontal-individual-tiles 10 for receiving a fluid-installed-dynamic-interactive-fluidtight-flexible-joints (DIFFJ), installed over any type of resilient substrate 35, such as:

Horizontal-disassociation-cushioning-layer

Disassociation elastic foam pads of the type used as carpeting pads, such as, Omalon II polyurethane foam Thin disassociation elastic foam layer, such as, polyethylene Horizontal-rigid-foam-insulation Resilient substrate 35

Non-woven compression-resistant three-dimensional nylon matting

Non-woven vinyl random filament construction.

Figure 17:
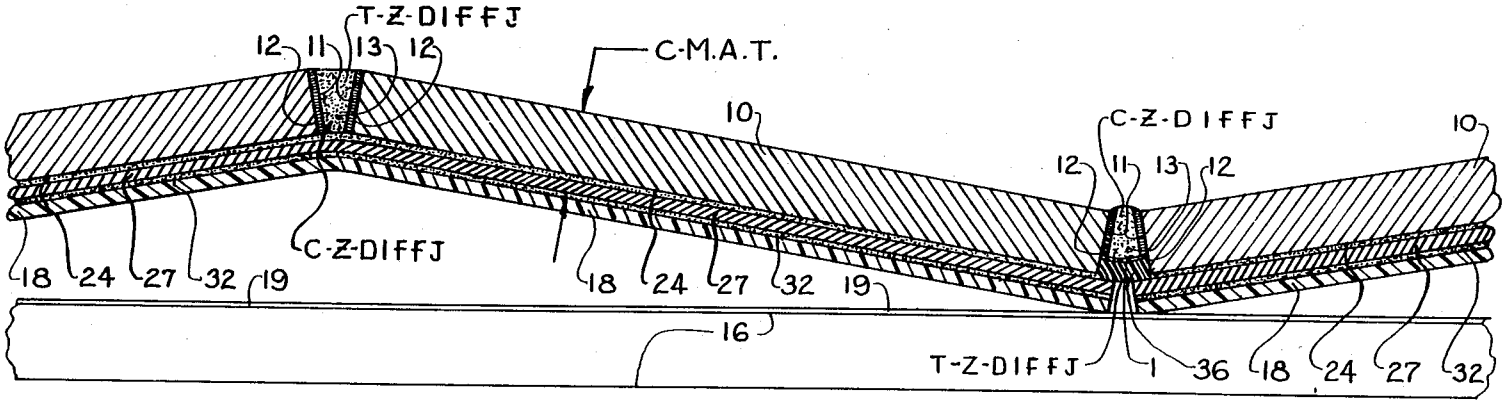
FIG. 17 is an enlarged, accentuated, transverse, sectional view of dynamic-interactive-fluidtight-flexible-joints, depicting the cohesion zone and adhesion zones of the flexible joints of this invention relative to FIG. 16.
Figure 18:
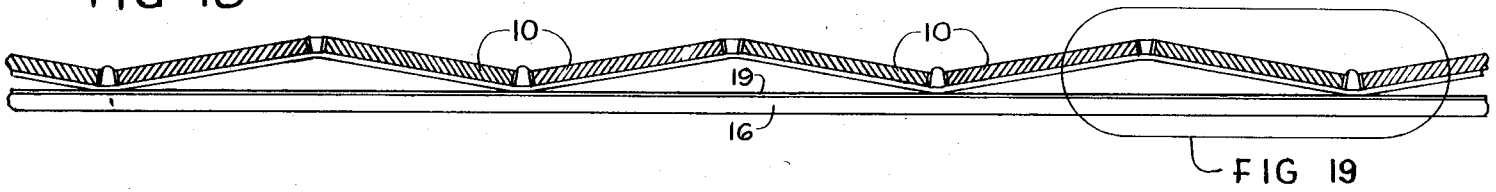
FIG. 18 is an accentuated, explanatory, transverse, sectional view of the tile-covering-array and modular-accessible-tiles of this invention illustrative and applicable to FIG. 9, with certain other figures having many applicable similarities.
Figure 19:
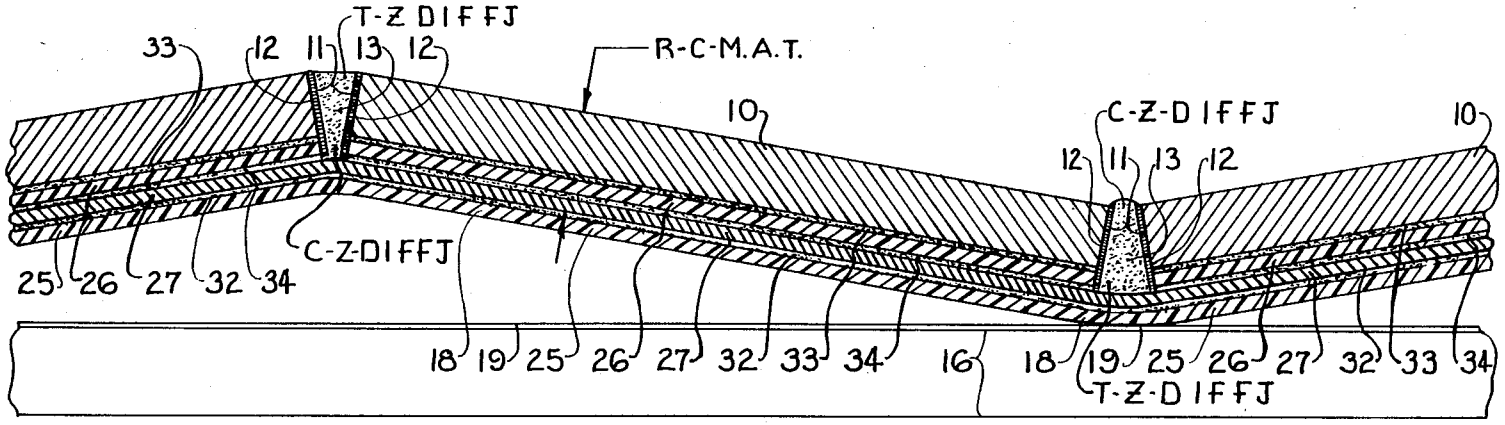
FIG. 19 is an enlarged, accentuated, transverse, sectional view of dynamic-interactive-fluidtight-flexible-joints, depicting the cohesion zone and adhesion zones of the flexible joints of this invention relative to FIG. 18.

The fluid-installed-dynamic-interactive-fluidtight-flexible-joints (DIFFJ) between all adjacent perimeter sides 12 of all horizontal-individual-tiles 10 in the gravity-held-in-place-load-bearing-horizontal-tile-array are formed by, preferably, urethane elastomeric-adhesive-sealant 14, with an adhesion zone 11, as illustrated in FIGS. 17 and 19, whereby all perimeter sides 12 of the horizontal-individual-tiles 10 have elastomeric-adhesive-sealant 14 enduringly adhered over the entire height and perimeter length of the perimeter sides 12 of the horizontal-individual-tiles 10. A cohesion zone 13, as illustrated in FIGS. 17 and 19, joins together the adjacent adhesion zones 11 of all adjacent perimeter sides 12 of all horizontal-individual-tiles 10 with self-leveling-elastomeric-adhesive-sealant 14 forming the dynamic-interactive-fluidtight-flexible-joints (DIFFJ) between all adjacent horizontal-individual-tiles 10.

The dynamic-interactive-fluidtight-flexible-joints (DIFFJ) between all perimeter sides 12 of all horizontal-individual-tiles 10 causes the gravity of the horizontal-individual-tiles 10 and the friction between various layers in the assembly when disposed over the loose-laid resilient substrate 35 to form a combination with the scale of the assemblage such that the gravity, friction, and accumulated-interactive-assemblage holds the horizontal-tile-array firmly in place.

The dynamic-interactive-fluidtight-flexible-joints (DIFFJ) also perform a plurality of required, necessary, dynamic, interactive, flexible response functions for exterior and interior use to constantly changing points of generally random, uneven, off-center loading of the horizontal-individual-tiles 10, reacting to moving loads such as are generated by walking loads and rolling loads in this combination's dynamic interaction to the functional use of this flexible new combination where the joints (DIFFJ) between the horizontal-individual-tiles 10 are fluidtight, cuttable, accessible, and reassembleable for access to networks of conductors, conduits, piping, and any other type of utilities required below the array of gravity-held-in-place-load-bearing-horizontal-tiles.

THE SIXTH EMBODIMENT OF THIS INVENTION

Figure 6:
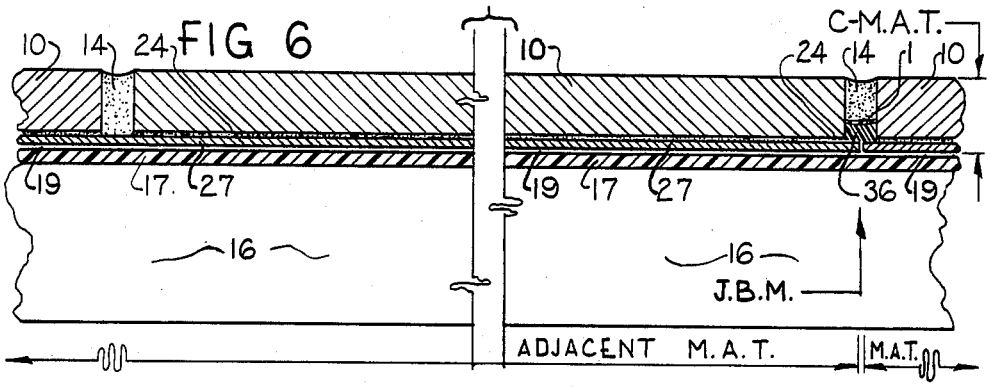
FIG. 6 is an enlarged, transverse, sectional view of the modular-accessible-tiles of this invention having horizontal-individual-tiles adhered to a horizontal-composite-assemblage-sheet, shown disposed over a flat conductor cable system and a horizontal-disassociation-cushioning-layer loose laid over a horizontal-base-surface as a sixth embodiment of this invention.

Referred to for communicative reasons on drawings and herein as C-M.A.T. (composite-modular-accessible-tile) disposed over flat conductor cable and a horizontal-disassociation-cushioning-layer loose laid over a horizontal-base surface Referring to the drawings, FIG. 6 shows a horizontal-disassociation-cushioning-layer 17 disposed over a horizontal-base-surface 16 accommodates flat conductor cable 19 into the top surface of the elastic foam horizontal-disassociation-cushioning-layer 17 to provide cushioning to the bottom surface of gravity-held-in-place-load-bearing-horizontal-composite-modular-accessible-tiles (C-M.A.T.) from directly contacting the hard top surface of the horizontal-base-surface 16 and generating impact sound when they make direct contact with each other and to diminish direct transfer of impact sound from foot and rolling traffic contacting the top surface of the gravity-held-in-place-load-bearing-horizontal-composite-modular-accessible-tiles (C-M.A.T.) from direct transfer of this impact sound to the horizontal-base surface 16. The horizontal-composite-assemblage-sheet 27 is sized to a size selected for one or more horizontal-individual-tiles 10 as a multiple of horizontal-individual-tiles 10 with allowance for uniform joint (DIFFJ) width between horizontal-individual-tiles 10. A plurality of horizontal-individual-tiles 10 have a top wearing surface, a bottom surface, three or more sides 12 to each horizontal-individual-tile 10, with the sides 12 being perpendicular to the parallel top and bottom surfaces of the horizontal-individual-tiles 10 and of approximate uniform joint (DIFFJ) thickness between adjacent horizontal-individual-tiles 10. The horizontal-individual-tiles 10 are sized and assembled with a patterned layout to match the size of the composite-modular-accessible-tiles (C-M.A.T.) so the layout of the C-M.A.T. provides a relatively uniform width joint (DIFFJ) between all adjacent horizontal-individual-tiles 10 for receiving a fluid-installed-dynamic-interactive-fluidtight-flexible-joint (DIFFJ).

The plurality of horizontal-individual-tiles 10 is assembled and adhered to the horizontal-composite-assemblage-sheet 27 with a suitably engineered adhesive 24 over the entire bottom surface of the horizontal-individual tiles 10, with a uniform width joint (DIFFJ) between all adjacent horizontal-individual-tiles 10 forming composite-modular-accessible-tiles (C-M.A.T.), with the suitably engineered adhesive 24 adhered to the bottom surface of the horizontal-individual-tiles 10 and to the top of the horizontal-composite-assemblage-sheet 27 acting to prevent self-leveling-elastomeric-adhesive-sealant 14 from running out between the bottom surface of the horizontal-individual-tiles 10 and the top of the horizontal-composite-assemblage-sheet 27 before setting up of the elastomeric-adhesive-sealant 14. The horizontal-individual-tiles 10 form a series of homogeneous composites with the horizontal-composite-assemblage-sheet 27 to prevent the horizontal-individual-tiles 10 from coming loose and causing clanking noises when foot traffic comes in contact with the horizontal-individual-tiles 10 in future use of the horizontal-individual-tiles 10. The horizontal-composite-assemblage-sheet 27 is utilized to keep the self-leveling-elastomeric-adhesive-sealant 14 from dripping or draining through onto production equipment, with the ensuing expensive breaking down and cleanup of the production equipment. The horizontal-composite-assemblage-sheet 27 is also utilized as a separator for earlier horizontal stacking of composite-modular-accessible-tiles (C-M.A.T.) in a plurality of layers than is practical with the omission of the horizontal-composite-assemblage-sheet 27.

The dynamic-interactive-fluidtight-flexible-joints (DIFFJ) between all adjacent perimeter sides 12 of all horizontal-individual-tiles 10 forming the composite-modular-accessible-tiles (C-M.A.T.) are dynamic-interactive-fluidtight-elastomeric-adhesive-sealant-joints (DIFFJ), preferably formed of urethane, with an adhesion zone 11 as illustrated in FIGS. 17 and 19, whereby all perimeter sides 12 of the horizontal-individual-tiles 10 have the self-leveling-elastomeric-adhesive-sealant 14 enduringly adhered over the entire height and perimeter length of the perimeter sides 12 of the horizontal-individual-tiles 10. A cohesion zone 13 joins together adjacent adhesion zones 11 of all adjacent perimeter sides 12 of all adjacent horizontal-individual-tiles 10, with the elastomeric-adhesive-sealant 14 forming dynamic-interactive-fluidtight-flexible-joints (DIFFJ) between all adjacent horizontal-individual-tiles 10. The flexible joints (DIFFJ) have a dam of gun-grade-elastomeric-adhesive-sealant 15 adhered for the full depth of the joint (DIFFJ) to prevent the self-leveling-elastomeric-adhesive-sealant 14 from running out of the uncured flexible joints (DIFFJ).

The plurality of horizontal-individual-tiles 10 is assembled and adhered to the horizontal-composite-assemblage-sheet 27 with a suitably engineered adhesive 24 applied over the entire bottom surface of the horizontal-individual-tiles 10 to form a homogeneous composite of each horizontal-individual-tile 10 and the portion of the horizontal-composite-assemblage-sheet 27 directly below the horizontal-individual-tile 10, with the intervening plane of weakness and flexibility in the fluidtight-flexible-joint area (DIFFJ) on all perimeter sides 12 of the homogeneous composite forming a flexible-hinge-zone on two or more axes surrounding the horizontal-individual-tile 10 adhered to the horizontal-composite-assemblage-sheet 27. This elastomeric-adhesive-sealant 14 becomes the relatively weakened-place flexible-hinge-zone of the composite-modular-accessible-tiles (C-M.A.T.) at all intervening joints (DIFFJ) when compared to the much greater rigidity of the homogeneous composite formed of each horizontal-individual-tile 10 adhered by the suitably engineered adhesive 24 to the horizontal-composite-assemblage-sheet 27.

The dynamic-interactive-fluidtight-flexible-joints (DIFFJ) of the gravity-held-in-place-load-bearing-horizontal-modular-accessible-tiles (C-M.A.T.) are formed with the dynamic-interactive-fluidtight-flexible-joints (DIFFJ) between the horizontal-individual-tiles 10 having a plurality of functions whereby the dynamic-interactive-fluidtight-elastomeric-adhesive-sealant 14 filling all the perimeter joints 12 around the sides 12 of the horizontal-individual-tiles 10 functions to create accumulated-interactive-assemblage of the horizontal-individual-tiles 10 into accessible, movable and relocatable composite-modular-accessible-tiles (C-M.A.T.) while the top of the loose-laid horizontal-disassociation-cushioning-layer 17 accommodates the thickness variations of the flat conductor cable 19.

THE SEVENTH EMBODIMENT OF THIS INVENTION

Figure 7:
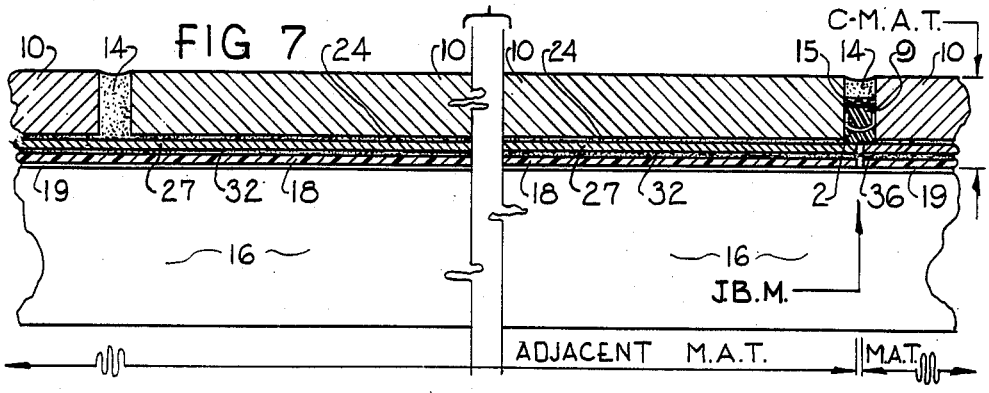
FIG. 7 is an enlarged, transverse, sectional view of the modular-accessible-tiles of this invention having horizontal-individual-tiles adhered to a horizontal-composite-assemblage-sheet with a horizontal-disassociation-cushining-layer adhered to the bottom of the horizontal-composite-assemblage-sheet, disposed over a flat conductor cable system which is disposed over a horizontal-base-surface as a seventh embodiment of this invention.

Referred to for communicative reasons on drawings herein as C-M.A.T. (composite-modular-accessible-tile) with a horizontal-disassociation-cushioning-layer adhered to the bottom of the C-M.A.T., disposed over flat conductor cable and a horizontal-base-surface Referring to the drawings, FIG. 7 shows the bottom surface of the composite-modular-accessible-tile (C-M.A.T.) is not adhered to the top of the horizontal-base-surface 16. The bottom surface of the horizontal-composite-assemblage-sheet 27 is separated from the top of the horizontal-base surface 16 by a horizontal-disassociation-cushioning-layer 18 disposed over the horizontal-base-surface 16, accommodating flat conductor cable 19 into the bottom surface of the elastic foam horizontal-disassociation-cushioning-layer 18. The horizontal-disassociation-cushioning-layer 18 is adhered to the bottom surface of the horizontal-composite-assemblage-sheet 27, and the horizontal-disassociation-cushioning-layer 18 compresses over the flat conductor cable 19 to accommodate varying thicknesses of the flat conductor cable 19 while providing cushioning of the bottom surface of the gravity-held-in-place-load-bearing-horizontal-composite-modular-accessible-tiles formed as and denoted as composite-modular-accessible-tiles (C-M.A.T.) from directly contacting the hard top surface of the horizontal-base-surface 16 and generating impact sound when they make direct contact with each other and diminish direct transfer of impact sound from foot and rolling traffic contacting the top surface of the composite-modular-accessible-tiles (C-M.A.T.) from the direct transfer of this impact sound to the horizontal-base-surface 16.

The horizontal-disassociation-cushioning-layer 18 is adhered with a suitably engineered adhesive 32 to the bottom of the horizontal-disassociation-cushioning-layer 27 as an integral part of the composite-modular-accessible-tiles (C-M.A.T.) for a plurality of synergistic functions and benefits, such as, providing only one complete item to transport and install at the jobsite, providing cushioning between the composite-modular-accessible-tiles (C-M.A.T.) during transport to the jobsite and handling at the jobsite, providing only one combined item to install at the jobsite, and providing the horizontal-disassociation-cushioning-layer 18 to readily yield to accommodate the increased thickness of the flat conductor cable 19 and protective layers, the thin flat conductor cable 19 connections and protective layers, crossover points of the flat conductor cables 19 and separator layers, and overlapping folds for changes in direction of the flat conductor cable 19 in a functional, accommodating manner to not visually telegraph on finish flooring surface plan layout of concealed-from-view flat conductor cable 19 and for the horizontal-disassociation-cushioning-layer 18 to fully absorb the slight bulge of the flat conductor cable 19 due to thickness buildup so the composite-modular-accessible-tiles (C-M.A.T.) do not tilt and rock in position due to the increased thickness of the flat conductor cable 19.

The horizontal-composite-assemblage-sheet 27 is sized to a size selected for composite-modular-accessible-tiles (C-M.A.T.) as a multiple of one or more horizontal-individual-tiles 10 with allowance for uniform width dynamic-interactive-fluidtight-flexible-joints (DIFFJ) between the horizontal-individual-tiles 10, with the horizontal-composite-assemblage-sheet 27 and the horizontal-individual-tiles 10 disposed over the horizontal-disassociation-cushioning-layer 27. A plurality of horizontal-individual-tiles 10 have a top wearing surface, a bottom surface, three or more sides 12 to each horizontal-individual-tile 10, with the sides 12 being perpendicular to the parallel top and bottom surfaces of the horizontal-individual-tile 10, with approximate uniform joint (DIFFJ) thickness between adjacent horizontal-individual-tiles 10 and with horizontal-individual-tiles 10 sized and assembled with a patterned layout to match the size of the composite-modular-accessible-tiles (C-M.A.T.) so the layout provides relatively uniform width joint (DIFFJ) between all adjacent horizontal-individual-tiles 10 for receiving a fluid-installed-dynamic-interactive-fluidtight-flexible-joint (DIFFJ).

The plurality of horizontal-individual-tiles 10 is assembled and adhered to the horizontal-composite-assemblage-sheet 27 with a suitably engineered adhesive 24 over the entire bottom surface of the horizontal-individual-tiles 10, with a uniform width joint (DIFFJ) between all adjacent horizontal-individual-tiles 10 to form composite-modular-accessible-tiles (C-M.A.T.), with the suitably engineered adhesive 24 applied to the top of the horizontal-composite-assemblage-sheet 27 to adhere the layers together and to prevent self-leveling-elastomeric-adhesive-sealant 14 from running out between the bottom surface of the horizontal-individual-tiles 10 and the top of the horizontal-composite-assemblage-sheet 27 before setting up of the self-leveling-elastomeric-adhesive-sealant 14.

The horizontal-individual-tiles 10 form a series of homogeneous composites with the horizontal-composite-assemblage-sheet 27 to prevent the horizontal-individual-tiles 10 from coming loose and causing clanking noises when foot traffic comes in contact with the horizontal-individual-tiles 10 in future use of the horizontal-individual-tiles 10. The horizontal-composite-assemblage-sheet 27 is utilized to keep the self-leveling-elastomeric-adhesive-sealant 14 from dripping or draining through onto production equipment, with the ensuing expensive breaking down and cleanup of the production equipment. The horizontal-composite-assemblage-sheet 27 is also utilized as a separator for earlier horizontal stacking of composite-modular-accessible-tiles (C-M.A.T.) in a plurality of layers during production than is practical with the omission of the horizontal-composite-assemblage-sheet 27.

The dynamic-interactive-fluidtight-flexible-joints (DIFFJ) between all adjacent perimeter sides 12 of all horizontal-individual-tiles 10 forming the composite-modular-accessible-tiles (C-M.A.T.) are, preferably, formed of urethane elastomeric-adhesive-sealant 14, with an adhesion zone 11 whereby all perimeter sides 12 of the horizontal-individual-tiles 10 have the self-leveling-elastomeric-adhesive-sealant 14 enduringly adhered over the entire height and perimeter length of the perimeter sides 12 of the horizontal-individual-tiles 10. A cohesion zone 13 joins together the adjacent adhesion zones 11 of all adjacent perimeter sides 12 of all adjacent horizontal-individual-tiles 10, with the self-leveling-elastomeric-adhesive-sealant 14 forming the dynamic-interactive-fluidtight-flexible-joints (DIFFJ) between all adjacent horizontal-individual-tiles 10.

The plurality of horizontal-individual-tiles 10 is assembled and adhered to the horizontal-composite-assemblage-sheet 27 with a suitably engineered adhesive 24 applied over the entire bottom surface of the horizontal-individual-tiles 10 to form a homogeneous composite of each horizontal-individual-tile 10 and the portion of the horizontal-composite-assemblage-sheet 27 directly below the horizontal-individual-tile 10, with the intervening plane of weakness and flexibility in the fluidtight-flexible-joint area (DIFFJ) on all perimeter sides 12 of the homogeneous composite forming a flexible-hinge-zone on two or more axes surrounding the horizontal-individual-tile 10 adhered to the horizontal-composite-assemblage-sheet 27. This elastomeric-adhesive-sealant 14 becomes the relatively weakened-plane flexible-hinge-zone of the composite-modular-accessible-tiles (C-M.A.T.) at all intervening joints (DIFFJ) when compared to the much greater rigidity of the homogenous composite formed of each horizontal-individual-tile 10 adhered by the suitably engineered adhesive 24 to the horizontal-composite-assemblage-sheet 27. The dynamic-interactive-fluidtight-flexible-joints (DIFFJ) of the gravity-held-in-place-load-bearing-horizontal-composite-modular-accessible-tiles (C-M.A.T.) are formed with dynamic-interactive-fluid-tight-flexible-joints (DIFFJ) between the horizontal-individual-tiles 10 having a plurality of functions whereby the dynamic-interactive-fluidtight-elasomeric-adhesive-sealant 14 filling all perimeter joints (DIFFJ) around the sides 12 of the horizontal-individual-tiles 10 functions to create accumulated-interactive-assemblage of the horizontal-individual-tiles 10 into accessible, movable and relocatable composite-modular-accessible-tiles (C-M.A.T.) when suitably disposed over the horizontal-disassociation-cushioning-layer 18 serving to cushion the bottom surface of brittle, randomly-loaded tiles having dynamic-interactive-fluidtight-flexible-joints (DIFFJ) from impact against the hard horizontal-base-surface 16 while the bottom of the horizontal-disassociation-cushioning-layer 18 accommodates the thickness variations of the flat conductor cable 19.

THE EIGHTH EMBODIMENT OF THIS INVENTION

Figure 8:
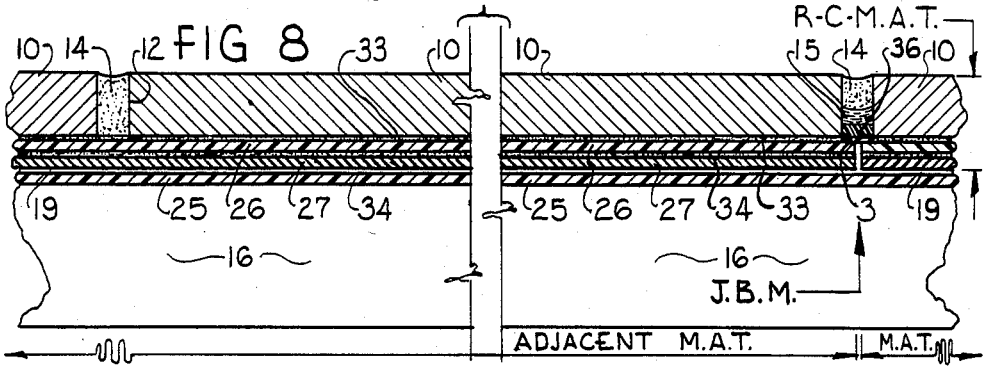
FIG. 8 is an enlarged, transverse, sectional view of the modular-accessible-tiles of this invention, having the horizontal-individual-tiles adhered to a horizontal-composite-assemblage-sheet by means of a second horizontal-disassociation-cushioning-layer sandwiched between the horizontal-individual-tiles and the horizontal-composite-assemblage-sheet, disposed over a flat conductor cable system and a first horizontal-disassociation-cushioning-layer consisting of an elastic foam layer loose laid over a horizontal-base-surface as an eighth embodiment of this invention.

Referred to for communicative reasons on drawings and herein as R-C-M.A.T. (resilient-composite-modular-accessible-tile) with a sandwiched horizontal-disassociation-cushioning-layer with R-C-M.A.T. disposed over flat conductor cable and a horizontal-disassociation-cushioning layer Referring to the drawings, FIG. 8 shows the loose-laid first horizontal-disassociation-cushioning-layer 25 is not adhered to the bottom surface of the horizontal-composite-assemblage-sheet 27 but is loose laid over the horizontal-base-surface 16 upon which the flat conductor cable 19 is then disposed as functionally required onto the first horizontal-disassociation-cushioning-layer 25. The bottom surface of the resilient-composite-modular-accessible-tile (R-C-M.A.T.) is not adhered to the top of the flat conductor cable 19 or to the top of the first horizontal-disassociation-cushioning-layer 25. The first horizontal-disassociation-cushioning-layer 25 provides cushioning of the bottom surface of the gravity-held-in-place-load-bearing-horizontal-composite-modular-accessible-tiles formed as and denoted as resilient-composite-modular-accessible-tiles (R-C-M.A.T.) from directly contacting the hard top surface of the horizontal-base-surface 16 and generating impact sound from making direct contact thereon. Also the first horizontal-disassociation-cushioning-layer 25 is provided to diminish direct transfer of impact sound from foot and rolling traffic contacting the top surface of the resilient-composite-modular-accessible-tiles (R-C-M.A.T.) from direct transfer of impact sound to the horizontal-base-surface 16.

The first horizontal-disassociation-cushioning-layer 25 is loose laid over the horizontal-base-surface 16 and is not an integral part of the resilient-composite-modular-accessible-tiles (R-C-M.A.T.). The first horizontal-disassociation-cushioning-layer 25 provides a plurality of synergistic functions and benefits, such as, yielding to accommodate itself to the increased thickness of the flat conductor cable 19 and protective layers, the thin flat conductor cable 19 connections and protective layers, crossover points of the flat conductor cable 19 and separator layers, and overlapping folds for changes in direction of the flat conductor cable 19 in a functional, accommodating manner to not visually telegraph on finish flooring surface plan layout of concealed-from-view flat conductor cable 19 and to fully absorb the slight bulge of the flat conductor cable 19 due to the thickness buildup so the resilient-composite-modular-accessible-tiles (R-C-M.A.T.) do not tilt and rock in position due to the increased thickness of the flat conductor cable 19.

The horizontal-composite-assemblage-sheet 27 is sized to a size selected for resilient-composite-modular-accessible-tiles (R-C-M.A.T.) as a multiple of one or more horizontal-individual-tiles 10 with allowance for uniform width dynamic-interactive-fluidtight-flexible-joint (DIFFJ) between the horizontal-individual-tiles 10, with the horizontal-composite-assemblage-sheet 27, the second horizontal-disassociation-cushioning-layer 26, and the horizontal-individual-tiles 10 disposed over the loose-laid first horizontal-disassociation-cushioning-layer 25.

The plurality of horizontal-individual-tiles 10 have a top wearing surface, a bottom surface, three or more sides 12 to each horizontal-individual-tile 10, with the sides 12 being perpendicular to the parallel top and bottom surfaces of the horizontal-individual-tile 10 and having approximate uniform joint thickness between adjacent horizontal-individual-tiles 10. The horizontal-individual-tiles 10 are sized and assembled with a patterned layout to match the size of the resilient-composite-modular-accessible-tiles (R-C-M.A.T.) so the layout provides a realtively uniform width joint (DIFFJ) between all adjacent horizontal-individual-tiles 10 for receiving a fluid-installed-dynamic-interactive-fluid-tight-flexible-joint (DIFFJ).

A resilient homogeneous composite is formed by having the second horizontal-disassociation-cushioning-layer 26 sandwiched between a plurality of horizontal-individual-tiles 10 and the horizontal-composite-assemblage-sheet 27 to form a resilient-composite-modular-accessible-tile (R-C-M.A.T.) with a suitably engineered adhesive 33 for adhering the entire bottom surface of the plurality of horizontal-individual-tiles 10 to the entire top surface of the second horizontal-disassociation-cushioning-layer 26 and also with a suitably engineered adhesive 34 for adhering the entire bottom surface of the second horizontal-disassociation-cushioning-layer 26 to the entire top surface of the horizontal-composite-assemblage-sheet 27 so they both act to prevent the self-leveling-elastomeric-adhesive-sealant 14 from running out between the bottom layer sandwiched between the bottom of the horizontal-individual-tiles 10 and the top surface of the horizontal-composite-assemblage-sheet 27.

The second horizontal-disassociation-cushioning-layer 26 is also utilized to keep the self-leveling-elastomeric-adhesive-sealant 14 from dripping or draining through onto production equipment, with the ensuing expensive breaking down and cleanup of the production equipment. The second horizontal-disassociation-cushioning layer 26 and the horizontal-composite-assemblage-sheet 27 are also utilized as a separator for earlier horizontal stacking of the resilient-composite-modular-accessible-tiles (R-C-M.A.T.) in a plurality of layers than is practical with the omission of the horizontal-composite-assemblage-sheet 27.

The dynamic-interactive-fluidtight-flexible-joints (DIFFJ) between all adjacent perimeter sides 12 of all horizontal-individual-tiles 10 forming the resilient-composite-modular-accessible-tiles (R-C-M.A.T.) are formed, preferably, of urethane elastomeric-adhesive-sealant 14, with an adhesion zone 11, as illustrated in FIGS. 17 and 19, whereby all perimeter sides 12 of the horizontal-individual-tiles 10 have self-leveling-elastomeric-adhesive-sealant 14 enduringly adhered over the entire height and perimeter length of the perimeter sides of the horizontal-individual-tiles 10. A cohesion zone 13 joins together the adjacent adhesion zones 11 of all adjacent perimeter sides 12 of all adjacent horizontal-individual-tiles 10 with self-leveling-elastomeric-adhesive-sealant 14 forming the dynamic-interactive-fluidtight-flexible-joints (DIFFJ) between all adjacent horizontal-individual-tiles 10.

The plurality of horizontal-individual-tiles 10 is assembled and resiliently adhered by means of the second horizontal-disassociation-cushioning-layer 26 to the horizontal-composite-assemblage-sheet 27 with suitably engineered adhesive layers, with adhesive layer 33 for adhering the horizontal-individual-tiles 10 to the second horizontal-disassociation-cushioning-layer 26 applied over the entire bottom surface of the horizontal-individual-tiles 10 and an adhesive layer 34 applied between the bottom of the second horizontal-disassociation-cushioning-layer 26 and the top of the horizontal-composite-assemblage-sheet 27 to form the resilient homogeneous composite of each horizontal-individual-tile 10 and the portion of the horizontal-composite-assemblage-sheet 27 directly below the horizontal-individual-tile 10, whereby the intervening plane of weakness and flexibility in the fluidtight-flexible-joint (DIFFJ) area on all perimeter sides 12 of the resilient homogeneous composite forms a flexible-hinge-zone on two or more axes surround the horizontal-individual-tile 10. The horizontal-composite-assemblage-sheet 27 and the self-leveling-elastomeric-adhesive-sealant 14 become the relatively weakened-plane flexible-hinge-zone of the resilient-composite-modular-accessible-tiles (R-C-M.A.T.) at all intervening joints (DIFFJ), when compared to the much greater rigidity of the resilient homogeneous composite formed of each horizontal-individual-tile 10 resiliently adhered to the horizontal-composite-assemblage-sheet 27 by the second horizontal-disassociation-cushioning-layer 26 and the portion of the horizontal-composite-assemblage-sheet 27.

The dynamic-interactive-fluidtight-flexible-joints (DIFFJ) between the horizontal-individual-tiles 10 have a plurality of functions whereby the dynamic-interactive-fluidtight-elastomeric-adhesive-sealant 14 filling all perimeter joints (DIFFJ) around all sides 12 of the horizontal-individual-tiles 10 functions to create accumulated-interactive-assemblage of said horizontal-individual-tiles 10 into accessible, movable and relocatable resilient-composite-modular-accessible-tiles (R-C-M.A.T.) when suitably disposed over the second horizontal-disassociation-cushioning-layer 26 serving to cushion the bottom surface of brittle, randomly-loaded tiles 10 having the dynamic-interactive-fluidtight-flexible-joints (DIFFJ) from impact against the hard surface of the horizontal-composite-assemblage-sheet 27.

THE NINTH EMBODIMENT OF THIS INVENTION

Figure 9:
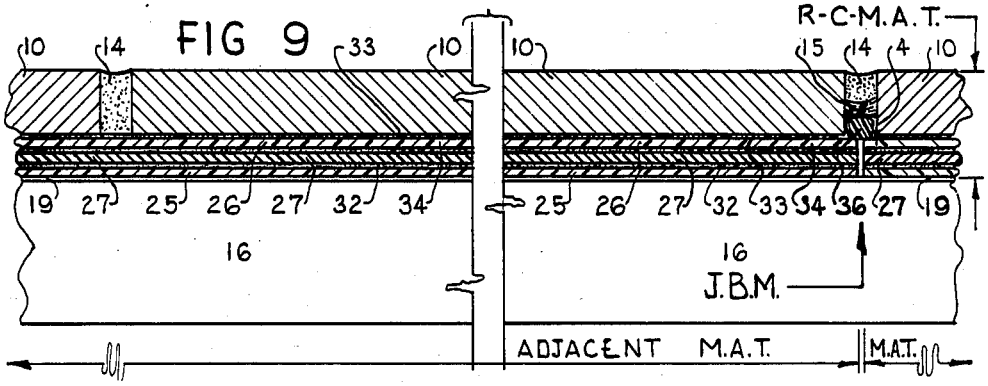
FIG. 9 is an enlarged, transverse, sectional view of the modular-accessible-tiles of this invention, having the horizontal-individual-tiles adhere to a horizontal-composite-assemblage-sheet by means of a second horizontal-disassociation-cushioning-layer sandwiched between the horizontal-individual-tiles and the horizontal-composite-assemblage-sheet while having a first horizontal-disassociation-cushioning-layer adhered to the bottom of the horizontal-composite-assemblage-sheet, disposed over a flat conductor cable system which is disposed over a horizontal-base-surface as a ninth embodiment of this invention.

Referred to for communicative reasons on drawings and herein as R-C-M.A.T. (resilient-composite-modular-accessibe-tile) having a first and second horizontal-disassociation-cushioning-layer with R-C-M.A.T. disposed over flat conductor cable and a horizontal-base surface Referring to the drawings, FIG. 9 shows the first horizontal-disassociation-cushioning-layer 25 adhered with a suitably engineered adhesive 32 for adhering the entire top surface of the horizontal-disassociation-cushioning-layer 25 to the entire bottom surface of the horizontal-composite-assemblage-sheet 27 to provide cushioning of the bottom surface of the resilient-composite-modular-accessible-tiles (R-C-M.A.T.) from directly contacting the hard top surface of the horizontal-base-surface 16 and generating impact sound from making direct contact with each other and diminishing direct transfer of impact sound from foot and rolling traffic coming in contact with the top surface of the resilient-composite-modular-accessible-tiles (R-C-M.A.T.) from the direct transfer of this impact sound to the horizontal-base-surface 16 while the bottom of the gravity-held-in-place-load-bearing-horizontal-modular-accessible-tiles formed and denoted as resilient-composite-modular-accessible-tiles (R-C-M.A.T.) are not adhered to the top of the horizontal-base-surface 16 or the top of flat conductor cable 19.

The first horizontal-disassociation-cushioning-layer 25 is an integral part of the resilient-composite-modular-accessible-tiles (R-C-M.A.T.) and provides a plurality of synergistic functions and benefits, such as, providing only one complete item to transport and install at the jobsite, providing cushioning between resilient-composite-modular-accessible-tiles (R-C-M.A.T.) during transport to the jobsite and handling at the jobsite, providing only one combined item to install at the jobsite. The first horizontal-disassociation-cushioning-layer 25 also readily yields to accommodate the increased thickness of the flat conductor cable 19 and protective layers, thin flat conductor cable 19 and connections and protective layers; crossover points of the flat conductor cables 19 and separator layers, and overlapping folds for changes in direction of the flat conductor cable 19 in a functional, accommodating manner to not visually telegraph on finish floor surface plan layout of the concealed-from-view flat conductor cable 19 and to fully absorb the slight bulge of the flat conductor cable 19 due to thickness buildup so the resilient-composite-modular-accessible-tiles (R-C-M.A.T.) do not tilt and rock in position due to the increased thickness of the flat conductor cable 19.

The flat conductor cable 19 is affixed to the horizontal-base-surface 16 in conformance with established UL and flat conductor cable manufacturer's recommendations.

The horizontal-composite-assemblage-sheet 27 is sized to a size selected for resilient-composite-modular-accessible-tiles (R-C-M.A.T.) as a multiple of one or more horizontal-individual-tiles 10 with allowance for a uniform width dynamic-interactive-fluidtight-flexible-joint (DIFFJ) between the horizontal-individual-tiles 10. The horizontal-composite-assemblage-sheet 27, the second horizontal-disassociation-cushioning-layer 26, the horizontal-individual-tiles 10, and the first horizontal-disassociation-cushioning-layer 25 are disposed loose laid over the flat conductor cable 19 and the horizontal-base-surface 16.

A plurality of horizontal-individual-tiles 10 has a top wearing surface, a bottom surface, three or more sides 12 to each horizontal-individual-tile 10, with the sides 12 being perpendicular to the parallel top and bottom surfaces of the horizontal-individual-tile 10, with an approximate uniform joint thickness between adjacent horizontal-individual-tiles 10. The horizontal-individual-tiles 10 are sized and assembled with a patterned layout to match the size of the resilient-composite-modular-accessible-tiles (R-C-M.A.T.) so the layout provides a relatively uniform width joint (DIFFJ) between all adjacent horizontal-individual-tiles 10 for receiving a fluid-installed-dynamic-interactive-fluid-tight-flexible-joint (DIFFJ).

A resilient homogeneous composite is formed by having the second horizontal-disassociation-cushioning-layer 26 sandwiched between a plurality of horizontal-individual-tiles 10 and the horizontal-composite-assemblage-sheet 27 to form a resilient-composite-modular-accessible-tile (R-C-M.A.T.) with a suitably engineered adhesive 33 for adhering the entire bottom surface of the plurality of horizontal-individual-tiles 10 to the entire top surface of the second horizontal-disassociation-cushioning-layer 26 and also with a suitably engineered adhesive 34 for adhering the entire bottom surface of the second horizontal-disassociation-cushioning-layer 26 to the entire top surface of the horizontal-composite-assemblage-sheet 27 so they both act to prevent the self-leveling-elastomeric-adhesive-sealant 14 from running out between the bottom layers sandwiched between the bottom of the horizontal-individual-tiles 10 and the top surface of the horizontal-composite-assemblage-sheet 27.

The second horizontal-disassociation-cushioning-layer 26 is also utilized to keep the self-leveling-elastomeric-adhesive-sealant 14 from dripping or draining through onto production equipment, with the ensuing expensive breaking down and cleanup of the production equipment. The first horizontal-disassociation-cushioning-layer 25, the second horizontal-disassociation-cushioning-layer 26, and the horizontal-composite-assemblage-sheet 27 are also utilized as a separator for earlier horizontal stacking of the resilient-composite-modular-accessible-tiles (R-C-M.A.T.) in a plurality of layers than is practical with the omission of the horizontal-composite-assemblage-sheet 27.

The dynamic-interactive-fluidtight-flexible-joints (DIFFJ) between all adjacent perimeter sides 12 of all the horizontal-individual-tiles 10 in the resilient-composite-modular-accessible-tiles (R-C-M.A.T.) are formed, preferably, of urethane elastomeric-adhesive-sealant 14, with an adhesion zone 11 as illustrated in FIGS. 17 and 19, whereby all perimeter sides 12 of the horizontal-individual-tiles 10 have the self-leveling-elastomeric-adhesive-sealant 14 enduringly adhered over the entire height and perimeter length of the perimeter sides 12 of the horizontal-individual-tiles 10. A cohesion zone 13 joins together the adjacent zones 11 of all adjacent perimeter sides 12 of all adjacent horizontal-individual-tiles 10, with the self-leveling-elastomeric-adhesive-sealant 14 forming the dynamic-interactive-fluidtight-flexible-joints (DIFFJ) between all adjacent horizontal-individual-tiles 10.

The plurality of horizontal-individual-tiles 10 is assembled and resiliently adhered by means of the second horizontal-disassociation-cushioning-layer 26 to the horizontal-composite-assemblage-sheet 27 with suitably engineered adhesive layers with adhesive layer 32 for adhering the horizontal-individual-tiles 10 to the second horizontal-disassociation-cushioning-layer 26 applied over the entire bottom surface of the horizontal-individual-tiles 10 and adhesive layer 34 applied between the bottom of the second horizontal-disassociation-cushioning-layer 26 and the top of the horizontal-composite-assemblage-sheet 27 to form the resilient homogeneous composite of each horizontal-individual-tile 10 and the portion of the horizontal-composite-assemblage-sheet 27 directly below the horizontal-individual-tile 10. The intervening plane of weakness and flexibility in the fluidtight-flexible-joint (DIFFJ) area on all perimeter sides 12 of the resilient homogeneous composite forms a flexible-hinge-zone on two or more axes surrounding the horizontal-individual-tile 10, with the horizontal-composite-assemblage-sheet 27 and the elastomeric-adhesive-sealant 14 becoming the relatively weakened-plane flexible-hinge-zone of the resilient-composite-modular-accessible-tiles (R-C-M.A.T.) at all intervening joints, when compared to the much greater rigidity of the resilient homogeneous composite formed of each horizontal-individual-tile 10 resiliently adhered to the horizontal-composite-assemblage-sheet 27 by the second horizontal-disassociation-cushioning-layer 26 and the portion of the horizontal-composite-assemblage-sheet 27. The dynamic-interactive-fluidtight-flexible-joints (DIFFJ) of the resilient-composite-modular-accessible-tiles (R-C-M.A.T.) with the dynamic-interactive-fluidtight-flexible-joints (DIFFJ) between the horizontal-individual-tiles 10 have a plurality of functions whereby the dynamic-interactive-fluidtight-elastomeric-adhesive-sealant 14 filling all perimeter joints (DIFFJ) around all sides 12 of the horizontal-individual-tiles 10 functions to create accumulated-interactive-assemblage of the horizontal-individual-tiles 10 into accessible, movable and relocatable resilient-composite-modular-accessible-tiles (R-C-M.A.T.) when suitably disposed over the second horizontal-disassociation-cushioning-layer 26 serving to cushion the bottom surface of brittle, randomly-loaded tiles 10 having dynamic-interactive-fluidtight-flexible-joints (DIFFJ) from impact against the hard surface of the horizontal-composite-assemblage-sheet. The first horizontal-disassociation-cushioning-layer 25 adhered to the horizontal-composite-assemblage-sheet 27 additionally provides a horizontal-disassociation-cushioning-layer 25 for improved impact sound isolation and for accommodating, protecting, and cushioning the flat conductor cable 19.

THE TENTH EMBODIMENT OF THIS INVENTION

Figure 10:
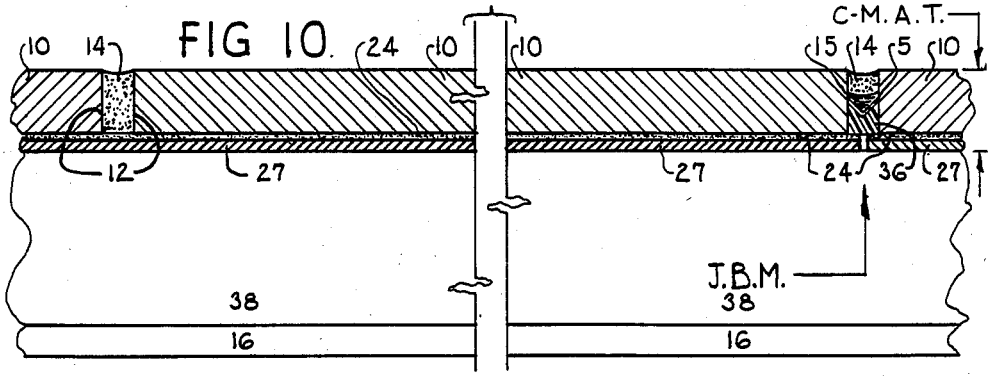
FIG. 10 is an enlarged, transverse, sectional view of the modular-accessible-tiles of this invention having horizontal-individual-tiles adhered to a horizontal-composite-assemblage-sheet, shown disposed over a three-dimensional-passage-and-support-matrix disposed over a horizontal-base-surface as a tenth embodiment of this invention.

Referred to for communicative reasons on drawings and herein as C-M.A.T. (composite-modular-accessible-tile) disposed over a three-dimensional-passage-and-support-matrix Referring to the drawings, FIG. 10 shows the three-dimensional-passage-and-support-matrix 38 for accommodating one or more flat or round insulated electrical or electronic conductors, plastic or metallic conduits, plastic or metallic piping for distributing gases, fluids, chilled fluid return and supply, hot fluid return and supply, or fire control sprinkler fluid disposed over the horizontal-base-surface 16, with the three-dimensional-passage-and-support-matrix 38 separating the bottom surface of the gravity-held-in-place-load-bearing-horizontal-composite-modular-accessible-tiles denoted as composite-modular-accessible-tiles (C-M.A.T.).

The horizontal-composite-assemblage-sheet 27 is sized to a size selected for one or more horizontal-individual-tiles 10 as a multiple of the horizontal-individual-tiles 10 with allowance for a uniform width dynamic-interactive-fluidtight-flexible-joint (DIFFJ) between the horizontal-individual-tiles 10. The horizontal-composite-assemblage-sheet 27 and the horizontal-individual-tiles 10 are disposed over the thre-dimensional-passage-and-support-matrix 38 which is disposed over the horizontal-base-surface 16.

A plurality of horizontal-individual-tiles 10 has a top wearing surface, a bottom surface, three or more sides 12 to each horizontal-individual-tile 10, with the sides 12 being perpendicular to the parallel top and bottom surfaces of the horizontal-individual-tile 10, with an approximate uniform joint (DIFFJ) thickness between adjacent horizontal-individual-tiles 10. The horizontal-individual-tiles 10 are sized and assembled with a patterned layout to match the size of the composite-modular-accessible-tiles (C-M.A.T.) so the layout of the composite-modular-accessible-tiles (C-M.A.T.) provides a relatively uniform width joint (DIFFJ) between all adjacent horizontal-individual-tiles 10 for receiving a fluid-installed-interactive-fluidtight-flexible-joint (DIFFJ).

The plurality of horizontal-individual-tiles 10 is assembled and adhered to the horizontal-composite-assemblage-sheet 27 with a suitably engineered adhesive 24 over the entire bottom surface of the horizontal-individual-tiles 10, with a uniform width joint (DIFFJ) between all adjacent horizontal-individual-tiles 10 to form the composite-modular-accessible-tiles (C-M.A.T.). The adhesive 24 is applied to the bottom surface of the horizontal-individual-tiles 10 and to the top of the horizontal-composite-assemblage-sheet 27 to adhere the layers together and acting to prevent self-leveling-elastomeric-adhesive-sealant 14 from running out between the bottom surface of the horizontal-individual-tiles 10 and the top of the horizontal-composite-assemblage-sheet 27 before setting up the elastomeric-adhesive-sealant 14.

The horizontal-individual-tiles 10 form a series of homogeneous composites with the horizontal-composite-assemblage-sheet 27 to prevent the horizontal-individual-tiles 10 from coming loose and causing clanking noises when foot traffic comes in contact with the horizontal-individual-tiles 10 in future use of the horizontal-individual-tiles 10.

The horizontal-composite-assemblage-sheet 27 is utilized to keep the self-leveling-elastomeric-adhesive-sealant 14 from dripping or draining through onto production equipment, with the ensuing expensive breaking down and cleanup of the production equipment. The horizontal-composite-assemblage-sheet 27 is also utilized as a separator for earlier horizontal stacking of the composite-modular-accessible-tiles (C-M.A.T.) in a plurality of layers than is practical with the omission of the horizontal-composite-assemblage-sheet 27.

The dynamic-interactive-fluidtight-flexible-joints (DIFFJ) have a dam of gun-grade-elastomeric-adhesive-sealant 15 adhered for the full depth of the joints (DIFFJ) to prevent the self-leveling-elastomeric-adhesive-sealant 14 from running out of the uncured flexible joints (DIFFJ).

The dynamic-interactive-fluidtight-flexible-joints (DIFFJ) between all adjacent perimeter sides 12 of all horizontal-individual-tiles 10 forming the composite-modular-accessible-tiles (C-M.A.T.) are, preferably, formed of urethane elastomeric-adhesive-sealant 14, with an adhesion zone 11 as illustrated in FIGS. 17 and 19 whereby all perimeter sides 12 of the horizontal-individual-tiles 10 have the self-leveling-elastomeric-adhesive-sealant 14 enduringly adhered over the entire height and perimeter length of the perimeter sides 12 of the horizontal-individual-tiles 10.

A cohesion zone 13 as illustrated in FIGS. 17 and 19 joins together adjacent zones 11 of all adjacent perimeter sides 12 of all adjacent horizontal-individual-tiles 10, with the elastomeric-adhesive-sealant 14 forming the dynamic-interactive-fluidtight-flexible-joints (DIFFJ) between all adjacent horizontal-individual-tiles 10.

The plurality of horizontal-individual-tiles 10 is assembled and adhered to the horizontal-composite-assemblage-sheet 27 with a suitably engineered adhesive 24 applied over the entire bottom surface of the horizontal-individual-tiles 10 to form a homogeneous composite of each horizontal-individual-tile 10 and the portion of the horizontal-composite-assemblage-sheet 27 directly below the horizontal-individual-tile 10, with the intervening plane of weakness and flexibility in the fluidtight-flexible-joint (DIFFJ) area on all peimeter sides 12 of the homogeneous composite forming a flexible-hinge-zone on two or more axes surrounding the horizontal-individual-tile 10 adhered to the horizontal-composite-assemblage-sheet 27. This elastomeric-adhesive-sealant 14 becomes the relatively weakened-plane flexible-hinge-zone of the composite-modular-accessible-tiles (C-M.A.T.) at all intervening joints (DIFFJ) when compared to the much greater rigidity of the homogeneous composite formed of each horizontal-individual-tile 10 adhered by the suitably engineered adhesive 24 to the horizontal-composite-assemblage-sheet 27.

The dynamic-interactive-fluidtight-flexible-joints (DIFFJ) of the gravity-held-in-place-load-bearing-horizontal-composite-modular-accessible-tiles (C-M.A.T.) are formed with dynamic-interactive-fluidtight-flexible-joints (DIFFJ) between the horizontal-individual-tiles 10 having a plurality of functions whereby the dynamic-interactive-fluidtight-elastomeric-adhesive-sealant 14 filling all perimeter joints (DIFFJ) around the sides 12 of the horizontal-individual-tiles 10 functions to create accumulated-interactive-assemblage of the horizontal-individual-tiles 10 into cuttable, accessible, movable, relocatable, and reassembleable composite-modular-accessible-tiles (C-M.A.T.) when suitably disposed over the three-dimensional-passage-and-support-matrix 38.

THE ELEVENTH EMBODIMENT OF THIS INVENTION

Referred to for communicative reasons on drawings and herein as C-M.A.T. (composite-modular-accessible-tile) with a horizontal-diassocation-cushioning-layer adhered to C-M.A.T. disposed over a three-dimensional-passage-and-support matrix.

Figure 11:
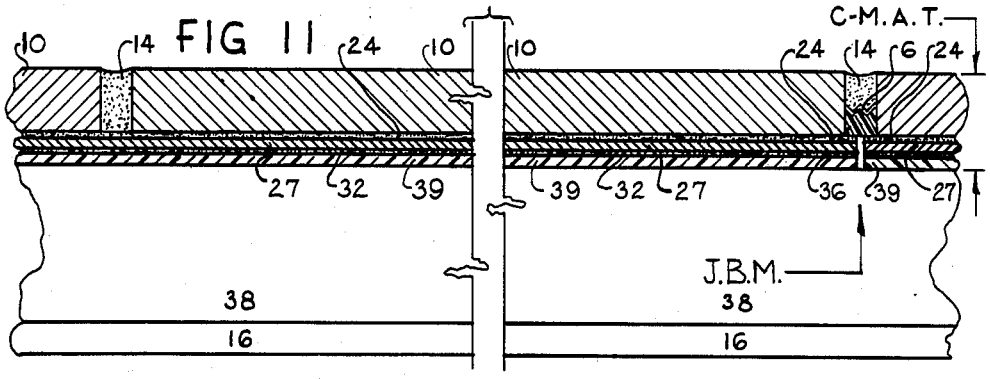
FIG. 11 is an enlarged, transverse, sectional view of the modular-accessible-tiles of this invention having horizontal-individual-tiles adhered to a horizontal-composite-assemblage-sheet with a horizontal-disassociation-cushioning-layer adhered to the bottom of the horizontal-composite-assemblage-sheet, disposed over a three-dimensional-passage-and-support-matrix disposed over a horizontal-base-surface as the eleventh embodiment of this invention.

Referring to the drawings, FIG. 11 shows the three-dimensional-passage-and-support-matrix 38 for accommodating one or more flat or round insulated electrical or electronic conductors, plastic or metallic conduits, plastic or metallic piping for distributing gases, fluids, chilled fluid return and supply, hot fluid return and supply, or fire control sprinkler fluid disposed over the horizontal-base-surface 16, with the three-dimensional-passage-and-support-matrix 38 separating the bottom surface of the horizontal-disassociation-cushioning-layer 39 adhered to the bottom of the horizontal-composite-assemblage-sheet 27 from the top of the horizontal-base-surface 16.

The horizontal-disassociation-cushioning-layer 39 is adhered with a suitably engineered adhesive 32 to the bottom surface of the horizontal-composite-assemblage-sheet 27 and positioned against the three-dimensional-passage-and-support-matrix 38, with the horizontal-disassociation-cushioning-layer 39 bearing at least at the points of bearing against the three-dimensional-passage-and-support-matrix 38, providing cushioning of the bottom surface of the gravity-held-in-place-load-bearing-horizontal-composite-modular-accessible-tiles denoted as composite-modular-accessible-tiles (C-M.A.T.) so as to prevent direct contact with the top surface of the three-dimensional-passage-and-support-matrix 38 and the generating of impact sound if they make direct contact with each other and diminishing direct transfer of impact sound from foot and rolling traffic when contacting the top surface of the composite-modular-accessible-tiles (C-M.A.T.) from the direct transfer of this impact sound to the horizontal-base-surface 16.

The horizontal-disassociation-cushioning-layer 39 adhered with a suitably engineered adhesive 32 to the bottom of the horizontal-composite-assemblage-sheet 27 as an integral part of the composite-modular-accessible-tiles (C-M.A.T.) provides a plurality of synergistic functions and benefits, such as, providing only one complete item to transport and install at the jobsite, providing cushioning between the composite-modular-accessible-tiles (C-M.A.T.) during transport to the jobsite and handling at the jobsite, and providing only one combined item to install at the jobsite.

The horizontal-composite-assemblage-sheet 27 is sized to a size for the composite-modular-accessible-tiles (C-M.A.T.) as a multiple of one or more horizontal-individual-tiles 10 with allowance for a uniform width dynamic-interactive-fluidtight-flexible-joint (DIFFJ) between the horizontal-individual-tiles 10, with the horizontal-composite-assemblage-sheet 27, the horizontal-individual-tiles 10, and the horizontal-disassociation-cushioning-layer 39 disposed over the three-dimensional-passage-and-support-matrix 38.

The plurality of horizontal-individual-tiles 10 has a top wearing surface, a bottom surface, three or more sides 12 to each horizontal-individual-tile 10, with the sides 12 being perpendicular to the parallel top and bottom surfaces of the horizontal-individual-tile 10, with approximate uniform joint (DIFFJ) thickness between adjacent horizontal-individual-tiles 10. The horizontal-individual-tiles 10 are sized and assembled with a patterned layout to match the size of the composite-modular-accessible-tiles (C-M.A.T.) so that the layout of the composite-modular-accessible-tiles (C-M.A.T.) provides a relatively uniform width joint (DIFFJ) between all adjacent horizontal-individual-tiles 10 for receiving a fluid-installed-dynamic-interactive-fluidtight-flexible-joint (DIFFJ).

The plurality of horizontal-individual-tiles 10 is assembled and adhered to the horizontal-composite-assemblage-sheet 27 with a suitably engineered adhesive 24 over the entire bottom surface of the horizontal-individual-tiles 10, with a uniform width joint (DIFFJ) between all adjacent horizontal-individual-tiles 10 to form the composite-modular-accessible-tiles (C-M.A.T.) with the adhesive 24 applied to the bottom surface of the horizontal-individual-tiles 10 and to the top of the horizontal-composite-assemblage-sheet 27 to adhere the layers together and acting to prevent self-leveling-elastomeric-adhesive-sealant 14 from flowing out between the bottom surface of the horizontal-individual-tiles 10 and the top of the horizontal-composite-assemblage-sheet 27 before setting up of the elastomeric-adhesive-sealant 14.

The horizontal-individual-tiles 10 form a series of homogeneous composites with the horizontal-composite-assemblage-sheet 27 to prevent the horizontal-individual-tiles 10 from coming loose and causing clanking noises when foot traffic comes in contact with the horizontal-individual-tiles 10 in future use of the horizontal-individual-tiles 10. The horizontal-composite-assemblage-sheet 27 is utilized to keep the self-leveling-elastomeric-adhesive-sealant 14 from dripping or draining through onto production equipment, with the ensuing expensive breaking down and cleanup of the production equipment. The horizontal-composite-assemblage-sheet 27 and the horizontal-disassociation-cushioning-layer 39 are also utilized as a separator for earlier horizontal-stacking of said composite-modular-accessible-tiles (C-M.A.T.) in a plurality of layers than is practical with the omission of the horizontal-composite-assemblage-sheet 27.

The dynamic-interactive-fluidtight-flexible-joints (DIFFJ) between all adjacent perimeter sides 12 of all horizontal-individual-tiles 10 forming the composite-modular-accessible-tiles (C-M.A.T.) are formed, preferably, of urethane elastomeric-adhesive-sealant 14, with an adhesion zone 11 as illustrated in FIGS. 17 and 19, whereby all perimeter sides 12 of the horizontal-individual-tiles 10 have the self-leveling-elastomeric-adhesive-sealant 14 enduringly adhered over the entire height and perimeter length of the perimeter sides 12 of the horizontal-individual-tiles 10. A cohesion zone 13 as illustrated in FIGS. 17 and 19 joins together adjacent adhesion zones 11 of all adjacent perimeter sides 12 of all adjacent horizontal-individual-tiles 10 with self-leveling-elastomeric-adhesive-sealant 14 forming the dynamic-interactive-fluidtight-flexible-joints (DIFFJ) between all adjacent horizontal-individual-tiles 10.

The plurality of horizontal-individual-tiles 10 is assembled and adhered to the horizontal-composite-assemblage-sheet 27 with a suitably engineered adhesive 24 applied over the entire bottom surface of the horizontal-individual-tiles 10 to form a homogeneous composite of each horizontal-individual-tile 10 and the portion of the horizontal-composite-assemblage-sheet 27 directly below the horizontal-individual-tile 10. The intervening plane of weakness and flexibility in the fluidtight-flexible-joint (DIFFJ) area on all perimeter sides 12 of the homogeneous composite forms a flexible-hinge-zone on two or more axes surrounding the horizontal-individual-tile 10 adhered to the horizontal-composite-assemblage-sheet 27, and this elastomeric-adhesive-sealant 14 becomes the relatively weakened-plane flexible-hinge-zone of the composite-modular-accessible-tiles (C-M.A.T.) at all intervening joints (DIFFJ), when compared to the much greater rigidity of the homogeneous composite formed of each horizontal-individual-tile 10 adhered by adhesive 24 to the horizontal-composite-assemblage-sheet 27.

The dynamic-interactive-fluidtight-flexible-joints (DIFFJ) of the composite-modular-accessible-tiles (C-M.A.T.) are formed with the dynamic-interactive-fluidtight-flexible-joints (DIFFJ) between the horizontal-individual-tiles 10 having a plurality of functions whereby the dynamic-interactive-fluidtight-elastomeric-adhesive-sealant 14 filling all perimeter joints around the sides 12 of the horizontal-individual-tiles 10 functions to create accumulated-interactive-assemblage of the horizontal-individual-tiles 10 into cuttable, accessible, movable, relocatable, and reassembleable composite-modular-accessible-tiles (C-M.A.T.) when suitably disposed over the three-dimensional-pasasge-and-support-matrix 38 with the horizontal-disassociation-cushioning-layer 39 of elastic foam adhered to the bottom of the horizontal-composite-assemblage-sheet 27 serving to cushion the bottom surface of the composite-modular-accessible-tiles (C-M.A.T.) and cushioning the brittle, randomly-loaded horizontal-individual-tiles 10 as well as to reduce transfer of impact sound generated by foot and rolling traffic on the surface of the composite-modular-accessible-tiles (C-M.A.T.)

THE TWELFTH EMBODIMENT OF THIS INVENTION

Figure 12:
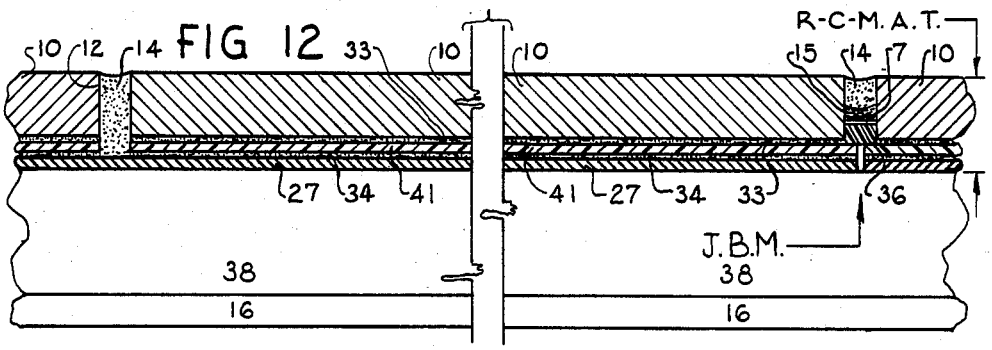
FIG. 12 is an enlarged, transverse, sectional view of the modular-accessible-tiles of this invention having horizontal-individual-tiles adhered to a horizontal-composite-assemblage-sheet by a horizontal-disassociation-cushioning-layer sandwiched between horizontal-individiual-tiles and the horizontal-composite-assemblage-sheet disposed over a three-dimensional-passage-and support-matrix disposed over a horizontal-base-surface as the twelfth embodiment of this invention.

Referred to for dommunicative reasons on drawings and herein as R-C-M.A.T. (resilient-composite-modular-accessible-tile) with a sandwiched horizontal-disassociation-cushioning-layer, with the R-C-M.A.T. disposed over a three-dimensional-passage-and-support-matrix Referring to the drawings, FIG. 12 illustrates a three-dimensional-passage-and-support-matrix 38 disposed over a horizontal-base-surface 16 and also separating the bottom surface of the gravity-held-in-place-load-bearing-horizontal-composite-modular-accessible-tile formed and denoted as a resilient-composite-modular-accessible-tile (R-C-M.A.T) from the top of the horizontal-base-surface 16. The horizontal-composite-assemblage-sheet 27 is sized to a size for a resilient-composite-modular-accessible-tile (R-C-M.A.T.) as a multiple of one or more horizontal-individual-tiles 10 with allowance for a uniform width dynamic-interactive-fluidtight-flexible-joint (DIFFJ) between the horizontal-individual-tiles 10, whereby the horizontal-composite-assemblage-sheet 27, a horizontal-disassociation-cushioning-layer 41, and the horizontal-individual-tiles 10 are disposed over the three-dimensional-passage-and support-matrix 38.

The intermediate horizontal-disassociation-cushioning-layer 41 is sandwiched between the top surface of the horizontal-composite-assemblage-sheet 27 and the bottom surface of the horizontal-individual-tiles 10 to provide cushioning of the bottom surface of the horizontal-individual-tiles 10 from directly contacting the hard top surface of the horizontal-composite-assemblage-sheet 27 and to diminish direct transfer of impact sound from foot and rolling traffic contacting the top surface of gravity-held-in-place-load-bearing-horizontal-composite-modular-accessible tile (R-C-M.A.T.) to the horizontal-composite-assemblage-sheet 27, three-dimensional-passage-and-support-matrix 38, and thus to the horizontal-base-surface 16.

The plurality of horizontal-individual-tiles 10 has a top wearing surface, a bottom surface, three or more sides 12 to each horizontal-individual-tile 10, with the sides 12 being perpendicular to the parallel top and bottom sufaces of the horizontal-individual-tile 10, with approximate uniform joint (DIFFJ) thickness between adjacent horizontal-individual-tiles 10. The horizontal-individual-tiles 10 are sized and assembled with a patterned layout to match the size of the resilient-composite-modular-accessible-tiles (R-C-M.A.T.) so the layout provides a relatively uniform width joint (DIFFJ) between all adjacent horizontal-individual-tiles 10 for receiving a fluid-installed-dynamic-interactive-fluidtight-flexible-joint (DIFFJ).

The plurality of horizontal-individual-tiles 10 is assembled and resiliently adhered by means of the intermediate horizontal-disassociation-cushioning-layer 41 to the horizontal-composite-assemblage-sheet 27 to provide the formation of a resilient homogeneous composite by having the horizontal-disassociation-cushioning-layer 41 sandwiched between a plurality of horizontal-individual-tiles 10 and the horizontal-composite-assemblage-sheet 27 to form a resilient-composite-modular-accessible-tile (R-C-M.A.T.) with a suitably engineered adhesive 33 for adhering the entire bottom surface of the plurality of horizontal-individual-tiles 10 to the entire top surface of the horizontal-disassociation-cushioning-layer 41 and also with a suitably engineered adhesive 34 for adhering the entire bottom surface of the horizontal-disassociation-cushioning-layer 41 to the entire top surface of the horizontal-composite-assemblage-sheet 27 so they both act to prevent the self-leveling-elastomeric-adhesive-sealant 14 from running out between the bottom layers sandwiched between the bottom of the horizontal-individual-tiles 10 and the top surface of the horizontal-composite-assemblage-sheet 27.

The horizontal-disassociation-cushioning-layer 41 and horizontal-composite-assemblage-sheet 27 are utilized to keep the self-leveling-elastomeric-adhesive-sealant 14 from dripping or draining through onto production equipment, with the ensuing expensive breaking down and cleanup of production equipment. The horizontal-composite-assemblage-sheet 27 is utilized as a separator for earlier horizontal stacking of the resilient-composite-modular-accessible-tiles (R-C-M.A.T.) in a plurality of layers than is practical with the omission of the horizontal-composite-assemblage-sheet 27.

The dynamic-interactive-fluidtight-flexible-joints (DIFFJ) between all adjacent perimeter sides 12 of all horizontal-individual-tiles 10 in the resilient-composite-modular-accessible-tiles (R-C-M.A.T.) are formed, preferably, of urethane elastomeric-adhesive-sealant 14, with an adhesion zone 11, as illustrated in FIGS. 17 and 19, whereby all perimeter sides 12 of the horizontal-individual-tiles 10 have the self-leveling-elastomeric-adhesive-sealant 14 enduringly adhered over the entire height and perimeter length of the perimeter sides 12 of the horizontal-individual-tiles 10. A cohesion zone 13, as illustrated in FIGS. 17 and 19, joins together the adjacent adhesion zones 11 of all adjacent perimeter sides 12 of all adjacent horizontal-individual-tiles 10 with self-leveling-elastomeric-adhesive-sealant 14, forming the dynamic-interactive-fluidtight-flexible-joints (DIFFJ) between all adjacent horizontal-individual-tiles 10.

The plurality of horizontal-individual-tiles 10 is assembled and resiliently adhered by means of the intermediate horizontal-disassociation cushioning-layer 41 to the horizontal-composite-assemblage-sheet 27 with suitably engineered adhesive layers, with adhesive layer 33 for adhering the horizontal-individual-tiles 10 to the horizontal-disassociation-cushioning-layer 41 applied over the entire bottom surface of each horizontal-individual-tile 10 and adhesive layer 34 applied between the bottom of the horizontal-disassociation-cushioning-layer 41 and the top of horizontal-composite-assemblage-sheet 27 to form the resilient homogeneous composite of each horizontal-individual-tile 10 and the portion of the horizontal-composite-assemblage-sheet 27 directly below the horizontal-individual-tile 10, whereby the intervening plane of weaknesss and flexibility in the fluidtight-flexible-joint (DIFFJ) area on all perimeter sides 12 of the resilient homogeneous composite forms a flexible-hinge-zone on two or more axes surrouning the horizontal-individual-tile 10, with the horizontal-composite-assemblage-sheet 27 and the elastomeric-adhesive-sealant 14 becoming the relatively weakened-plane flexible-hinge-zone of the resilient-composite-modular-accessible-tiles (R-C-M.A.T.) at all intervening joints, when compared to the much greater rigidity of the resilient homogeneous composite formed of each horizontal-individual-tile 10 resiliently adhered to the horizontal-composite-assemblage-shee 27 by means of the horizontal-disassociation-cushioning-layer 41 and the portion of the horizontal-composite-assemblage-sheet 27.

The dynamic-interactive-fluidtight-flexible-joints (DIFFJ) of the resilient-composite-modular-accessible-tiles (R-C-M.A.T.) with the dynamic-interactive-fluidtight-flexible-joints (DIFFJ) between the horizontal-individual-tiles 10 have a plurality of functions whereby the dynamic-interactive-fluidtight-elastomeric-adhesive-sealant 14 filling all perimeter joints (DIFFJ) around all sides 12 of the horizontal-individual-tiles 10 functions to create accumulated-interactive-assemblage of the horizontal-individual-tiles 10 into accessible, movable and relocatable resilient-composite-modular-accessible-tiles (R-C-M.A.T.) when suitably disposed over the three-dimensional-passage-and-support-matrix 38. The intermediate horizontal-disassociation-cushioning-layer 41 serves to cushion the bottom surface of brittle, randomly-loaded horizontal-individual-tiles 10 having dynamic-interactive-fluidtight-flexible-joints from impact against the hard surface of the horizontal-composite-assemblage-sheet 27 and the surface of the three-dimensional-passage-and-support-matrix 38 supporting the resilient-composite-modular-accessible-tile (R-C-M.A.T.)

THE THIRTEENTH EMBODIMENT OF THIS INVENTION

Referred to for communicative reasons on drawings and therein as R-C-M.A.T.

Figure 13:
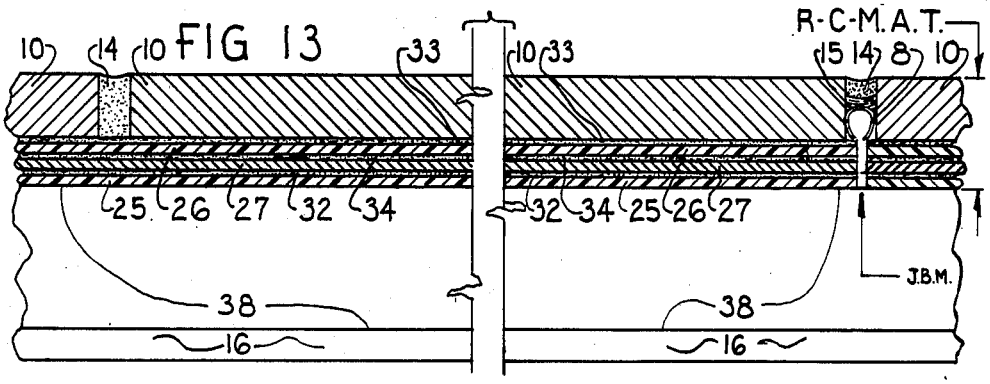
FIG. 13 is an enlarged, transverse, sectional view of the modular-accessible-tiles of this invention having horizontal-individual-tiles adhered to a horizontal-composite-assemblage-sheet by means of a second horizontal-disassociation-cushioning-layer sandwiched between the horizontal-individual-tiles and the horizontal-composite-assemblage-sheet while having a first horizontal-disassociation-cushioning-layer adhered to the bottom of the horizontal-composite-assemblage-sheet, disposed over a three-dimensional-passage-and-support-matrix disposed over a horizontal-base-surface as the thirteenth embodiment of this invention.

(resilient-composite-modular-accessible-tile) with a sandwiched horizontal-disassociation-cushioning-layer and a second horizontal-disassociation-cushioning-layer adhered to the bottom of the R-C-M.A.T., all disposed over a three-dimensional-passage-and-support-matrix Referring to the drawings, FIG. 13 shows a three-dimensional-passage-and-support-matrix 38 separating the bottom surface of a first horizontal-disassociation-cushioning-layer 25 adhered to the bottom of the horizontal-composite-assemblage-sheet 27 from the top of the horizontal-base-surface 16. The first horizontal-disassociation-cushioning-layer 25 is adhered with a suitably engineered adhesive 32 to the bottom surface of the horizontal-composite-assemblage-sheet 27 between at least all bearing portions bearing against the three-dimensional-passage-and-support-matrix 38 to provide cushioning of the bottom surface of the horizontal-composite-assemblage-sheet 27 from coming in direct contact with the top surface of the three-dimensional-passage-and-support-matrix 38 and generating impact sound from making direct contact with each other and to diminish direct transfer of impact sound from foot and rolling traffic coming in contact with the top surface of the gravity-held-in-place-load-bearing-horizontal-composite-modular-accessible-tiles formed as and denoted as resilient-composite-modular-accessible-tiles (R-C-M.A.T.) from the direct transfer of this impact sound to the horizontal-base-surface 16.

The horizontal-composite-assemblage-sheet 27 is sized to a size selected for the resilient-composite-modular-accessible-tiles (R-C-M.A.T.) as a multiple of one or more horizontal-individual-tiles 10 with allowance for uniform width dynamic-interactive-fluidtight-flexible-joints (DIFFJ) between the horizontal-individual-tiles 10, with the horizontal-composite-assemblage-sheet 27, a second horizontal-disassociation-cushioning-layer 26, the horizontal-individual-tiles 10, and at least the contact-bearing portion of the first-horizontal-disassociation-cushioning-layer 25 and the three-dimensional-passage-and-support-matrix 38 disposed over the horizontal-base-surface 16.

A plurality of horizontal-individual-tiles 10 has a top wearing surface, a bottom surface, three or more sides 12 to each horizontal-individual-tile 10, with the sides 12 being perpendicular to the parallel top and bottom surfaces of the horizontal-individual-tile 10, with approximate uniform joint (DIFFJ) thickness between adjacent horizontal-individual-tile 10. The horizontal-individual-tiles 10 are sized and assembled with a patterned layout to match the size of the resilient-composite-modular-accessible-tiles (R-C-M.A.T.) so this layout provides a relatively uniform width joint (DIFFJ) between all adjacent horizontal-individual-tiles 10 for receiving a fluid-installed-dynamic-interactive-fluidtight-flexible-joint (DIFFJ).

The plurality of horizontal-individual-tiles 10 is assembled and resiliently adhered by means of the intermediate second horizontal-disassociation-cushioning-layer 26 to the horizontal-composite-assemblage-sheet 27 to provide the formation of a resilient homogeneous composite by having the second horizontal-disassociation-cushioning-layer 26 sandwiched between a plurality of horizontal-individualt-tiles 10 and the horizontal-composite-assemblage-sheet 27 to form a resilient-composite-modular-accessible-tile (R-C-M.A.T.) with a suitably engineered adhesive 33 for adhering the entire bottom surface of the plurality of horizontal-individual-tiles 10 to the entire top surface of the second horizontal-disassociation-cushioning-layer 26 and also with a suitably engineered adhesive 34 for adhering the entire bottom surface of the second horizontal-disassociation-cushioning-layer 26 to the entire top surface of the horizontal-composite-assemblage-sheet 27 so they both act to prevent the self-leveling-elastomeric-adhesive-sealant 14 from running out between the bottom layers sandwiched between the bottom of the horizontal-individual-tiles 10 and the top surface of the horizontal-composite-assemblage-sheet 27.

The second horizontal-disassociation-cushioning-layer 26 and the horizontal-composite-assemblage-sheet 27 are utilized to keep the self-leveling-elastomeric-adhesive-sealant 14 from dripping or draining through onto production equipment, with the ensuing expensive breaking down and cleanup of production equipment. The first horizontal-disassociation-cushioning-layer 25 25 and the horizontal-composite-assemblage-sheet 27 are utilized as a separator for earlier horizontal stacking of the resilient-composite-modular-accessible-tiles (R-C-M.A.T.) in a plurality of layers than is practical with the omission of the horizontal-composite-assemblage-sheet 27.

The dynamic-interactive-fluidtight-flexible-joints (DIFFJ) between all adjacent perimeter sides 12 of all horizontal-individual-tiles 10 in the resilient-composite-modular-accessible-tiles (R-C-M.A.T.) are formed, preferably, of urethane elastomeric-adhesive-sealant 14, with an adhesion zone 11, as illustrated in FIGS. 17 and 19, whereby all perimeter sides 12 of the horizontal-individual-tiles 10 have the elastomeric-adhesive-sealant 14 enduringly adhered over the entire height and perimeter length of the perimeter sides 12 of the horizontal-individual-tiles 10. A cohesion zone 13, as illustrated in FIGS. 17 and 19, joins together the adjacent adhesion zones 11 of all adjacent perimeter sides 12 of all adjacent horizontal-individual-tiles 10 with self-leveling-elastomeric-adhesive-sealant 14 forming the dynamic-interactive-fluidtight-flexible-joints (DIFFJ) between all adjacent horizontal-individual-tiles 10.

The plurality of horizontal-individual-tiles 10 is assembled and resiliently adhered by means of the intermediate second horizontal-disassociation-cushioning-layer 26 to the horizontal-composite-assemblage-sheet 27 with suitably engineered adhesive layers, with adhesive layer 33 for adhering the horizontal-individual-tiles 10 to the second horizontal-disassociation-cushioning-layer 26 and adhesive layer 34 applied between the bottom of the second horizontal-disassociation-cushioning-layer 26 and the top of the horizontal-composite-assemblage-sheet 27 applied over the entire bottom surface of the horizontal-individual-tiles 10 to form the resilient homogeneous composite of each horizontal-individual-tiles 10 and the portion of the horizontal-composite-assemblage-sheet 27 directly below the horizontal-individual-tile 10, whereby the intervening plane of weakness and flexibility in the fluidlight-flexible-joint (DIFFJ) area on all perimeter sides 12 of the resilient homogeneous composite forms a flexible-hinge-zone on two or more axes surrounding the horizontal-individual-tile 10, with the horizontal-composite-assemblage-sheet 27 and the elastomeric-adhesive-sealant 14 becoming the relatively weakened-plane flexible-hinge-zone of the resilient-composite-modular-accessible-tiles (R-C-M.A.T.) at all intervening joints, when compared to the much greater rigidity of the resilient homogeneous composite formed of each horizontal-individual-tile 10 resiliently adhered to the horizontal-composite-assemblage-sheet 27 by means of the second horizontal-disassociation-cushioning-layer 26 and the portion of the horizontal-composite-assemblage-sheet 27.

The dynamic-interactive-fluidtight-flexible-joints (DIFFJ) of the resilient-composite-modular-accessible-tiles (R-C-M.A.T.) with the dynamic-interactive-fluidtight-flexible-joints (DIFFJ) between the horizontal-individual-tiles 10 have a plurality of functions whereby the dynamic-interactive-fluidtight-elastomeric-adhesive-sealant 14 filling all perimeter joints (DIFFJ) around all sides 12 of the horizontal-individual-tiles 10 functions to create accumulated-interactive-assemblage of the horizontal-individual-tiles 10 into accessible, movable and relocatable resilient-composite-modular-accessible-tiles (R-C-M.A.T.) when suitably disposed over the second horizontal-disassociation-cushioning-layer 26, serving to cushion the bottom surface of brittle, radomly-loaded horizontal-individual-tiles 10 having the dynamic-interactive-fluidtight-flexible-joints (DIFFJ) from impact agains the hard surface of the horizontal-composite-assemblage-sheet 27.

The first horizontal-disassociation-cushioning-layer 25 is adhered by adhesive layer 32 to the horizontal-composite-assemblage-sheet 27 at least at the point of contact bearing between the horizontal-composite-assemblage-sheet 27 and the top of the three-dimensional-passage-and-support-matrix 38 to provide cushioning between the bottom of the horizontal-composite-assemblage-sheet 27 and the top of the three-dimensional-passage-and-support-matrix 38 for improved impact sound isolation through two or more layers of horizontal disassociation cushioning.

THE FOURTEENTH EMBODIMENT OF THIS INVENTION

Figure 14:
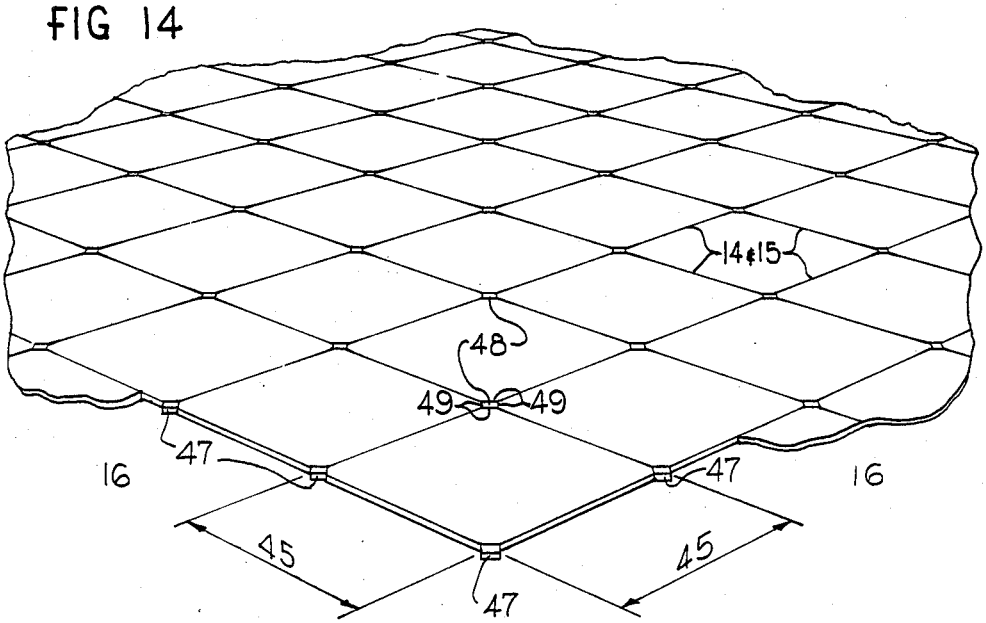
FIG. 14 is a perspective view of an array of modular-accessible-tiles (M.A.T., C-M.A.T., and R-C-M.A.T.) disposed over a horizontal-disassociation-cushioning-layer or disposed over a three-dimensional-passage-and-support-matrix, wherein the modular-accessible-tiles (M.A.T., C-M.A.T., and R-C-M.A.T.) have their adjacent intersecting corners identically diagonally cut to accommodate the positioning of a diagonally positioned array of modularly positioned outlet or junction boxes for recessed outlet or junction boxes between the adjacent intersecting corners of the modular-accessible-tiles with a decorative accessible cover positioned thereover as part of the finished-appearing array of modular-accessible-tiles positioned at the adjacent intersecting corners of the modular-accessible-tiles as a fourteenth embodiment of this invention.

Referring to the drawings, FIG. 14 shows modular-accessible-tiles formed and denoted as modular-accessible-tiles (M.A.T.), composite-modular-accessible-tiles (C-M.A.T.), and resilient-composite-modular-accessible-tiles (R-C-M.A.T.) and assembled to form an array of gravity-held-in-place-load-bearing-horizontal-modular-accessible-tiles (M.A.T., C-M.A.T., and R-C-M.A.T.) adhered one to another with accessible and resealable dynamic-interactive-fluidtight-flexible-joints (DIFFJ) formed with a continuous-protective-strip 1–9 covered and sealed over with gun-grade-elastomeric-adhesive sealant 15 to form bottom fluidtight seal for containing self-leveling-elastomeric-adhesive-sealant 14 for top of joint for joining all perimeter sides 12 of the modular-accessible-tiles (M.A.T., C-M.A.T., and R-C-M.A.T.) one to another, disposed over flat conductor cable 19 or disposed loose laid over a three-dimensional-passage-and-support-matrix 38 and a horizontal-base-surface 16.

Single-increment modular-accessible-tiles (M.A.T., C-M.A.T., and R-C-M.A.T.) 45 have their diagonally-opposite adjacent intersecting corners 49 identically diagonally cut to accommodate the positioning of a diagonally positioned array of modularly positioned recessed rotated outlet-junction-boxes 47 from 2 to 6 feet center-to-center positioned at diagonally opposite corners with positioning of the recessed rotated outlet-junction-boxes 47 between the diagonally-opposite adjacent intersecting corners 49 of the single-increment modular-accessible-tiles (M.A.T., C-M.A.T. or R-C-M.A.T.) 45 positioned approximately 2 to 6 feet on at least one side to coordinate with center-to-center positioning of diagonally positioned array of modularly positioned recessed rotated outlet-junction-boxes' 47 center-to-center positioning.

A decorative access cover 48 is positioned over each recessed rotated outlet-junction-box 47 as part of the finished-appearing array and finished wearing surface of the array of modular-accessible-tiles (M.A.T., C-M.A.T. and R-C-M.A.T.).

The horizontal-base-surface 16 may be a horizontal-disassociation-cushioning-layer 25, rigid-foam-insulation 30, resilient substrate 35, horizontal-suspended-structural-floor-system 50 or cushioning-granular-substrate 40.

THE FIFTEENTH EMBODIMENT OF THIS INVENTION

Figure 15:
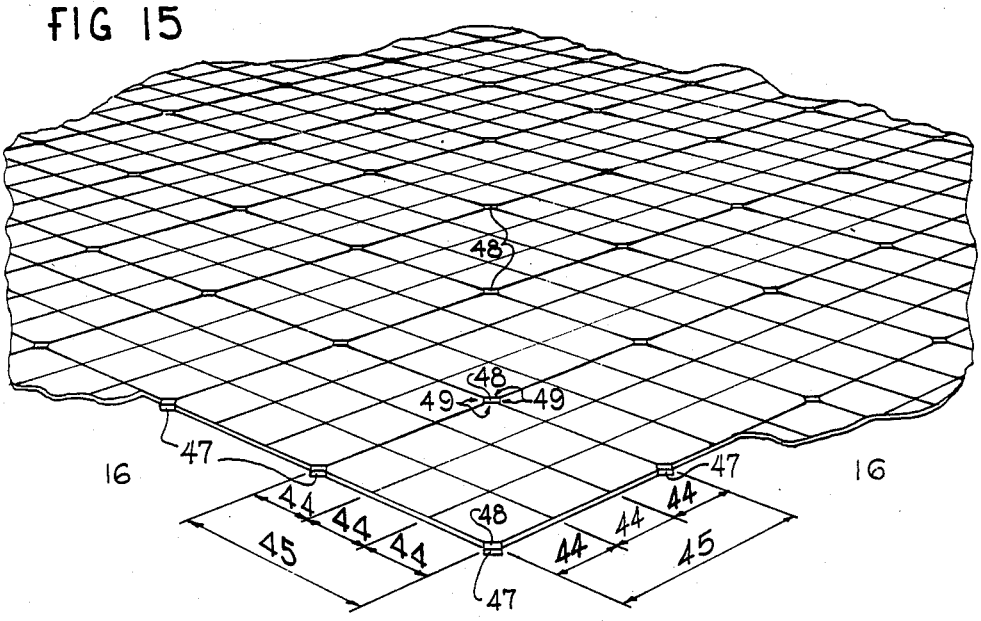
FIG. 15 is a perspective view of an array of modular-accessible-tiles (M.A.T., C-M.A.T., and R-C-M.A.T.) disposed over a horizontal-disassociation-cushioning-layer or disposed over a three-dimensional-passage-and-support-matrix, wherein a plurality of four, 9 or 16 or more modular-accessible-tiles (M.A.T., C-M.A.T., and R-C-M.A.T.) is positioned between the functionally positioned adjacent intersecting corners identically cut to accommodate the positioning of a diagonally positioned arrray of modularly positioned outlet or junction boxes for recessed outlet and junction boxes between the adjacent interesecting corners of the modular-accessible-tiles with a decorative access cover positioned thereover as part of the finished-appearing array of modular-accessible-tiles positioned at the adjacent intersecting corners of the modular-accessible-tiles as a fifteenth embodiment of this invention.
Figure 16:
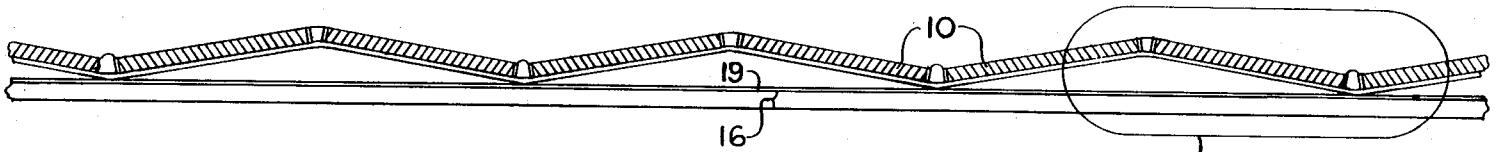
FIG. 16 is an accentuated, explanatory, transverse, sectional view of the tile-covering-array and modular-accessible-tile of this invention illustrative and applicable to FIG. 7, with certain other figures having many applicable similarities.

Referring to the drawings, FIG. 15 shows modular-accessible-tiles formed and denoted as modular-accessible-tiles (M.A.T.), composite-modular-accessible-tiles (C-M.A.T.), and resilient-composite-modular-accessible-tiles (R-C-M.A.T.) and assembled to form an array of gravity-held-in-place-load-bearing-horizontal-modular-accessible-tiles (M.A.T., C-M.A.T., and R-C-M.A.T.) adhered one to another with accessible and resealable dynamic-interactive-fluidtight-flexible-joints (DIFFJ) formed with a continuous-protective-strip 1–9 covered and sealed over with gun-grade-elastomeric-adhesive sealant 15 to form bottom fluidtight seal for containing self-leveling-elastomeric-adhesive-sealant 14 for top of joint for joining all perimeter sides 12 of the modular-accessible-tiles (M.A.T., C-M.A.T., and R-C-M.A.T.) one to another, disposed over flat conductor cable 19 or disposed loose laid over a three-dimensional-passage-and-support-matrix 38 and a horizontal-base-surface 16.

A plurality of four, 9, 16 or more smaller increments of modular-accessible-tiles (M.A.T., C-M.A.T., and R-C-M.A.T.) 44 have their adjacent intersecting corners 49 as shown in perspective FIG. 15 identically diagonally cut to accommodate the positioning of a diagonally positioned array of modularly positioned rotated outlet-junction-boxes 47 from 2 to 6 feet center-to-center positioned at diagonally opposite corners with positioning of the recessed rotated outlet-junction boxes 47 between the diagonally-opposite adjacent intersecting corners 49 of the modular-accessible-tiles (M.A.T., C-M.A.T. or R-C-M.A.T.) positioned approximately 2 tp 6 feet on at least one side to coordinate with center-to-center positioning of diagonally positioned array of modularly positioned recessed rotated outlet-junction-boxes 47 center-to-center positioning as shown in perspective FIG. 15 wherein a plurality of four, 9, 16 or more smaller increments of modular-accessible-tiles 44 are employed to match the center-to-center spacing at which diagonally positioned array of modular positioned recessed rotated outlet-junction-boxes 47 are spaced at from 2 to 6 feet center to center.

A decorative access cover 48 is positioned over each recessed rotated outlet-junction-box 47 as part of the finished-appearing array and finished wearing surface of the array of modular-accessible-tiles (M.A.T., C-M.A.T. and R-C-M.A.T.).

The horizontal-base-surface 16 may be a horizontal-disassociation-cushioning-layer 25, rigid-foam-insulation 30, resilient substrate 35, horizontal-suspended-structural-floor-system 50 or cushioning-granular-substrate 40.

THE SIXTEENTH EMBODIMENT OF THIS INVENTION

In reference to the drawings, this refers to FIGS. 6, 7, 8 and 9 in particular and also refers in general to FIGS. 2, 5, 14, 15 and 20, wherein modular-tiles formed and denoted as

| | |
|---|---|
| modular-accessible-tiles | M.A.T. |
| composite-modular-accessible-tiles | C-M.A.T. |
| resilient-composite-modular-accessible-tiles | R-C-M.A.T., |

are assembled one to another at all perimeter sides of the modular-accessible-tiles (M.A.T., C-M.A.T., R-C-M.A.T.) with accessible and resealable dynamic-interactive-fluidtight-flexible-joints (DIFFJ), with array of modular-accessible-tiles (M.A.T., C-M.A.T., R-C-M.A.T.) floating loose laid over flat conductor cable 19 over at least one horizontal-disassociation-cushioning-layer 25 over the horizontal-base-surface 16 where the horizontal-disassociation-cushioning-layer 25 importantly accommodates the thickness variation in the flat conductor cable 19.

Making the composite-modular-accessible-tile (C-M.A.T.) of a modularly sized metallic horizontal-composite-assemblage-sheet 27 and used in conjunction with metallic continuous-protective-strips 1–9 at the joints between adjacent modular-accessible-tiles (C-M.A.T.) provides protective metallic covering to protect the flat conductor cable system 19 from physical injury, provides a non-combustible containment covering over the flat conductor cable 19 and the horizontal-disassociation-cushioning-layer 25, provides continuous metallic grounding to avoid possible hazards from current carried in the flat conductor power cable 19, provides capability for metallic horizontal-composite-assemblage-sheet 27 to ground off stray static electric charges which are so often disruptive in highly automated computer office networks. The use of a metallic horizontal-composite-assemblage-sheet 27 also provides independent isolated floating metallic horizontal-composite-assemblage-sheet 27 for physically anchoring outlet-junction-boxes 47 thereto and, where desired, for grounding networks. The use of a metallic horizontal-composite-assemblage-sheet 27 also provides for grounding the flat conductor cable terminals 19 without bridging the horizontal-disassociation-cushioning-layer's 25 impact sound isolaltion improvements.

The accessible and resealable dynamic-interactive-fluidtight-flexible joints (DIFFJ) between all perimeter sides of all modular-accessible-tiles (M.A.T., C-M.A.T., R-C-M.A.T.0 assembles the modular-accessible-tiles (M.A.T., C-M.A.T., R-C-M.A.T.) by accumulated-interactive-assemblage, wherein the modular-accessible-tiles (M.A.T., C-M.A.T., and R-C-M.A.T.) are held in place by gravity, including the gravity of the modular-accessible-tiles (M.A.T., C-M.A.T., R-C-M.A.T.) and the dynamic-interactive-fluidtight-flexible-joints as well as by the gravity of the atmosphere above the modular-accessible-tiles (M.A.T., C-M.A.T., R-C-M.A.T.) without mechanical fastening or adherence to the horizontal-base-surface 16.

The array of load-bearing-modular-accessible-tiles (M.A.T., C-M.A.T., R-C-M.A.T.) are also held in place by friction between the top of the horizontal-base-surface 16 and the bottom of the modular-accessible-tiles (M.A.T., C-M.A.T., R-C-M.A.T.). The assembled array is held in place by the scale of the accumulated-interactive-assemblage of the array of load-bearing-horizontal-modular-accessible-tiles (M.A.T., C-M.A.T., R-C-M.A.T.) over the flat conductor cable 19 by a combination of gravity, friction, and accumulated-interactive-assemblage as a result of room-temperature-cured-elastomeric-adhesive-sealant 14 surrounding all modular-accessible-tiles (M.A.T., C-M.A.T., R-C-M.A.T.).

The accessible and resealable dynamic-interactive-fluidtight-flexible-joints (DIFFJ) between all adjacent perimeter sides 12 of the gravity-held-in-place-load-bearing-horizontal-modular-accessible-tiles (M.A.T., C-M.A.T., R-C-M.A.T.) are formed with elastomeric-adhesive-sealant 14 with an adhesion zone 11, as illustrated in FIGS. 17 and 19, whereby all perimeter sides 12 of the modular-accessible-tiles (M.A.T., C-M.A.T., R-C-M.A.T.) have elastomeric-adhesive-sealant 14 enduringly adhered over the entire height and perimeter length of all perimeter sides 12 between modular-accessible-tiles (M.A.T., C-M.A.T., R-C-M.A.T.). A cohesion zone 13, as illustrated in FIGS. 17 and 19, joins together the adjacent adhesion zones 11 of all adjacent perimeter sides 12 of all modular-accessible-tiles (M.A.T., C-M.A.T., R-C-M.A.T.) with elastomeric-adhesive-sealant 14 forming the array of load-bearing-horizontal-modular-accessible-tiles (M.A.T., C-M.A.T., R-C-M.A.T.).

Accessible and resealable dynamic-interactive-fluid-tight-flexible-joints (DIFFJ) between the gravity-held-in-place-load-bearing-horizontal modular-accessible-tiles (M.A.T., C-M.A.T., R-C-M.A.T.) in the array consist of two application layers, a first layer of gun-grade-elastomeric-adhesive-sealant 15 applied over the aforementioned metallic continuous-protective-strips 1–9 wherein the gun-grade-elastomeric-adhesive-sealant 15 is to seal the bottom perimeter side 12 of the gravity-held-in-place-load-bearing-horizontal-modular-accessible-tiles (M.A.T., C-M.A.T., R-C-M.A.T.) fluid-tight to one another for containing after the initial setting cure a second layer of self-leveling-elastomeric-adhesive-sealant 14 in the flexible joints (DIFFJ) and also to hold the modular-accessible-tiles (M.A.T., C-M.A.T., R-C-M.A.T.) in final position against movement when applying the self-leveling-elastomeric-adhesive-sealant 14 for form the joints (DIFFJ). A second layer of self-leveling-elastomeric-adhesive-sealant 14 is applied over the first layer of gun-grade-elastomeric-adhesive-sealant 15 to form the accessible and resealable dynamic-interactive-fluidtight-flexible-joints (DIFFJ) for the full width and depth of the fluidtight-flexible-joints (DIFFJ).

At the perimeter sides of occupied spaces, the accessible and resealable dynamic-interactive-fluidtight-flexible-joints (DIFFJ) between the gravity-held-in-place-load-bearing-horizontal-modular-accessible-tiles in the array have a dam of gun-grade-elastomeric-adhesive-sealant 15 inserted for the full depth of the joint to prevent the self-leveling-elastomeric-adhesive-sealant 14 from running out of the uncure flexible joints.

The accessible, movable, and relocatable modular-accessible-tiles (M.A.T., C-M.A.T., R-C-M.A.T.) are joined one to another with accessible and resealable dynamic-interactive-fluidtight-flexible-joints (DIFFJ) formed of room-temperature-curing-interactive-fluid-tight-elastomeric-adhesive-sealant 14 on all perimeter sides 12 of modular-accessible-tiles (M.A.T., C-M.A.T., R-C-M.A.T.), providing the capability for joints to be cut between all modular-accessible-tiles (M.A.T., C-M.A.T., R-C-M.A.T.), with cutting by any suitable cutting means with vertical or sloping cuts at any future time to provide accessibility, movability, and relocatability of the modular-accessible-tiles (M.A.T., C-M.A.T., R-C-M.A.T.) for accessibility to the horizontal-base-surface 16 for inspection, renovation, and repairs; for accessibility to power flat conductor cable 19, lighting flat conductor cable 19, electronic flat conductor cable 19, and communications flat conductor cable 19 disposed below the modular-accessible-tiles (M.A.T., C-M.A.T., R-C-M.A.T.); and for accessibility to clean-outs, junction boxes, pull boxes, wiring, regulators, valves, conduits, piping, equipment, and other utilities for inspection, renovation, and repairs.

The cuttable and reassembleable elastomeric-adhesive-sealant 14 provides the ability to move and relocate any sized units of the array of modular-accessible-tiles (M.A.T. C-M.A.T., R-C-M.A.T.), the ability to salvage the array of modular-accessible-tiles (M.A.T., C-M.A.T., R-C-M.A.T.) into physically and economically manageable-sized units for any desired user in new and renovated environmental use for the purpose of conserving finite resources and for economic benefit. The linear expansion and contraction induced by temperature and moisture is linear absorbed and contained within perimeter elastomeric-adhesive-sealant-joints (DIFFJ) surrounding the modular-accessible-tiles (M.A.T., C-M.A.T., R-C-M.A.T.) without generally transferring the linear expansion and contraction horizontally beyond the confines of the given modular-accessible-tile (M.A.T., C-M.A.T., R-C-M.A.T.).

The accessible and resealable dynamic-interactive-fluidtight-flexible-joints (DIFFJ) between perimeter of the array of modular-accessible-tiles (M.A.T., C-M.A.T., R-C-M.A.T.) and the adjacent wall and abutting adjacent perimeter surfaces provide seal at perimeter edge to exclude dust and dirt as well as to facilitate cleaning; improved impact sound isolation from adjacent wall and abutting surface; improved sound transmission reduction between intervening vertical and horizontal occupied spaces; provide containment of thin air films between layers of combination for cushioning and insulating benefits; containment of atmospheric air pressure above array of modular-accessible-tiles (M.A.T., C-M.A.T., R-C-M.A.T.); containment of split fluids on wearing surface from flowing downwards to intervening layers of lat conductor cable 19 and to the horizontal-base-surface 16.

THE SEVENTEENTH EMBODIMENT OF THIS INVENTION

In reference to the drawings, this refers to FIGS. 10, 11, 12 and 13 in particular and also refers in general to FIGS. 2, 5, 14, and 15, wherein modular-accessible-tiles formed and denoted as

| | |
|---|---|
| modular-accessible-tiles | M.A.T. |
| composite-modular-accessible-tiles | C-M.A.T. |
| resilient-composite-modular-accessible-tiles | R-C-M.A.T., |

are assembled one to another at all perimeter sides of the modular-accessible-tiles (M.A.T., C-M.A.T., R-C-M.A.T.) with cuttable, accessible and resealable dynamic-interactive-fluidtight-flexible-joints (DIFFJ) joining together all perimeter adjacent sides 12 of the modular-accessible-tiles (M.A.T., C-M.A.T., R-C-M.A.T.) one to another, loose laid over one or more horizontal-disassociation-cushioning-layers 25 sandwiched above or below a three-dimensional-passage-and-support-matrix 38 formed to accept and accommodate varying combinations of any, none, or all of the following functional plurality of synergistic benefits for accommodating electrical and electronic plurality of single and multiple insulated conduits; plastic and metallic conduits and raceways; plastic and metallic supply and return piping carrying fluids, including but not limited to hot fluids, chilled fluids, absorption fluids, and fire protection fluids by the fluid-containment system; passage of gases through the inherent resulting matrix; outlet-junction-boxes 47.

The three-dimensional-passage-and-support-matrix 38 is a modular grid network of a plurality of individual support plinths serving to form coordinating indeces for the orderly separation and passage of a plurality of the accepted and accommodated conductors, conduits, and piping while the plurality of assembled support plinths importantly provides the plurality of independent supports for supporting the array of gravity-held-in-place-load-bearing-horizontal-modular-accessible-tiles (M.A.T., C-M.A.T., R-C-M.A.T.) with a plurality of required cuttable, accessible, and resealable dynamic-interactive-fluidtight-flexible-joints (DIFFJ) surrounding all adjacent perimeter sides 12 to assemble the array of modular-accessible-tiles (M.A.T., C-M.A.T., R-C-M.A.T.) by gravity, friction, and accumulated-interactive-assemblage;

Providing at least one horizontal-disassociation-cushioning-layer 25 of elastic foam above or below the three-dimensional-passage-and-support-matrix 38 diminishes direct transfer of impact sound from foot and rolling traffic coming in contact with the top surface of the gravity-held-in-place-load-bearing-horizontal-modular-accessible-tiles (M.A.T., C-M.A.T., R-C-M.A.T.) from direct transfer of impact sound to a horizontal-base-surface.

Making the composite-modular-accessible-tile (C-M.A.T.) of a modularly sized metallic horizontal-composite-assemblage-sheet 27 and used in conjunction with metallic continuous-protective-strips 1–9 at the joints between adjacent modular-accessible-tiles (C-M.A.T.) provides protective metallic covering to protect the flat conductor cable system 19, round conductor and ribbon conductor cable systems from physicial injury, provides a non-combustible containment covering over the flat conductor cable 19, round conductor and ribbon conductor cable systems and the horizontal-disassociation-cushioning-layer 25, provides continuous metallic grounding to avoid possible hazards from current carried in the flat conductor power cable 19, round conductors and ribbon conductor cable system, provides capability for metallic horizontal-composite-assemblage-sheet 27 to ground off stray static electric charges which are so often disruptive in highly automated computer office networks. The use of a metallic horizontal-composite-assemblage-sheet 27 also provides independent isolated floating metallic horizontal-composite-assemblage-sheet 27 for physically anchoring outlet-juntion-boxes 47 thereto and, where desired, for grounding networks. The use of a metallic horizontal-composite-assemblage-sheet 27 also provides for grounding the flat conductor cable terminals 19 without bridging the horizontal-disassociation-cushioning-layer's 25 impact sound isolation improvements.

The accessible and resealable dynamic-interactive-fluidtight-flexible-joints (DIFFJ) between all perimeter sides 12 of all modular-accessible-tiles (M.A.T., C-M.A.T., R-C-M.A.T.) assembles the modular-accessible-tiles (M.A.T., C-M.A.T., R-C-M.A.T.) by accumulated-interactive-assemblage, wherein the modular-accessible-tiles (M.A.T., C-M.A.T., and R-C-M.A.T.) are held in place by gravity, including the gravity of the modular-accessible-tiles (M.A.T., C-M.A.T., R-C-M.A.T.) and the dynamic-interactive-fluidtight-flexible-joints as well as by the gravity of the atmosphere above the modular-accessible-tiles (M.A.T., C-M.A.T., R-C-M.A.T.) without mechanical fastening or adherence to the three-dimensional-passage-and-support-matrix 38 or the horizontal-base-surface 16.

The array of load-bearing-modular-accessible-tiles (M.A.T., C-M.A.T., R-C.-M.A.T.) are also held in place by friction between the top of the horizontal-base-surface 16 and the bottom of the modular-accessible-tiles (M.A.T., C-M.A.T., R-C-M.A.T.). The assembled array is held in place by the scale of the accumulated-interactive-assemblage of the array of load-bearing-horizontal-modular-accessible-tiles (M.A.T., C-M.A.T., R-C-M.A.T.) over the three-dimensional-passage-and-support-matrix 38 by a combination of gravity, friction, and accumulated-interactive-assemblage as a result of room-temperature-cured-elastomeric-adhesive-sealant 14 surrounding all modular-accessible-tiles (M.A.T., C-M.A.T., R-C-M.A.T.).

The accessible and resealable dynamic-interactive-fluidtight-flexible-joints (DIFFJ) between all adjacent perimeter sides 12 of the gravity-held-in-place-load-bearing-horizontal-modular-accessible-tiles (M.A.T., C-M.A.T., R-C-M.A.T.) are formed with elastomeric-adhesive-sealant 14 with and adhesion zone 11, as illustrated in FIGS. 17 and 19, whereby all perimeter sides 12 of the modular-accessible-tiles (M.A.T., C-M.A.T., R-C-M.A.T.) have elastomeric-adhesive-sealant 14 enduringly adhered over the entire height and perimeter length of all perimeter sides 12 between modular-accessible-tiles (M.A.T., C-M.A.T., R-C-M.A.T.). A cohesion zone 13, as illustrated in FIGS. 17 and 19, joins together the adjacent adhesion zones 11 of all adjacent perimeter sides 12 of all modular-accessible-tiles (M.A.T., C-M.A.T., R-C-M.A.T.) with elastomeric-adhesive-sealant 14 forming the array of load-bearing-horizontal-modular-accessible-tiles (M.A.T., C-M.A.T., R-C-M.A.T.).

Accessible and resealable dynamic-interactive-fluidtight-flexible-joints (DIFFJ) between the gravity-held-in-place-load-bearing-horizontal modular-accessible-tiles (M.A.T., C-M.A.T., R-C-M.A.T.) in the array consist of two application layers, a first layer of gun-grade-elastomeric-adhesive-sealant 15 applied over the aformentioned metallic continuous-protective-strips 1–9 wherein the gun-grade-elastomeric-adhesive-sealant 15 is to seal the bottom perimeter side 12 of the gravity-held-in-place-load-bearing-horizontal-modular-accessible-tiles (M.A.T., C-M.A.T., R-C-M.A.T.) fluidtight to one another for containing after the initial setting cure a second layer of self-leveling-elastomeric-adhesive-sealant 14 in the flexible joints (DIFFJ) and also to hold the modular-accessible-tiels (M.A.T., C-M.A.T., R-C-M.A.T.) in final position against movement when applying the self-leveling-elastomeric-adhesive-sealant 14 to form the joints (DIFFJ). A second layer of self-leveling-elastomeric-adhesive-sealant 14 is applied over the first layer of gun-grade-elastomeric-adhesive-sealant 15 to form the accessible and resealable dynamic-interactive-fluidtight-flexible-joints (DIFFJ) for the full width and depth of the fluidtight-flexible-joints (DIFFJ).

At the perimeter sides of occupied spaces, the accessible and resealable dynamic-interactive-fluidtight-flexible-joints (DIFFJ) between the gravity-held-in-place-load-bearing-horizontal-modular-accessible-tiles in the array have a dam of gun-grade-elastomeric-adhesive-sealant 15 inserted for the full depth of the joint to prevent the self-leveling-elastomeric-adhesive-sealant 14 from running out of the uncured flexible joints.

The accessible, movable, and relocatable modular-accessible-tiles (M.A.T., C-M.A.T., R-C-M.A.T.) are joined one to another with accessible and resealable dynamic-interactive-fluidtight-flexible-joints (DIFFJ) formed of room-temperature-curing-interactive-fluid-tight-elastomeric-adhesive-sealant 14 on all perimeter sides 12 of modular-accessible-tiles (M.A.T., C-M.A.T., R-C-M.A.T.), providing the capability for joints to be cut between all modular-accessible-tiles (M.A.T., C-M.A.T., R-C-M.A.T.), with cutting by any suitable cutting means with vertical or sloping cuts at any future time to provide accessibility, movability, and relocatability of the modular-accessible-tiles (M.A.T., C-M.A.T., R-C-M.A.T.) and through the three-dimensional-passage-and-support-matrix 38 for accessibility to the horizontal-base-surface 16 for inspection, renovation, and repairs, for accessibility to electrical and electronic conductors within wireway space formed by the three-dimensional-passage-and-support-matrix 38; and for accessibility to cleanouts, junciton boxes, pull boxes, wiring, regulators, valves, conduits, piping, equipment, and other utilities for inspection, renovation, and repairs.

The cuttable and reassembleable and resealable elastomeric-adhesive-sealant 14 provides the ability to move and relocate any sized units of the array of modular-accessible-tiles (M.A.T., C-M.A.T., R-C-M.A.T.) and the ability to salvage the array of modular-accessible-tiles (M.A.T., C-M.A.T., R-C-M.A.T.) into physically and economically manageable-sized units for any desired user use in new and renovated environmental use for the purpose of conserving finite resources and for economic benefit.

The linear expansion and contraction induced by temperature and moisture is linear absorbed and contained within perimeter elastomeric-adhesive-sealant-joints (DIFFJ) surrounding the ;modular-accessible-tiles (M.A.T., C-M.A.T., R-C-M.A.T.) without generally transferring the linear expansion and contraction horizontally beyond the confines of the given modular-accessible-tile (M.A.T., C-M.A.T., R-C-M.A.T.).

The accessible and resealable dynamic-interactive-fluidtight-flexible-joints (DIFFJ) between perimeter of the array of modular-accessible-tiles (M.A.T., C-M.A.T., R-C-M.A.T.) and the adjacent wall and abutting adjacent perimeter surfaces provide seal at perimeter edge to exclude dust and dirt as well as to facilitate cleaning; improved impact sound isolation from adjacent wall and abutting surface; improved sound transmission reduciton between intervening vertical and horizontal occupied spaces; provide containment of air within the three-dimensional-passage-and-support-matrix 38; provide containment of atmospheric air pressure above array of modular-accessible-tiles (M.A.T., C-M.A.T., R-C-M.A.T.); containment of split fluids on wearing surface from flowing downwards to intervening layers of flat conductor cable 19 and to the horizontal-base-surface 16.

THE EIGHTEENTH EMBODIMENT OF THIS INVENTION

Figure 20:
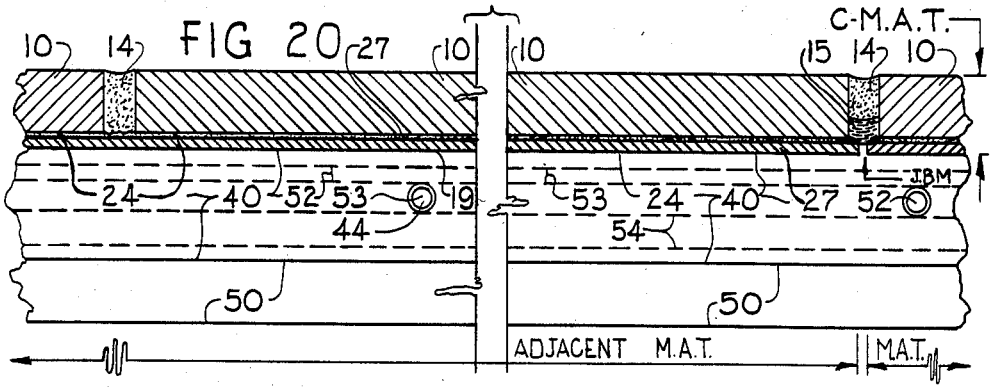
FIG. 20 is an enlarged, transverse, sectional view of the tile covering or modular-accessible-tile (M.A.T., C-M.A.T., and R-C-M.A.T.) of this invention, shown disposed over any type of cushioning-granular-substrate, located within an enclosed interior environmental occupied space, wherein the cushioning-granular-substrate may or may not contain conduits, raceways, and piping, with all disposed over a horizontal suspended structural floor system as an eighteenth embodiment of this invention.

Referring to the drawings, FIG. 20 shows any type of array of horizontal-individual-tiles 10 or modular-accessible-tiles (M.A.T., C-M.A.T. or R-C-M.A.T.) loose laid by gravity, friction, and accumulated-interactive-assemblage by means of flexible joints (DIFFJ) of elastomeric-adhesive-sealant 14 disposed over a cushioning-granular-substrate 40 within interior environmental occupied spaces wherein the cushioning-granular-substrate 40 is thus disposed over a horizontal-suspended structural floor system 50.

The cushioning-granular-substrate 40 may be any type of suitable granular material, such as, sand, fine sand, sandy loam, fine sandy loam, loam, silt loam, light clay loam, clay loam, heaving clay loam, clay, compost, perlite, vermiculite, fine gravel, fine pea gravel, pea gravel, haydite, cinders, and any simily type granular materials where the cushioning-granular-substrate 40 functions to cushion and support the bottom of arrays of horizontal-individual-tiles 10 and of arrays of modular-accessible-tiles (M.A.T., C-M.A.T., and R-C-M.A.T.).

The arrays of horizontal-individual-tiles or arrays of modular-accessible-tiles are beneficially cuttable, accessible and reassembleable by means of dynamic-interactive-fluidtight-flexible-joints (DIFFJ), providing important top accessiblity to a cushioning-granular-substrate 40. The cushioning-granular-substrate 40 provides a leveling course and fill course for accepting and accommodating conduits and piping while also providing support for the tile arrays.

The cushioning-granular-substrate 40 also functions synergistically as a distribution passage matrix for any one, part, or all of the following networks:

- One or more flat conductor cable 19 or round or ribbon insulated electrical and electronic conductors 44
- Metal and plastic conduits 53 carrying electrical and electronic conductors
- Metal, plastic and fiber insulation piping for distribution of gases
- Metal and plastic piping 54 for distribution of fluids, chilled fluid return and supply, hot fluid return and supply, and the like
- Metal or plastic pipe coil with working fluid 52 of any functionally desired layout, disposed within a cushioning-granular-substrate 40 reasonably close to the tile array for passage of working fluid through pipe coil 52 to:
  - Transfer heat from the pipe coil with working fluid 52 to the encapsulating cuhsioning-granular-substrate 40 and then transfer of the heat to the tile array which is supported by the cushioning-granular-substrate 40 supporting:
    - An array of horizontal-individual-tiles 10, or
    - An array of modular-accessible-tiles (M.A.T., C-M.A.T., or R-C-M.A.T., as the case may be)
  - so the supported tile array is a beneficial low $\Delta t$ radiative surface for radiative heating interior occupied spaces over large surface areas, using low $\Delta t$ heat which is more plentifully available and less costly at higher efficiencies when usable at a low differential $\Delta t$, as permitted by the teachings of this invention, from sources such as lights, waste heat, solar sources, and the like, and wherein radiative floor heating gives a high degree of comfort at lower temperatures and higher humidities desired for ideal comfort relationships at lowest cost-to-benefit
  - Transfer heat by absorbing heat from
    - The array of horizontal-individual-tiles 10, or
    - The array of modular-accessible-tiles (M.A.T., C-M.A.T., or R-C-M.A.T., as the case may be)
  - to the supporting cushioning-granular-substrate 40 encapsulating the pipe coil with working fluid 52 with a cooler working fluid to beneficially absorb heat so that the tile array is an absorptive surface of low Δt heat
from electrical and electronic equipment sitting on tile array and conducting excess waste heat from electrical and electronic equipment
from heat-operating produciton equipment sitting on tile array and conducting excess waste heat to tile array
from excess ambient air heat from metabolic source and from heat-operating production equipment
from diffuse and heat beam solar radiation transmission through vertical sloping and horizontal transmissive surfaces by greenhouse phenomenum
from internal radiative vertical wall, ceiling, and furnishings sources and also from metaolic sources radiating excess heat to absorptive tile array surfaces
wherein radiative cooling provides benefical low Δt heat for storage or transfer from internal areas for heating external envelope by using low Δt heat or for pre-heating domestic hot water, and the like.
Passage of gases through voids within cushioning-granular-substrate 40
The cushioning-granular-substrate 40 is utilized to
Level uneven floors or badly deflected floors
Add thermal mass for passive heating
Add thermal mass to absorb fire load
Improve impact sound isolation

THE NINETEENTH EMBODIMENT OF THIS INVENTION

Figure 21:
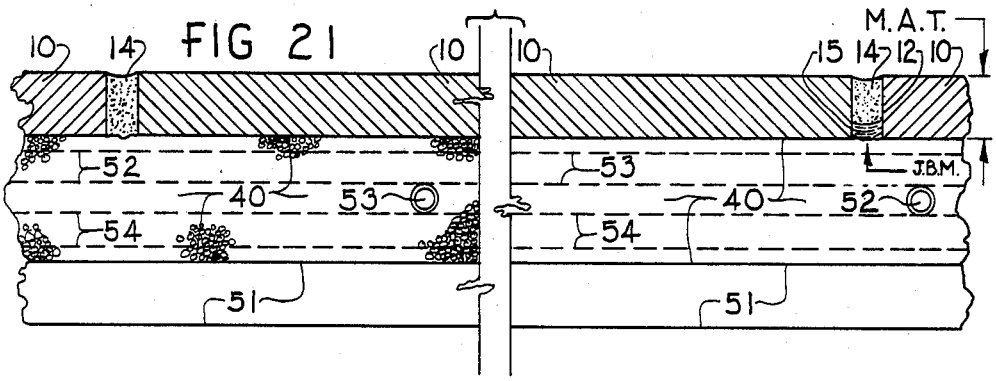
FIG. 21 is an enlarged, transverse, sectional view of the tile covering or modular-accessible-tile (M.A.T., C-M.A.T., and R-C-M.A.T.) of this invention, shown disposed over any type of cushioning-granular-substrate, located within an enclosed interior environmental occupied space, wherein the cushioning-granular-substrate may or may not contain conduits, raceways, and piping, with all disposed over any type of horizontal-base-surface of granular subgrade soil or granular subgrade subsoil or granular substrate at grade or below grade as a nineteenth embodiment of this invention.

Referring to the drawings, FIG. 21 shows any type of array of horizontal-individual-tiles 10 or modular-accessible-tiles (M.A.T., C-M.A.T., or R-C-M.A.T.) loose laid by gravity, friction, and accumulated-interactive-assemblage by means of flexible joints (DIFFJ) of elastomeric-adhesive-sealant 14, disposed over a cushioning-granular-substrate 40 within interior environmental occupied spaces wherein the cushioning-granular-substrate 40 is thus disposed over any type of horizontal-base-surface 51 of granular subgrade soil 51 or granular subgrade subsoil 51 or granular substrate 51 at grade or below grade.

The cushioning-granular-substrate 40 may be any type of suitable granular materials, such as, sand, fine sand, sandy loam, fine sandy loam, loam, silt loam, light clay loam, clay loam, heavy clay loam, clay, compost, perlite, vermiculite, fine gravel, fine pea gravel, pea gravel, haydite, cinders, and any similar type of granular materials where the cushioning-granular-substrate 40 functions to cushion and support the bottom of arrays of horizontal-individual-tiles 10 or arrays of modular-accessible-tiles (M.A.T., C-M.A.T., or R-C-M.A.T.).

The arrays of horizontal-individual-tiles 10 or arrays of modular-accessible-tiles (M.A.T., C-M.A.T., R-C-M.A.T.) are beneficially cuttable, accessible and reassembleable by means of dynamic-interactive-fluidtight-flexible-joints (DIFFJ), providing important top accessibility to a cushioning-granular-substrate 40. The cushioning-granular-substrate 40 provides a leveling course and fill course for accepting and accommodating conduits and piping while also providing support for the tile arrays.

The cushioning-granular-substrate 40 functions also synergistically as a distribution passage matrix for any one, part, or all of the following networks:
Metal and plastic conduits carrying electrical and electronic conductors 53
Metal and plastic piping 54 for distributing gases, fluids, chilled fluid return and supply, hot fluid return and supply, and the like
Metal or plastic pipe coil with working fluid 52 of any functionally desired layout, disposed within a cushioning-granular-substrate 40 reasonably close to the tile array for passage or working fluid through pipe coil 52 to:
Transfer heat from the pipe coil with working fluid 52 to the encapsulating cushioning-granular-substrate 40 and then transfer of the heat to the tile aray which is supported by the cushioning-granular-substrate 40 supporting:
An array of horizontal-individual-tiles 10, or
An array of modular-accessible-tiles (M.A.T., C-M.A.T., or R-C-M.A.T., as the case may be)
so the supported tile array is a beneficial low Δt radiative surface for radiative heating interior occupied spaces over large surface areas, using low Δt heat which is more plentifully available and less costly at higher efficiencies when usable at a low differential Δt, as permitted by the teachings of this invention, from sources such as lights, waste heat, solar sources, and the like, and wherein radiative floor heating gives a high degree of comfort at lower temperatures and higher humidities desired for ideal comfort relationships at lowest cost-to-benefit
Transfer heat by absorbing heat from
The array of horizontal-individual-tiles 10, or
The array of modular-accessible-tiles (M.A.T., C-M.A.T., or R-C-M.A.T., as the case may be)
to the supporting cushioning-granular-substrate 40 encapsulating the pipe coil with working fluid 52 with a cooler working fluid to beneficially absorb heat so that the tile array is an absorptive surface of low Δt heat
from electrical and electronic equipment sitting on tile array and conducting excess waste heat from electrical and electronic equipment
from heat-operating production equipment sitting on tile array and conducting excess waste heat to tile array
from excess ambient air heat from metabolic source and from heat-operating production equipment
from diffuse and heat beam solar radiation transmission through vertical sloping and horizontal transmissive surfaces by greenhouse phenomenum
from internal radiative vertical wall, ceiling, and furnishing sources and also from metabolic sources radiating excess heat to absorptive tile array surfaces
wherein radiative cooling provides beneficial low Δt heat for storage or transfer from internal areas for heating external envelope by using low Δt heat or for pre-heating domestic hot water, and the like
Passage of gases through voids within cushioning-granular-substrate 40
The cushioning-granular-substrate 40 is utilized to
Add thermal mass for passive heating Add thermal mass to absorb fire load Open drainage piping for fluids for infiltration and exfiltration of fluids Beneficial drainage below tile array where drain tiles are functionally required and installed.

THE TWENTIETH EMBODIMENT OF THIS INVENTION

Figure 22:
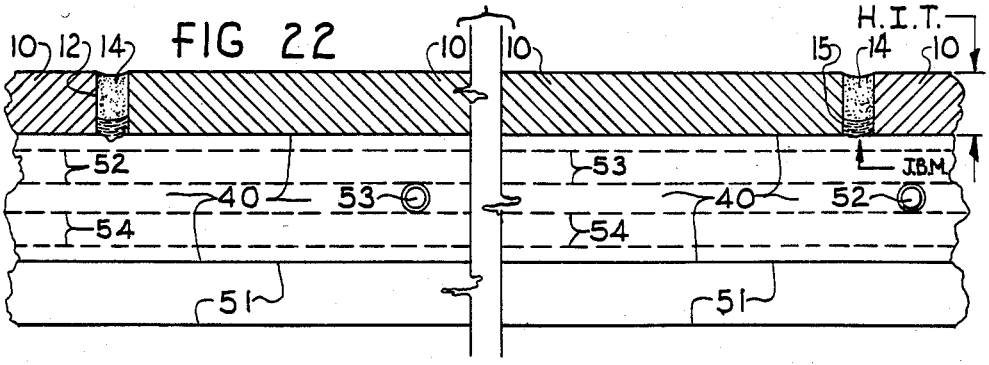
FIG. 22 is an enlarged, transverse, sectional view of the tile covering or modular-accessible-tile (M.A.T., C-M.A.T., and R-C-M.A.T.) of this invention, shown disposed over any type of cushioning-granular-substrate, located within exterior environments, wherein the cushioning-granular-substrate may or may not contain conduits and piping, disposed over any type of exterior horizontal-base-surface of granular subgrade soil or granular subgrade subsoil or granular substrate at grade or below grade as a twentieth embodiment of this invention.

Referring to the drawings, FIG. 22 shows any type of array of horizontal-individual-tiles 10 or modular-accessible-tiles (M.A.T., C-M.A.T., or R-C-M.A.T.) loose laid by gravity, frictioin, and accumulated-interactive-assemblage by means of flexible joints (DIFFJ) of elastomeric-adhesive-sealant 14, disposed over a cushioning-granular-substrate 40 within exterior environments, wherein the cushioning-granular-substrate 40 is thus disposed over any type of horizontal-base-surface 51 of granular subgrade soil 51 or granular subgrade subsoil 51 or granular substrate 51 at grade or below grade.

This cushioning-granular-substrate 40 may be any type of suitable granular material, such as, sand, fine sand, sandy loam, fine sandy loam, loam, silt loam, light clay loam, clay loam, heavy clay loam, clay, compost, perlite, vermiculite, fine gravel, fine pea gravel, pea gravel, haydite, cinders, and any similar type of granular materials where the cushioning-granular-substrate 40 functions to cushion and support the bottom of arrays of horizontal-individual-tiles 10 and arrays of modular-accessible-tiles (M.A.T., C-M.A.T., and R-C-M.A.T.).

The arrays of horizontal-individual-tiles 10 or arrays of modular-accessible-tiles (M.A.T., C-M.A.T., R-C-M.A.T.) are beneficially cuttable, accessible and reassembleable by means of dynamic-interactive-fluidtight-flexible-joints (DIFFJ), providing important top accessibility to a cushioning-granular-substrate 40. The cushioning-granular-substrate 40 provides a leveling course and fill course for accepting and accommodating conduits and piping while also providing support for the tile arrays while providing the ability to accept and accommodate varying combinations of:

Metal and plastic conduits carrying electrical and electronic conductors 53

Metal and plastic piping 54 for distribution of fluids, chilled fluid return and supply, hot fluid return and supply, and the like Metal or plastic pipe coil with working fluid 52 of any functionally desired layout, disposed within a cushioning-granular-substrate 40 reasonably close to the tile array for passage of working fluid through pipe coil 52 to:

Transfer heat from the pipe coil with working fluid 52 to the encapsulationg cushioning-granular-substrate 40 and then transfer of the heat to the tile array which is supported by the cushioning-granular-substrate 40 supporting:

An array of horizontal-individual-tiles 10, or

An array of modular-accessible-tiles (M.A.T., C-M.A.T., or R-C-M.A.T., as the case may be)

so the supported tile array is a beneficial low Δt radiative surface for radiative heating exterior occupied large surface areas, while concurrently serving for functional paving for walks, patios, promenades, driveways, streets, roads, parking lots, and the like, using low Δt heat which is more plentifully available and less costly at higher efficiencies when usable at a low differential Δt, as permitted by the teachings of this invention, from exterior sources or from interior sources, such as, lights, waste heat, solar sources, and the like, Transfer heat by absorbing heat from The array of horizontal-individual-tiles 10, or The array of modular-accessible-tiles (M.A.T., C-M.A.T., or R-C-M.A.T., as the case may be)

to the supporting cushioning-granular-substrate 40 encapsulating the pipe coil with working fluid 52 with a cooler working fluid to beneficially absorb heat so that the tile array is an absorptive surface of low Δt heat from arrays of horizontal-individual-tiles 10 or modular-accessible-tiles (M.A.T., C-M.A.T., or R-C-M.A.T.) for surfaces facing the sun for beneficially receiving beam and diffuse radiation where efficiency is greates when operating at a low Δt while concurrently serving for functional paving for walks, patios, promenade decks, driveways, streets, roads, parking lots, and the like Beneficial drainage below tile array where drain tiles are functionally required and installed The dynamic-interactive-fluidtight-flexible-joints (DIFFJ) of elastomeric-adhesive-sealant 14 provide dynamic interactive ability to respond to frost heave while the joints (DIFFJ) are fluidtight to the passage of fluids when the embodiment of this invention functions for paving exterior walks, patios, driveways, streets, roads, parking lots, and the like.

Referring to the drawings, FIGS. 6 J.B.M. thru 13 J.B.M. illustrate alternate, interchangeable continuous-protective-strip embodiments for preventing damage to flat conductor cable and any other type of electrical and electronic conductor systems when cutting through the flexible joints between adjacent modular-accessible-tiles with a knife or sharp tool for accessibility to the conductors and to prevent the self-leveling-elastomeric-adhesive-sealant from leaking out past an imperfectly-made bottom seal of elastomeric-adhesive-sealant in the bottom of the flexible joints between adjoining modular-accessible-tiles and making later accessibility to the conductors and the horizontal-base-surface difficult or impossible, continuous-protective-strips are inserted in the bottom of the joints between adjacent modular-accessible-tiles before installing the sealants in the joints. The narrow continuous-protective-strips may be of various metallic or plastic materials and the like and various thicknesses and of any cross-sectional shape which will protect the conductors from being cut when cutting the dynamic-interactive-fluidtight-flexible-joints for accessibility below the modular-accessible-tiles for relocation or accessibility to the conductors, prevent the elastomeric-adhesive-sealant joining together of the modular-accessible-tiles at any point not accessible for cutting through from the top side when accessibility is needed for conductors and piping, renovation, and recycling of the modular-accessible-tiles, and prevent uncured self-leveling-elastomeric-adhesive-sealant from running out the bottom of the joints and bonding the modular-accessible-tiles permanently to each other or to the various layers below. The narrow continuous-protective-strips may or may not have a slightly oversized strip of foam affixed to the bottom side or loose laid below the continuous-protective-strip to provide enhanced seal. The entire top surface of the continuous-protective-strip must continuously be coated with some type of bond breaker coating (unless the selected metal or plastic of which the continuous-protective-strip is made has inherent bond breaking characteristics), such as Teflon bond breaker or the application of a continuous thin, slightly oversized in width foam strip adhered to the top of the continuous-protective-strip as a continuous top surface bond break to insure ease of disassembly of adjacent joined together modular-accessible-tiles. Some of the cross-sectional shapes in which the continuous-protective-strips may be formed or extruded are flat, concave, convex, 'C', 'U', 'V', 'W', 'ɲ', inverted 'U', 'ʍ', 'W' and 'ʊ', convex 'U', inverted convex 'U', concave 'U', inverted concave 'U', and the like cross-sectional shapes.

When the seal of the continuous-protective strip with foam strip affixed to the bottom is absolutely fluidtight, the flexible joints between adjacent modular-accessible-tiles may be formed by filling the joints full to the top with self-leveling-elastomeric-adhesive-sealant. When the seal of the continuous-protective-strip, with or without the foam strip, is not absolutely fluidtight, the flexible joint must be filled in two steps.

First, a continuous flow of gun-grade-elastomeric-adhesive-sealant is applied to the bottom of the joint over the continuous-protective-strip to form a fluidtight bottom seal to contain the second layer of self-leveling-elastomeric-adhesive-sealant. After initial cure of the bottom seal, a second layer of self-leveling-elastomeric-adhesive-sealant is applied to fill the joint to the top to form the cuttable, accessible, reassembleable dynamic-interactive-fluidtight-flexible-joint to join the adjacent modular-accessible-tiles one to another.

Various configurations of continuous-protective-strips are illustrated by drawings in FIGS. 6 J.B.M., 7 J.B.M., 8 J.B.M., 9 J.B.M., 10 J.B.M., 11 J.B.M., 12 J.B.M., and 13 J.B.M.

To communicate and clarify the disclosure of this invention, the following terms are often utilized for communicative and illustrative purpose within the written disclosure and the drawings:

H.I.T.: Horizontal-individual-tiles
M.A.T.: Modular-accessible-tile
C-M.A.T.: Composite-modular-accessible-tile
R-C-M.A.T.: Resilient-composite-modular-accessible-tile
J.B.M.: Joint between modular-accessible-tile
DIFFJ: Dynamic-interactive-fluidtight-flexible-joint
T-Z-DIFFJ: Tension Zone - Dynamic-interactive-fluidtight-flexible-joint
C-Z-DIFFJ: Compression Zone - Dynamic-interactive-fluidtight-flexible-joint In the various embodiments of this invention, the modular-accessible-tiles, the composite-modular-accessible-tiles, and the resilient-composite-modular-accessible-tiles, denoted as 'M.A.T.', 'C-M.A.T.', and 'R-C-M.A.T.', respectively, on the drawings and in the written disclosure may be beneficially assembled one to another to their adjacent similar counterparts by any one of the eight embodiments (shown on drawing FIGS. 6 J.B.M. thru 13 J.B.M.) of the J.B.M. Joint Between Modular-Accessible-Tiles.

Referring to the drawings, FIG. 6 J.B.M. illustrates a continuous-protective-strip which is a continuous protective slightly concave strip 1 which is formed of slightly oversized spring metal or plastic with continuous Teflon or other type bond breaker coating deposited on the top surfacing of the slightly concave strip 1 with a slightly oversized foam strip 36 adhered to the bottom surface for pressing into position for accommodating variations in the width or the dynamic-interactive-fluidtight-flexible-joint (DIFFJ) between adjacent gravity-held-in-place-load-bearing-horizontal-composite-modular-accessible-tiles denoted as modular-accessible-tiles (M.A.T.) for sealing the bottom of the joint (DIFFJ) while protecting conductors, piping, and the like below cuttable, accessible and reassembleable dynamic-interactive-fluidtight-flexible-joint (DIFFJ), with this configuration of continuous-protective-strip 1 applicable interchangeably to cuttable, accessible and reassembleable joints (DIFFJ) for assembling various modular-accessible-tiles (M.A.T., C-M.A.T. or R-C-M.A.T.) one to another into arrays of modular-accessible-tiles (M.A.T.) illustrated in drawings for FIGS. 6, 7, 8, 9, 10, 11, 12, 13, 14 and 15.

Referring to the drawings, FIG. 7 J.B.M. illustrates a continuous-protective-strip 2 which is a continuous protective slightly concave strip with a continuous thin, slightly oversized in width foam strip 9 adhered to the top surface as a bond breaker in the elastomeric-adhesive-sealant-joint 14, which is formed of slightly oversized spring metal or plastic adhered to the top with a slightly oversized foam strip 36 adhered to the bottom surface of the slightly concave strip for pressing into position for accommodating variations in the width of the dynamic-interactive-fluidtight-flexible-joint (DIFFJ) between adjacent gravity-held-in-place-load-bearing-horizontal-composite-modular-accessible-tiles denoted as modular-accessible-tiles (M.A.T.) for sealing the bottom of the joint (DIFFJ) while protecting conductors, piping, and the like below cuttable, accessible, and reassembleable dynamic-interactive-fluidtight-flexible-joints (DIFFJ), with this configuration of continuous-protective-strip 2 applicable interchangeably to cuttable, accessible, and reassembleable joints (DIFFJ) for assembling various modular-accessible-tiles (M.A.T., C-M.A.T., R-C-M.A.T.) one to another into arrays of modular-accessible-tiles (M.A.T.) illustrated in drawings for FIGS. 6, 7, 8, 9, 10, 11, 12, 13, 14 and 15.

Referring to the drawings, FIG. 8 J.B.M. illustrates a continuous-protective-strip 3 which is a continuous protective slightly undersized flat metal or plastic with a continuous thin slightly oversized in width foam strip 9 adhered to top surface of continuous-protective-strip 3 as a bond breaker to facilitate cutting, accessiblity, and disassembly of J.B.M. Joint Between Modular-Accessible-Tiles, with continuous-protective-strip 3 also serving to protect conductors, piping, and the like below cuttable, accessible and reassembleable dynamic-interactive-fluidtight-flexible-joints (DIFFJ) wherein the (J.B.M.) Joint Between Modular-Accessible-Tiles (M.A.T.) is further formed by placing a continuous flow of gun-grade-elastomeric-adhesive-sealant 15 at the bottom to form a fluidtight bottom seal to contain a second application of continuous filling of the joint (DIFFJ) full to the top with self-leveling-elastomeric-adhesive-sealant 14 for the full width and height of the joint (DIFFJ) in a manner such that the self-leveling-elastomeric-adhesive-sealant 14 does not flow below the continuous bottom seal to insure future disassembly of the joint (DIFFJ) while protecting conductors, piping, and the like below the cuttable, accessible, and relocatable dynamic-interactive-fluidtight-flexible-joint (DIFFJ) with this configuration of continuous-protective-strip 3 applicable interchangeably to cuttable, accessible, and reassembleable joints (DIFFJ) for assembling various modular-accessible-tiles (M.A.T., C-M.A.T., R-C-M.A.T.) one to another into arrays of modular-accessible-tiles (M.A.T.) illustrated in drawings for FIGS. 6, 7, 8, 9, 10, 11, 12, 13, 14 and 15.

Referring to the drawings, FIG. 9 J.B.M. illustrates a continuous-protective-strip 4 which is a continuous protective inverted 'U' strip with a concave top of slightly oversized spring metal or plastic with continuous Teflon or other type bond breaker coating deposited on top and side surfacing of continuous-protective inverted 'U' strip 4, with a slightly oversized foam strip 36 core projecting from the bottom surface for pressing into position for accommodating variations in width of the dynamic-interactive-fluidtight-flexible-joint (DIFFJ) between adjacent gravity-held-in-place-load-bearing-horizontal-composite-modular-accessible-tiles formed and denoted as resilient-composite-modular-accessible-tiles (R-C-M.A.T.) for sealing the bottom of the joint (DIFFJ) while protecting conductors, piping, and the like below cuttable, accessible and reassembleable dynamic-interactive-fluidtight-flexible-joints (DIFFJ), with this configuration of continuous-protective-strip 4 applicable interchangeably to cuttable, accessible and reassembleable joints (DIFFJ) for assembling various modular-accessible-tiles (M.A.T., C-M.A.T., R-C-M.A.T.) one to another into arrays modular-accessible-tiles illustrated in drawings for FIGS. 6, 7, 8, 9, 10, 11, 12, 13, 14 and 15.

Referring to the drawings, FIG. 10 J.B.M. illustrates a continuous-protective-strip 5 which is a continuous protective 'V' strip with continuous Teflor or other type bond breaker coating deposited on top surfacing of continuous protective 'V' strip, the protective strip being of slightly oversized spring metal or plastic with a slightly oversized foam strip 36 adhered to the bottom surface for pressing into position for accommodating variations in width of the dynamic-interactive-fluidtight-flexible-joint (DIFFJ) between adjacent gravity-held-in-place-load-bearing-horizontal-composite-modular-accessible-tiles denoted as composite-modular-accessible-tiles (C-M.A.T.) for sealing the bottom of the joint (DIFFJ) while protecting conductors, piping, and the like below cuttable, accessible, and reassembleable dynamic-interactive-fluidtight-flexible-joints (DIFFJ), with this configuration of continuous-protective-strip 5 applicable interchangeably to cuttable, accessible and reassembleable joints (DIFFJ) for assembling various modular-accessible-tiles (M.A.T., C-M.A.T., R-C-M.A.T.) one to another into arrays of modular-accessible-tiles illustrated in drawings for FIGS. 6, 7, 8, 9, 10, 11, 12, 13, 14 and 15.

Referring to the drawings, FIG. 11 J.B.M. illustrates a continuous-protective-strip 6 which is a continuous protective 'W' strip of slightly oversized spring metal or plastic with continuous Teflon or other type bond breaker coating deposited on top surfaces of continuous protective 'W' strip with a slightly oversized foam strip 36 adhered to the bottom surface for pressing into position for accommodating variations in width of the dynamic-interactive-fluidtight-flexible-joint (DIFFJ) between adjacent gravity-held-in-place-load-bearing-horizontal-composite-modular-accessible tiles denoted as composite-modular-accessible-tiles (C-M.A.T.) for sealing the bottom of the joint (DIFFJ) while protecting conductors, piping, and the like below cuttable, accessible, and reassembleable dynamic-interactive-fluidtight-flexible-joints (DIFFJ), with this configuration of continuous-protective-strip 6 applicable interchangeably to cuttable, accessible and reassembleable joints (DIFFJ) for assembling various modular-accessible-tiles (M.A.T., C-M.A.T., R-C-M.A.T.) one to another into arrays of modular-accessible-tiles illustrated in drawings for FIGS. 6, 7, 8, 9, 10, 11, 12, 13, 14 and 15.

Referring to the drawings, FIG. 12 J.B.M. illustrates a continuous-protective-strip 7 which is a continuous protective undersized flat metal or plastic strip with continuous Teflon or other type bond breaker coating deposited on top surfacing of continuous protective undersized flat strip with a slightly oversized foam strip 36 adhered to the bottom surface for pressing into position for accommodating variations in width of the dynamic-interactive-fluidtight-flexible-joint (DIFFJ) between adjacent gravity-held-in-place-load-bearing-horizontal-composite-modular-accessible-tiles formed as and denoted as resilient-composite-modular-accessible-tiles (R-C-M.A.T.) for sealing the bottom of the joint (DIFFJ) where the width of the joint (DIFFJ) varies considerably while protecting conductors, piping, and the like below cuttable, accessible, and reassembleable dynamic-interactive-fluidtight-flexible-joints (DIFFJ), with this configuration of continuous-protective-strip 7 applicable interchangeably to cuttable, accessible and reassembleable joints (DIFFJ) for assembling various composite-modular-accessible-tiles (M.A.T., C-M.A.T., R-C-M.A.T.) one to another into arrays of modular-accessible-tiles illustrated in drawings for FIGS. 6, 7, 8, 9, 10, 11, 12, 13, 14 and 15.

Referring to the drawings, FIG. 13 J.B.M. illustrates a continuous-protective-strip 8 which is a continuous protective inverted 'U' strip with convex top and sides of slightly oversized spring metal or plastic with continuous Teflon or other type bond breaker coating deposited on top surfaces of continuous protective inverted 'U' strip for pressing into position for accommodating variations in width of the dynamic-interactive-fluidtight-flexible-joint (DIFFJ) between adjacent gravity-held-in-place-load-bearing-horizontal-composite-modular-accessible-tiles formed as and denoted as resilient-composite-modular-accessible-tiles (R-C-M.A.T.) while protecting conductors, piping, and the like below cuttable, accessible, and reassembleable dynamic-interactive-fluidtight-flexible-joints (DIFFJ), with this configuration continuous-protective-strip 8 applicable interchangeably to cuttable, accessible and reassembleable joints (DIFFJ) for assembling various modular-accessible-tiles (M.A.T., C-M.A.T., R-C-M.A.T.) one to another into arrays of modular-accessible-tiles illustrated in drawings for 6, 7, 8, 9, 10, 11, 12, 13, 14 and 15.

Another means for protecting flat conductor cable when cutting relies on a plurality of dynamic-interactive-fluidtight-flexible-joints (DIFFJ) between the composite-modular-accessible-tiles to provide continuous metallic strips of from 3 inch to 6 inch width positioned below modular-accessible-tiles in an angular grid pattern to one another in a network matching the joint pattern below center of all dynamic-interactive-fluidtight-flexible-joints between adjacent modular-accessible-tiles to provide a protective layer for flat conductor cable 19 when cutting the dynamic-interactive-fluidtight-flexible-joints (DIFFJ) for accessibility to flat conductor cable 19 and east of release of composite-modular-accessible-tiles for one another when cutting the dynamic-interactive-fluidtight-flexible-joints for access below the modular-accessible-tiles.

Referring to the drawings, FIGS. 10 J.B.M., 11 J.B.M., 12 J.B.M. and 13 J.B.M. illustrate the inherently cuttable, accessible and reassembleable dynamic-interactive-fluidtight-flexible-joints (DIFFJ) utilized to assemble gravity-held-in-place-load-bearing-horizontal-composite-modular-accessible-tiles denoted as composite-modular-accessible-tiles (C-M.A.T.), and as resilient-composite-modular-accessible-tiles (R-C-M.A.T.), illustrated by the referenced Figures, into an array of gravity-held-in-place-load-bearing-horizontal-composite-modular-accessbile-tiles (C-M.A.T. and R-C-M.A.T.) providing the important top full accessibility to any type of three-dimensional-passage-and support-matrix 38 formed to accept and accommodate varying combinations of any, none or all of the following:

Electrical and electronic plurality of single and multiple insulated conductors

Plastic and metallic conduits and raceways 45

Plastic and metallic supply and return piping 46 carrying fluids, including but not limited to hot fluids, chilled fluids, absorption fluids, and fire protection fluids by Passage of gases through the inherent resulting plenum Outlet-junction-boxes 47

The bottom layer of the three-dimensional-passage-and-support-matrix 38 assembles into a modular grid network a plurality of support plinths serving to form coordinating indices for the orderly separation and passage of the plurality of accepted and accommodated conductors, conduits, and piping while the plurality of assembled support plinths importantly provides the plurality of supports for supporting the array of gravity-held-in-place-load-bearing-horizontal-composite-modular-accessible-tiles (C-M.A.T. and R-C-M.A.T.) with the plurality of required cuttable, accessible and reassembleable dynamic-interactive-fluidtight-flexible-joints (DIFFJ) surrounding all adjacent perimeter sides 12 to assemble the array of composite-modular-accessible-tiles (C-M.A.T.) and resilient-composite-modular-accessible-tiles (R-C-M.A.T.) by gravity, friction, and accumulated-interactive-assemblage.

Referring to the drawings, FIGS. 10 J.B.M., 11 J.B.M., 12 J.B.M. and 13 J.B.M. illustrate the inherenly cuttable, accessible, and reassembleable dynamic-interactive-fluidtight-flexible-joints (DIFFJ) utilized to assemble gravity-held-in-place-load-bearing-horizontal-composite-modular-accessible-tiles denoted as composite-modular-accessible-tiles (C-M.A.T.) and as resilient-composite-modular-accessible-tiles (R-C-M.A.T.), illustrated in the referenced Figures, into an array of gravity-held-in-place-load-bearing-horizontal-composite-modular-accessible-tiles (C-M.A.T. and R-C-M.A.T.) providing the important top full accessibility to any type of three-dimensional-passage-and-support-matrix 38 formed to accept and accommodate varying combinations of any, none or all of the following:

Electrical and electronic plurality of single and multiple insulated conduits

Plastic and metallic conduits and raceways 45

Plastic and metallic supply and return piping 46 carrying fluids, including but not limited to hot fluids, chilled fluids, absorption fluids, and fire protection fluids by the fluid-containment system Passage of gases through the inherent resulting plenum Outlet-junction-boxes 47

The three-dimensional-passage-and-support-matrix 38 is a modular grid network of a plurality of individual support plinths serving to form coordinating indeces for the orderly separation and passage of the plurality of the accepted and accommodated conductors, conduits, and piping while the plurality of assembled support plinths importantly provides the plurality of independent supports for supporting the array of gravity-held-in-place-load-bearing-horizontal-composite-modular-accessible-tiles (C-M.A.T. and R-C-M.A.T.) with the plurality of required cuttable, accessible, and reassembleable dynamic-interactive-fluidtight-flexible-joints (DIFFJ) surrounding all adjacent perimeter sides 12 to assemble the array of composite-modular-accessible-tiles (C-M.A.T.) and resilient-composte-modular-accessible-tiles (C-R-M.A.T.) by gravity, friction, and accumulated-interactive-assemblage.

The preferred embodiment of this invention, when disposed over at least one or more horizontal-disassociation-cushioning-layers and functionally required flat conductor cable is the Seventh Embodiment Of This Invention, depicted in the drawings by FIG. 7.

The preferred embodiment of this invention when disposed over a three-dimensional-passage-and-support-matrix, with at least one or more horizontal-disassociation-cushioning-layers sandwiched above or below the three-dimensional-passage-and-support-matrix, is the Tenth Embodiment Of This Invention, depicted in the drawings by FIG. 10.

A preferred way to assemble and install the modular-accessible-tiles of this invention denoted as

| | |
|---|---|
| modular-accessible-tiles | M.A.T. |
| composite-modular-accessible-tiles | C-M.A.T. |
| resilient-composite-modular-accessible-tiles | R-C-M.A.T. |

is to assemble one to another at all perimeter sides of the modular-accessible-tiles (M.A.T., C-M.A.T., R-C-M.A.T., R-C-M.A.T.) with accessible and resealable dynamic-interactive-fluidtight-flexible-joints, all floating loose laid over flat conductor cable disposed over or under at least one horizontal-disassociation-cushioning-layer accommodating variations in thickness of the flat conductor cable or disposed over the three-dimensional-passage-and-support-matrix, with at least one horizontal-disassociation-cushioning-layer at points of contact bearing.

A preferred way to manufacture the modular-accessible-tiles of this invention denoted as

| | |
|---|---|
| modular-accessible-tiles | M.A.T. |
| composite-modular-accessible-tiles | C-M.A.T. |
| Resilient-composite-modular-accessible-tiles | R-C-M.A.T. |

is to have precision-sized horizontal-composite-assemblage-sheets with the perimeter edges extended on all sides an equal amount to one-half the width of the dynamic-interactive-fluidtight-flexible-joints between the adjacent modular-accessible-tiles (M.A.T., C-M.A.T., R-C-M.A.T.) less a fractional assemblage and manufacturing tolerance to facilitate spacing the modular-accessible-tiles (M.A.T., C-M.A.T., R-C-M.A.T.) and alignment with properly aligned, uniform joint width between installed modular-accessible-tiles (M.A.T., C-M.A.T., R-C-M.A.T.) and also to provide protection to the exposed-to-view perimeter edges of modular-accessible-tiles (M.A.T., C-M.A.T., R-C-M.A.T.) when being handled and transported in the factory, in shipment, and when handled at the jobsite.

Another preferred way to manufacture the modular-accessible-tiles of this invention denoted as

| | |
|---|---|
| modular-accessible-tiles | M.A.T. |
| composite-modular-accessible-tiles | C-M.A.T. |
| resilient-composite-modular-accessible-tiles | R-C-M.A.T. |

is to have a plurality of horizontal-individual-tiles assembled and adhered to a modular-horizontal-disassociation-cushioning-layer or a modular-slip-sheet-temporary-containment or a plastic or metallic horizontal-composite-assemblage-sheet with edges turned or formed up an amount at least equal to the thickness of the horizontal-individual-tiles to form a modular-temporary-containment whereby the corners of the turned-up edges may be heat sealed fluidtight or made fluidtight by other suitable means with a suitably engineered adhesive to provide a uniform width joint between all adjacent horizontal-individual-tiles, with self-leveling-elastomeric-adhesive-sealant formulated to be the suitably engineered adhesive for adhering the bottom of the horizontal-individual-tiles to the top surface of the modular-temporary-containment acting to prevent the self-leveling-elastomeric-adhesive-sealant from running out between the bottom of the horizontal-individual-tiles and the top of the modular-temporary-containment before setting up of the elastomeric-adhesive-sealant.

The modular-temporary-containment utilized to keep the self-leveling-elastomeric-adhesive-sealant from dripping or draining through onto production equipment with the ensuing expensive breaking down and cleanup of production equipment. The modular-temporary-containment is utilized as a separator for earlier horizontal stacking of modular-accessible-tiles (M.A.T., C-M.A.T., R-C-M.A.T.) in a plurality of layers than is practical with the omission of the modular-temporary-containment. Turned-up edges of the modular-temporary-containment are trimmed off upon the curing of the self-leveling-elastomeric-adhesive-sealant or, in the case of metallic horizontal-composite-assemblage-sheets, the turned-up edge may be formulated to remain with the finish product. Also the modular-temporary-containment may be beneficially sized to a multiple size of a plurality of size selected for modular-accessible-tile and may be readily trimmed to form a plurality of selected modular-accessible-tile sizes upon curing of the elastomeric-adhesive-sealant.

It is obvious to one skilled in the art that the perimeter edge of the plastic and metallic edge of a variety of horizontal-composite-assemblage-sheets, as well as a variety of horizontal-disassociation-cushioning-layer edges and slip sheet eddges may be stamped, formed, folded by any means to form temporary or permanent containment forms and pans for containment of adhesion means and means of filling the joint by gravity, by setting the horizontal-individual-tiles into properly formulated self-leveling-elastomeric-adhesive-sealant, or pressure filling the joints as well as production manufacturing in larger containment sheets and cutting them into sizes selected for the modular-accessible-tiles.

The teachings of this invention disclose recessed rotated outlet-junction-boxes whereas it is to be understood that conventional surface terminals for flat conductor cable, as well as conventional surface terminals using conduit, raceways, flexible metallic conduit, flexible plastic cabling, and the like can be readily adapted for use with the arrays of modular-accessible-tiles (M.A.T., C-M.A.T., R-C-M.A.T.) as disclosed in the teachings of this invention as shown in FIGS. 14 and 15.

The above has been offered for illustrative purposes only, and is not intended to limit the invention of this application, which is as further defined in the claims below.

That which is claimed is:

1. An array of gravity-held-in-place-horizontal-modular-accessible-tiles, comprising, in combination, a horizontal-base-surface, a cushioning-granular-substrate disposed over said horizontal-base-surface, and a plurality of said modular-accessible-tiles loose laid over said cushioning-granular-substrate, said modular-accessible-tiles joined one to another into said array of modular-accessible-tiles by means of a dynamic-interactive-fluidtight-flexible-joint comprising an elastomeric sealant.

2. The array of modular-accessible-tiles of claim 1 in which said cushioning-granular-substrate comprises a material selected from the group consisting of gravel, loam, sand, soil, compost, perlite, vermiculite, haydite, and cinders.

3. The array of modular-accessible-tiles of claim 1 in which said horizontal-base-surface comprises a material selected from the group consisting of at-grade and below-grade granular subgrade soils, granular subgrade subsoils, and granular substrates.

4. The array of modular-accessible-tiles of claim 1 in which said cushioning-granular-substrate accommodates one or more items selected from the group consisting of metal and plastic conduits carrying electrical and electronic conductors, metal and plastic piping distributing gases, fluids, chilled fluid return and supply and hot fluid return and supply, metal and plastic pipe coils carrying working fluids and transferring heat from said pipe coils to said cushioning-granular-substrate and from said cushioning-granular-substrate to said pipe coils, voids for passage of gases, and open drainage piping.

5. The array of modular-accessible-tiles of claim 1 in which one or more of said modular-accessible-tiles is removed to provide accessiblity to said cushioning-granular-substrate by means of double cutting said dynamic-interactive-fluidtight-flexible-joint with cuts selected from the group of spaced-apart parallel vertical cuts forming a spaced-apart opening void, spaced-apart parallel sloping cuts forming a spaced-apart opening void, and spaced-apart parallel converging sloping cuts to form a vee open on the top side and closed on the bottom, said cuts forming a void into which an elastomeric sealant may be placed to reseal said joint after replacement of said removed modular-accessible tile.

6. The array of modular-accessible-tiles of claim 1 in which said array is located in an enclosed interior environmental occupied space.

7. The array of modular-accesible-tiles of claim 1 in which said array is located in an exterior environment.

8. The array of modular-accessible-tiles of claim 1 in which said array is load bearing.

9. The array of modular-accessible-tiles of claim 1 in which said array non-load bearing.

10. An array of gravity-held-in-place-load-bearing-horizontal-modular-accessible-tiles, comprising, in combination, a horizontal-base-surface, a three-dimensional-passage-and-support-matrix disposed over said horizontal-base-surface, and a plurality of modular-accessible-tiles loose laid over said three-dimensional-passage-and support-matrix, each said modular-accessible-tile comprising a cementitious tile, said modular-accessible-tiles joined one to another into said array of modular-accessible-tiles by means of a dynamic-interactive-fluidtight-flexible-joint comprising an elastomeric sealant.

11. The array of modular-accessible-tiles of claim 10 in which said three-dimensional-passage-and support-matrix comprises a network of plinths accommodating one or more conductors disposed on one or more coplanar axes, in one or more layers, and in one or more intercommunicating layers and selected from the group consisting of electrically insulated electrical and electronic conductors, metal and plastic conduits carrying electrical and electronic conductors, metal and plastic piping for distribution of fluids, chilled fluid return and supply and hot fluid return and supply, and metal and plastic pipe coils with working fluids.

12. The array of modular-accessible-tiles of claim 10 in which said three-dimensional-passage-and-support-matrix comprises a plurality of load-bearing outlet-junction-boxes modularly disposed at diagonally opposite corners of said modular-accessible-tiles and forming accessible indexing connectivity nodes, said outlet-junction-boxes having visible access covers flush with the top surface of said modular-accessible-tiles, an impact sound isolation horizontal-disassociation-cush-joining-layer placed below each said outlet-junction-box.

13. The array of modular-accessible-tiles of claim 10 in which said cementitious tile is reinforced by means selected from the group consisting of metal reinforcement, plastic reinforcement, metallic-fiber reinforcement, and plastic fiber reinforcement.

14. An array of gravity-held-in-place-load-bearing-horizontal-composite-modular-accessible-tiles, comprising, in combination, a horizontal-base-surface, a horizontal-disassociation-cushioning-layer loose laid over said horizontal-base-surface, one or more conductors selected from the group consisting of flat conductor cables, ribbon conductors, and individual conductors accommodated in said horizontal-disassociation-cushioning-layer, and a plurality of said composite-modular-accessible-tiles loose laid over said horizontal-disassociation-cushioning-layer and overlying said conductors and joined one to another by means of a dynamic-interactive-fluidtight-flexible-joint comprising an elastomeric sealant, each said composite-modular-accessible-tile comprising a metallic horizontal-composite-assemblage-sheet and a plurality of horizontal-individual-tiles adhered to the top surface of said horizontal-composite-assemblage-sheet and joined one to another by means of a dynamic-interactive-fluidtight-flexible-joint comprising an elastomeric sealant, said metallic horizontal-composite-assemblage-sheet providing continuous metallic grounding of said conductors and the terminals of said conductors by mechanical means without bridging the impact sound isolation improvements of said horizontal-disassociation-cushioning-layer.

15. The array of composite-modular-accessible-tiles of claim 14 in which a metallic horizontal-composite-assemblage-sheet is placed below said array of composite-modular-accessible-tiles and outlet-junction-boxes are mechanically fastened to said metallic horizontal-composite-assemblage-sheet.

16. An array of gravity-held-in-place-load-bearing-horizontal-composite-modular-accessible-tiles, comprising, in combination a horizontal-base-surface, a three-dimensional-passage-and support-matrix disposed over said horizontal-base-surface, and a plurality of composite-modular-accessible-tiles loose laid over said three-dimensional-passage-and-support-matrix, each said composite-modular-accessible-tile comprising a cementitious tile adhered to the top surface of a horizontal-composite-assemblage-sheet, said composite-modular-accessible-tiles joined one to another into said array of composite-modular-accessible-tiles by means of a dynamic-interactive-fluidtight-joint comprising an elastomeric sealant.

17. The array of composite-modular-accessible-tiles of claim 16 in which said horizontal-composite-assemblage-sheet is selected from the group consisting of metal and plastic.

18. An array of gravity-held-in-place-load-bearing-horizontal-resilient-composite-modular-accessible-tiles, comprising, in combination, a horizontal-base-surface, a three-dimensional-passage-and-support-matrix disposed over said horizontal-base-surface, and a plurality of resilient-composite-modular-accessible-tiles loose laid over said three-dimensional-passage-and-support-matrix, each said resilient-composite-modular-accessible-tile comprising a cementitious tile adhered to the top surface of a horizontal-disassociation-cushioning-layer, said horizontal-disassociation-cushioning layer adhered to the top surface of a horizontal-composite-assemblage-sheet, said resilient-composite-modular-accessible-tiles joined one to another into said array of resilent-composite-modular-accessible-tiles by means of a dynamic-interactive-fluidtight-flexible-joint comprising an elastomeric sealant.

19. An array of gravity-held-in-place-load-bearing-horizontal-composite-modular-accessible-tiles, comprising, in combination, a horizontal-base-surface, a cushioning-granular-substrate disposed over siad horizontal-base-surface, and a plurality of said composite-modular-accessible-tiles loose laid over said cushioning-granular-substrate, each said composite-modular-accessible-tile comprising a cementitious tile adhered to the top surface of a horizontal-composite-assemblage-sheet, said composite-modular-accessible-tiles joined one to another into said array of composite-modular-accessible-tiles by means of a dynamic-interactive-fluidtight-flexible-joint comprising an elastomeric sealant.

20. An array of gravity-held-in-place-load-bearing-horizontal-resilient-composite-modular-accessible-tiles, comprising, in combination, a horizontal-base-surface, a cushioning-granular-substrate disposed over said horizontal-base-surface, and a plurality of said resilient-composite-modular-accessible-tiles loose laid over said cushioning-granular-substrate, each said resilient-composite-modular-accessible-tile comprising a cementitious tile adhered to the top surface of a horizontal-disassociation-cushioning-layer, said horizontal-disassociation-cushioning-layer adhered to the top surface of a horizontal-composite-assemblage-sheet, said resilient-composite-modular-accessible-tiles joined one to another into said array of resilient-composite-modular-accessible-tiles by means of a dynamic-interactive-fluidtight-flexible-joint comprising an elastomeric sealant.

* * * * *